US009881728B2

(12) United States Patent
Honna et al.

(10) Patent No.: US 9,881,728 B2
(45) Date of Patent: Jan. 30, 2018

(54) HIGH FREQUENCY TRANSFORMER

(75) Inventors: Tsunehiko Honna, Kanagawa (JP); Minoru Ishikawa, Kanagawa (JP)

(73) Assignee: Seiden Mfg. Co., Ltd. (JP)

( * ) Notice: Subject to any disclaimer, the term of this patent is extended or adjusted under 35 U.S.C. 154(b) by 44 days.

(21) Appl. No.: 14/124,046

(22) PCT Filed: May 16, 2012

(86) PCT No.: PCT/JP2012/062549

§ 371 (c)(1),
(2), (4) Date: Dec. 5, 2013

(87) PCT Pub. No.: WO2012/169325

PCT Pub. Date: Dec. 13, 2012

(65) Prior Publication Data

US 2014/0104025 A1 Apr. 17, 2014

(30) Foreign Application Priority Data

Jun. 10, 2011 (JP) ..... 2011-130429

(51) Int. Cl.
*H01F 30/12* (2006.01)
*H01F 27/28* (2006.01)
(Continued)

(52) U.S. Cl.
CPC ..... *H01F 27/2828* (2013.01); *H01F 19/04* (2013.01); *H01F 27/2847* (2013.01); *H01F 27/255* (2013.01); *H01F 27/28* (2013.01)

(58) Field of Classification Search
CPC ..... H01F 30/12; H01F 30/14; H01F 27/2828; H01F 27/2847; H01F 19/04; H01F 27/255; H01F 27/28
(Continued)

(56) References Cited

U.S. PATENT DOCUMENTS 1,242,649 A * 10/1917 Stahl et al. ..... 336/187
1,347,910 A * 7/1920 Peters ..... H01F 27/38 323/340

(Continued)

FOREIGN PATENT DOCUMENTS

JP 2004-103624 A 4/2004
JP 2006-147927 A 6/2006

OTHER PUBLICATIONS

Transformer; Google NPL.*

*Primary Examiner* — Tsz Chan
*Assistant Examiner* — Kazi Hossain
(74) *Attorney, Agent, or Firm* — Banner & Witcoff, Ltd.

(57) ABSTRACT

A high frequency transformer with high conversion efficiency is provided. The high frequency transformer includes a first coil assembly 1 formed from a single flat wire, with first coils 1A that are configured by winding the flat wire edgewise plural times and that are formed at specific intervals, and a second coil assembly 2 formed from a single flat wire, with second coils 2A that are configured by winding the flat wire edgewise plural times and that are formed at specific intervals. In the primary coil assembly 1 and the secondary coil assembly 2, the primary coils 1A are disposed at intervals to each other such that a winding end portion of one of adjacent primary coils 1A opposes a winding start portion of the other of the adjacent primary coils 1A, and one of the secondary coils 2A is disposed in each interval between the primary coils 1A such that a winding start portion of each secondary coil 2A opposes the winding end portion of one of the primary coils 1A, and a winding end portion of each secondary coil 2A opposes the winding start portion of the other of the primary coils.

11 Claims, 53 Drawing Sheets

(51) Int. Cl.
*H01F 19/04* (2006.01)
*H01F 27/255* (2006.01)

(58) Field of Classification Search
USPC ..... 336/12, 5, 15, 182
See application file for complete search history.

(56) References Cited

U.S. PATENT DOCUMENTS 2,272,452 A * 2/1942 Whittle ..... H01F 19/04 333/12
2,378,884 A * 6/1945 Seifert ..... H01F 27/2852 29/602.1
3,510,858 A * 5/1970 Flanagan ..... G01L 1/086 324/207.18
4,403,205 A * 9/1983 Leibinger et al. ..... 336/180
4,445,082 A * 4/1984 Roberge ..... H01F 29/14 323/206
4,613,841 A * 9/1986 Roberts ..... H01F 17/043 336/160
5,982,262 A * 11/1999 Levin ..... 336/5
6,043,614 A * 3/2000 Tessnow ..... B60Q 1/1415 313/146
8,054,152 B2 * 11/2011 Tseng ..... H01F 27/29 336/192
8,497,755 B2 * 7/2013 Park ..... 336/12
2001/0033216 A1 * 10/2001 Shirahata ..... H01F 30/12 336/5
2006/0022783 A1 * 2/2006 Owen ..... 336/5
2006/0049903 A1 * 3/2006 Wolfgram ..... 336/180
2010/0085139 A1 * 4/2010 Yan ..... H01F 1/15358 336/221
2010/0232181 A1 * 9/2010 Nakahori ..... H01F 27/2804 363/17
2010/0321142 A1 * 12/2010 Tabuchi et al. ..... 336/184
2011/0148556 A1 * 6/2011 Park ..... 336/12
2011/0156851 A1 * 6/2011 Honna ..... H01F 27/255 336/5
2012/0013428 A1 * 1/2012 Hoevenaars ..... 336/192
2012/0038444 A1 * 2/2012 Wu ..... H01F 27/02 336/90

* cited by examiner

HIGH FREQUENCY TRANSFORMER

RELATED APPLICATION DATA

This application is a National Stage Application under 35 U.S.C. 371 of co-pending PCT application PCT/JP2012/062549 designating the United States and filed May 16, 2012; which claims the benefit of JP application number 2011-130429 and filed Jun. 10, 2011 each of which are hereby incorporated by reference in their entireties.

TECHNICAL FIELD

The present invention relates to a high frequency transformer, in particular relates to a high frequency transformer with high conversion efficiency.

BACKGROUND ART

Transformers exist in which gaps that are substantially equal in width to a flattened rectangular conductor are provided between layers of two edgewise coils 1*a*, 1*b*. The flattened rectangular conductor layers of the edgewise coils 1*a*, 1*b* are individually assembled into the gaps so as to be alternately mounted to the core, thereby reducing leakage inductance and enhancing coupling properties. In such transformers, insulation reinforcement is performed on the flat wires (Patent Document 1).

Transformers also exist that are formed by attaching, to four corners on a core 1 contact side of a core 1, a spacer 2 that is provided with notches so as to conform to the corners of the core 1. Flat wires of a primary winding 3 and a secondary winding 4 wound in coil shapes are interposed such that one cross-section length direction end thereof is inserted into a comb shaped recess portion provided to a side face of the spacer 2 that retains the winding.

In the transformer described above, the primary winding 3 and the secondary winding 4 are retained at a specific separation by projection portions of the spacer 2. Moreover, the windings are insulated from and retained at a separation to the core 1 by a main body portion of the spacer 2. An increase in temperature of the transformer can moreover be suppressed by flowing cooling air between the windings themselves and between the windings and the core 1.

Patent Document 1: Japanese Patent Application Laid-Open (JP-A) No. 2004-103624

Patent Document 2: JP-A No. 2006-147927

SUMMARY OF INVENTION

Technical Problem

However, in the transformers described in Patent Document 1 and Patent Document 2, both the edgewise coils 1*a*, 1*b* are configured from a flat wire of the same width and thickness. Application is accordingly difficult in situations such as when a high voltage alternating current is input to the primary coil and a large alternating current is desired to be output from the secondary coil, or when a large alternating current is input to the primary coil and a high voltage alternating current is desired to be output from the secondary coil.

In the above transformers, increasing the thickness and width of flat wires configuring the primary coil and the secondary coil such that a larger current flows may be considered. However there is an issue with flat wire of large cross-sectional area in that alternating current resistance increases due to the skin effect when a high frequency current flows in the primary coil and the secondary coil, and a uniform current does not readily flow inside the conductor.

In the above transformers, leakage inductance also increases at both end portions of the primary coil and the secondary coil due to alternately mounting the primary coil windings and the secondary coil windings into the core. The degree of coupling between the primary coil and the secondary coil is accordingly much lower than 1. The energy transfer efficiency from the primary side to the secondary side is accordingly well below 100%, with the issue that a large amount of loss occurs during energy transfer from the primary coil to the secondary coil.

In consideration of the above circumstances, an object of the present invention is to provide a high frequency transformer with extremely small leakage inductance, and a coupling rate that is very close to 1, such that loss during energy transfer from the primary coil to the secondary coil is extremely small.

Solution to Problem

A high frequency transformer of a first aspect of the present invention includes: a first coil assembly formed from a single flat wire, with plural first coils that are respectively configured by winding the flat wire edgewise plural times and are formed at specific intervals such that a winding end portion of one first coil out of adjacent first coils opposes a winding start portion of the other first coil out of the adjacent first coils; and a second coil assembly formed from a single flat wire, with plural second coils that are respectively configured by winding the flat wire edgewise plural times and are formed at specific intervals such that a winding end portion of one second coil out of adjacent second coils opposes a winding start portion of the other second coil out of the adjacent second coils; with the first coil assembly and the second coil assembly disposed such that the second coils are inserted between adjacent first coils such that a winding start portion of each of the second coils in the second coil assembly opposes a winding end portion of one of adjacent first coils in the first coil assembly, and a winding end portion of each of the second coils opposes a winding start portion of the other of the adjacent first coils.

In the high frequency transformer of the first aspect, the first coil assembly and the second coil assembly are respectively formed from a single flat wire. There is accordingly no need for a connection operation such as soldering to connect together respective first coils and second coils, unlike in a high frequency transformer in which plural first coils and second coils are respectively connected together to configure the first coil assembly and the second coil assembly. Manufacturing the transformer is accordingly easy, with good environmental characteristics due to being a lead-free configuration.

A high frequency transformer of a second aspect of the present invention includes: a first coil assembly including plural first coils that are respectively configured by winding a flat wire edgewise plural times, with the first coils disposed at specific intervals such that a winding end portion of one first coil out of adjacent first coils opposes a winding start portion of the other first coil out of the adjacent first coils; and a second coil assembly including plural second coils that are respectively configured by winding a flat wire edgewise plural times, with the second coils disposed at specific intervals such that a winding end portion of one second coil out of adjacent second coils opposes a winding start portion of the other second coil out of the adjacent second coils;

wherein one coil assembly out of the first coil assembly or the second coil assembly is formed from a single flat wire, the other coil assembly out of the first coil assembly and the second coil assembly is formed by connecting together in series or in parallel plural coils that are respectively configured by winding a flat wire edgewise plural times, with the first coil assembly and the second coil assembly disposed such that the second coils are inserted between adjacent of the first coils such that a winding start portion of each of the second coils in the second coil assembly opposes a winding end portion of one of adjacent first coils in the first coil assembly, and a winding end portion of each of the second coils opposes a winding start portion of the other of the adjacent first coils.

The high frequency transformer of the second aspect can accommodate various voltages and currents by selecting from series connection or parallel connection for the connection of the coils of the coil assemblies that are formed by connecting together plural coils for the first coil assembly and the second coil assembly.

A third aspect of the present invention is the high frequency transformer of either the first or the second aspect, wherein: the first coils are primary coils and the second coils are secondary coils, and the first coil assembly is a primary coil assembly and the second coil assembly is a secondary coil assembly.

In the high frequency transformer of the third aspect, both the primary coils and the secondary coils are formed by winding a flat wire edgewise plural times. The primary coils and the secondary coils are disposed alternately to one another, with configuration made such that the secondary coils are disposed between two adjacent primary coils. Leakage inductance can accordingly be made extremely small since a uniform magnetic field generated by the primary coils passes through the secondary coils when a high frequency current flows in the primary coils. The degree of coupling between the primary coils and the secondary coils is accordingly very close to 1, enabling an energy transfer rate from the primary coils to the secondary coils of almost 100%, and enabling loss during energy transfer from the primary coils to the secondary coils to be suppressed to an extremely small amount.

A fourth aspect of the present invention is the high frequency transformer of either the first or the second aspect, wherein: the first coils are secondary coils and the second coils are primary coils, and the first coil assembly is a secondary coil assembly and the second coil assembly is a primary coil assembly.

The high frequency transformer of the fourth aspect is configured such that the primary coils are inserted between two adjacent secondary coils, such that it is easy to configure a higher number of turns of the flat wire in the overall secondary coil assembly than in the primary coil assembly. The high frequency transformer is accordingly appropriately employed in applications wherein a high frequency current of a high voltage is output.

Moreover, since at least the secondary coil assembly is formed from a single continuous flat wire, there is no need for a connection operation such as soldering to connect together the secondary coils. Manufacturing is accordingly made easier than for a high frequency transformer in which the primary coil assembly and the secondary coil assembly are both configured by connecting together plural primary coils and secondary coils.

A fifth aspect of the present invention is a high frequency transformer including: plural primary coils formed by winding a flat wire edgewise plural times, and plural secondary coils formed by winding a flat wire edgewise plural times; wherein the secondary coils are disposed at intervals such that a winding end portion of one of the secondary coils and a winding start portion of another of the secondary coils that is adjacent to the one secondary coil oppose each other, and one individual of the primary coils is disposed inside each of the respective intervals such that a winding start portion of each of the primary coils opposes a winding end portion of the one secondary coil, and a winding end portion of the primary coil opposes a winding start portion of the other secondary coil, and a primary coil assembly is configured by connecting the primary coils in series or in parallel at the outside of the secondary coils so as to connect across the secondary coils, and a secondary coil assembly is configured by connecting the secondary coils in series or in parallel at the outside of the primary coils so as to connect across the primary coils.

The high frequency transformer of the fifth aspect is configured such that the primary coils are inserted between two adjacent secondary coils, such that it is easy to configure a higher number of turns of the flat wire in the overall secondary coil assembly than in the primary coil assembly. The high frequency transformer is accordingly appropriately employed in applications wherein a high voltage high frequency current is output.

A sixth aspect of the present invention is the high frequency transformer of the third aspect, wherein the number of the primary coils is 4 or more, and the number of the secondary coils is 3 or more.

The high frequency transformer of the sixth aspect exhibits excellent conversion efficiency in comparison to a high frequency transformer in which there are 2 or 3 of the primary coils and 1 or 2 of the secondary coils.

A seventh aspect of the present invention is the high frequency transformer of the fourth of the fifth aspect, wherein the number of the secondary coils is 4 or more, and the number of the primary coils is 3 or more.

The high frequency transformer of the seventh aspect exhibits excellent conversion efficiency in comparison to a high frequency transformer in which there are 1 or 2 of the primary coils and 2 or 3 of the secondary coils.

An eighth aspect of the present invention is the high frequency transformer of any one of the second to the seventh aspects, wherein an insulating member is inserted between the primary coils and the secondary coils.

In the high frequency transformer of the eighth aspect, the insulating member is inserted between the primary coils and the secondary coils, thereby maintaining an insulation distance between the primary coils and the secondary coils more uniformly in comparison to in a high frequency transformer in which the insulating member is not inserted between the primary coils and the secondary coils, thereby obtaining more reliable insulation between the primary coils and the secondary coils.

A ninth aspect of the present invention is the high frequency transformer of any one of the second to the eighth aspects, wherein the flat wire configuring the primary coil assembly and the flat wire configuring the secondary coil assembly differ from each other in width, in thickness, or in both width and thickness.

In the high frequency transformer of the ninth aspect, the flat wire configuring the primary coils and the flat wire configuring the secondary coils differ from each other in width, in thickness, or in both width and thickness. The width and thickness of the flat wires can accordingly be set to match the currents that are to flow in the primary coils and the secondary coils, such that when the current that is to flow in the secondary coils is greater than the current of the primary coils the width, the thickness or both the width and the thickness of the flat wire of the secondary coils are set greater than that of the flat wire of the primary coils, and when the current that will flow in the primary coils is greater than the current of the secondary coils, the width or the thickness or both the width and the thickness of the flat wire of the primary coils is set greater than the flat wire of the secondary coils. A high frequency transformer can accordingly be configured that is adapted for various input and output conditions.

A tenth aspect of the present invention is the high frequency transformer of any one of the second to the ninth aspects, wherein a ferrite core is inserted through the primary coil assembly and the secondary coil assembly.

In the high frequency transformer of the tenth aspect, loss during use at high frequencies is small due to employing a ferrite core as the core.

An eleventh aspect of the present invention is the high frequency transformer of the tenth aspect, wherein the ferrite core is a shell-type core.

In the high frequency transformer of the eleventh aspect, the ferrite core is a shell-type core. The ratio of the core to the coils is accordingly higher than in a high frequency transformer in which the ferrite core is a core-type core, leading to stronger characteristics of an iron machine. The high frequency transformer is accordingly suitably employed in applications with a small number of turns of the primary coils and the secondary coils, in particular in high frequency inverters (in the region of 50 kHz to 1 MHz).

A twelfth aspect of the present invention is the high frequency transformer of the tenth aspect, wherein the ferrite core is a core-type core.

In the high frequency transformer of the twelfth aspect, the ferrite core is a core-type core. The ratio of the core to the coils is accordingly lower than in a high frequency transformer in which the ferrite core is a shell-type core, leading to stronger characteristics of a copper machine. A large number of turns can accordingly be secured for the primary coils and the secondary coils, in particular giving a margin in the density of magnetic flux passing through the inside of the core in cases in which the frequency is controlled, such as in a parallel resonant inverter or in a series resonant inverter, such that the high-frequency transformer is suitably applied when widening a control range as far as low frequencies (in the region of 10 kHz to 200 kHz).

A thirteenth aspect of the present invention is the high frequency transformer of the twelfth aspect, wherein primary coil assemblies that are respectively mounted on a pair of central cores of the core-type core and secondary coil assemblies that are respectively mounted on the pair of central cores are respectively connected in series.

The high frequency transformer of the thirteenth aspect may be suitably employed in applications in which both input and output are high voltage high frequency currents.

A fourteenth aspect of the present invention is the high frequency transformer of the twelfth aspect, wherein at least one of primary coil assemblies respectively mounted on a pair of central cores of the core-type core or secondary coil assemblies respectively mounted on the pair of central cores are connected in parallel.

The high frequency transformer of the fourteenth aspect 14 may be suitably employed in applications in which at least one of the input and the output is a high frequency current with a low voltage and a large current.

A fifteenth aspect of the present invention is the high frequency transformer of any one of the second to the ninth aspects, further comprising: the primary coil assemblies and the secondary coil assemblies provided by three; three columnar cores that are formed from ferrite and are disposed at even intervals around the circumference of a circle; a top plate that is formed from ferrite and is coupled to one end of each of the columnar cores; and a bottom plate that is formed from ferrite and is coupled to the other end of each of the columnar cores; wherein the three columnar cores are respectively inserted into each of the primary coil assemblies and each of the secondary coil assemblies, and the primary coil assemblies and the secondary coil assemblies are respectively configured with a Y connection, or with a delta connection.

The high frequency transformer of the fourteenth aspect is a three-phase high frequency transformer, and therefore has three times the capacity of a single phase high frequency transformer for the same primary coils, secondary coils and leg portion cores for inserting the coils. The high frequency transformer is accordingly suitably applied in high capacity power converting equipment and high capacity power source equipment. Moreover, the basic ripple percentage of the output of a secondary side rectification circuit of a three-phase high frequency transformer is 4.2%, this being 1/10 or less than that of a single phase high frequency transformer for which an all-wavelength rectification circuit has a basic ripple percentage reaching 48%. Accordingly, it is sufficient to employ a filter with a small capacitance to reduce output ripple.

Since configuration may be made with such a filter with low capacitance, energy accumulation in the filter is also reduced. As a result, there is very little energy discharge during output short circuiting, such that very little damage to the product is sustained due to arc discharge occurring during sputtering when a high capacity DC sputtering power source device is employed, thereby enabling product yield to be improved.

Moreover, the primary coil assemblies configured from the plural primary coils inserted onto the columnar cores and the secondary coil assemblies configured from the plural secondary coils inserted onto the columnar cores may respectively be configured with either a Y connection or a delta connection. The high frequency transformer moreover includes cases in which the primary coil assemblies are configured with a Y connection and the secondary coil assemblies are configured with a Y connection, cases in which the primary coil assemblies are configured with a delta connection and the secondary coil assemblies are configured with a Y connection, cases in which the primary coil assemblies are configured with a Y connection and the secondary coil assemblies are configured with a delta connection, and cases in which both the primary coil assemblies and the secondary coil assemblies are configured with a delta connection.

Advantageous Effects of Invention

As described above, the present invention provides a high frequency transformer with high conversion efficiency that can prevent a drop in secondary output voltage during load current flow, and can also prevent heat build-up between primary coils and secondary coils since the voltage ratio of the secondary output voltage matches the turn ratio between the primary coils and the secondary coils.

BRIEF DESCRIPTION OF DRAWINGS

FIG. 6A is a front view of an example of the high frequency transformer of the first exemplary embodiment having insulation washers inserted between primary coils and secondary coils instead of an insulating member in.

DESCRIPTION OF EMBODIMENTS

1. First Exemplary Embodiment

Figure 1:
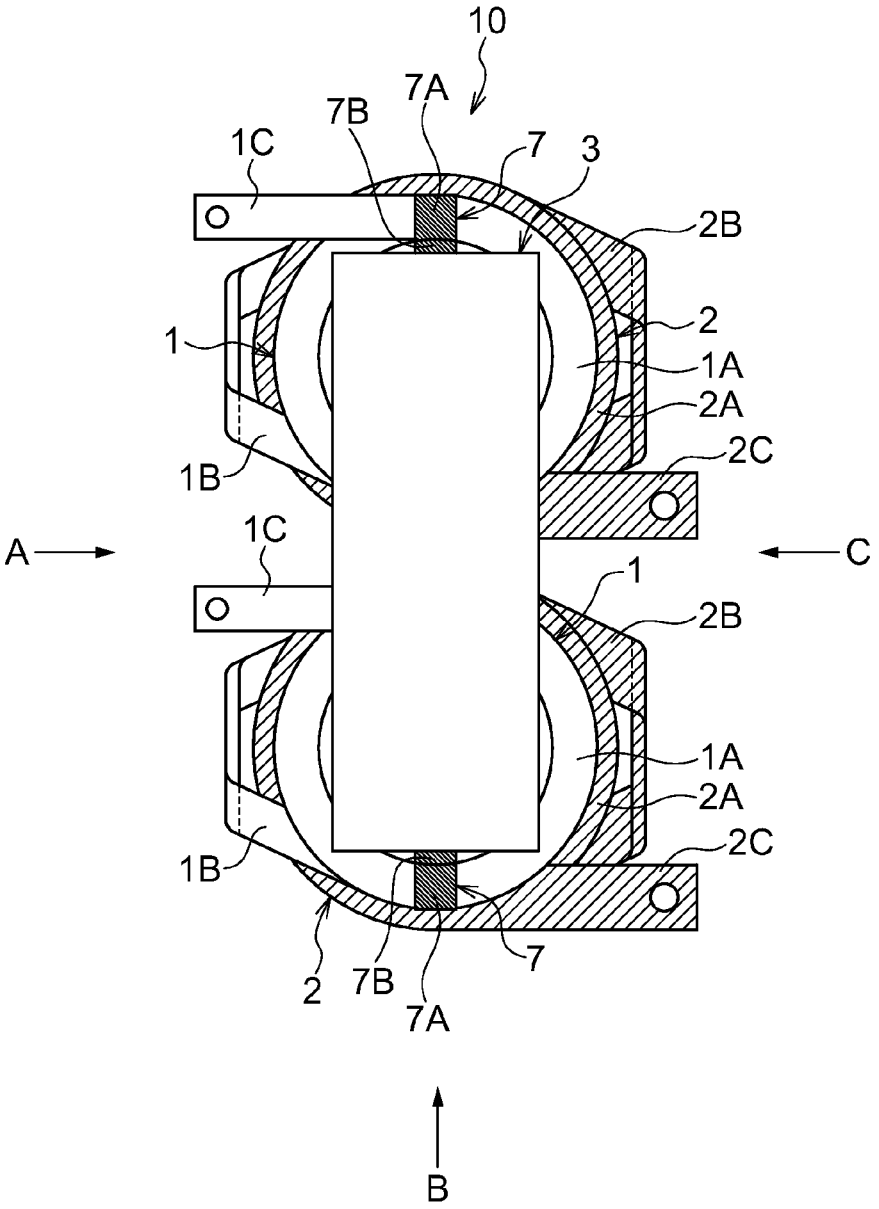
FIG. 1 is a plan view of a high frequency transformer according to a first exemplary embodiment.
Figure 2:
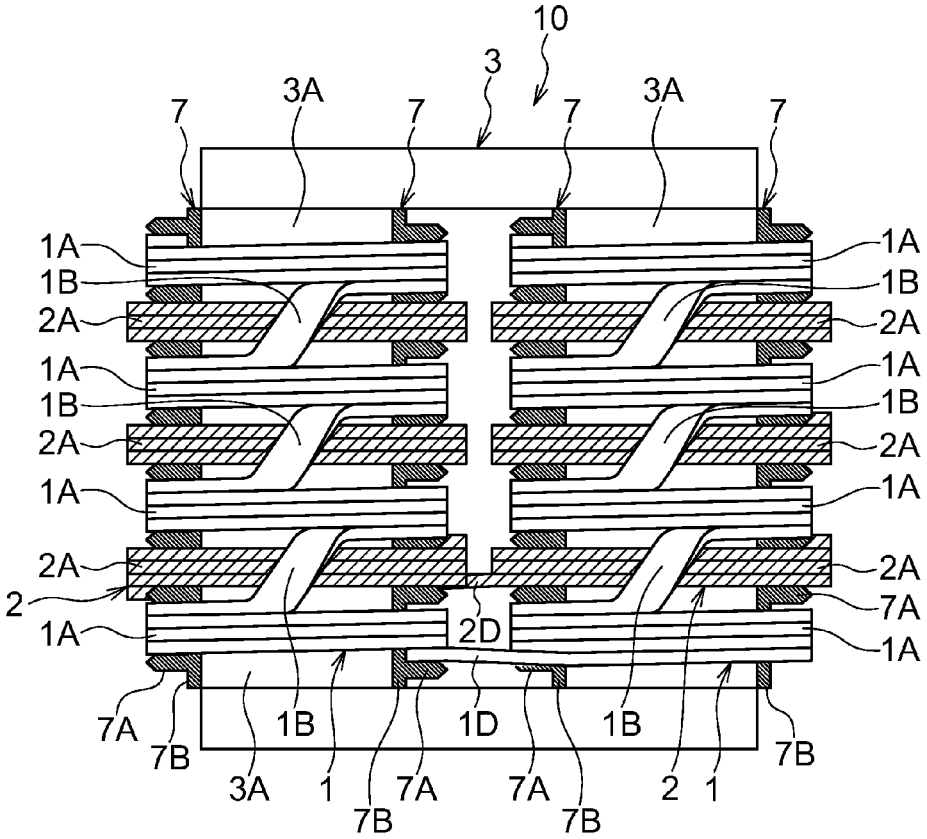
FIG. 2 is a front view illustrating a configuration of the high frequency transformer according to the first exemplary embodiment as viewed along the direction of arrow A in FIG. 1.
Figure 3:
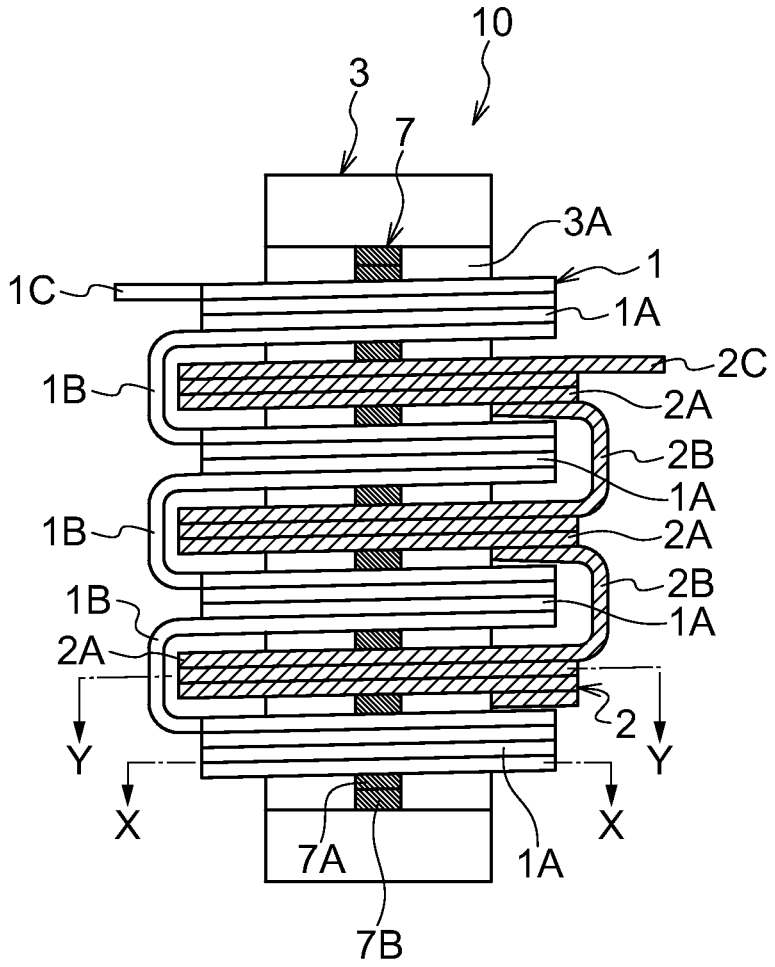
FIG. 3 is a side view illustrating a configuration of the high frequency transformer according to the first exemplary embodiment as viewed along the direction of arrow B in FIG. 1.
Figure 4:
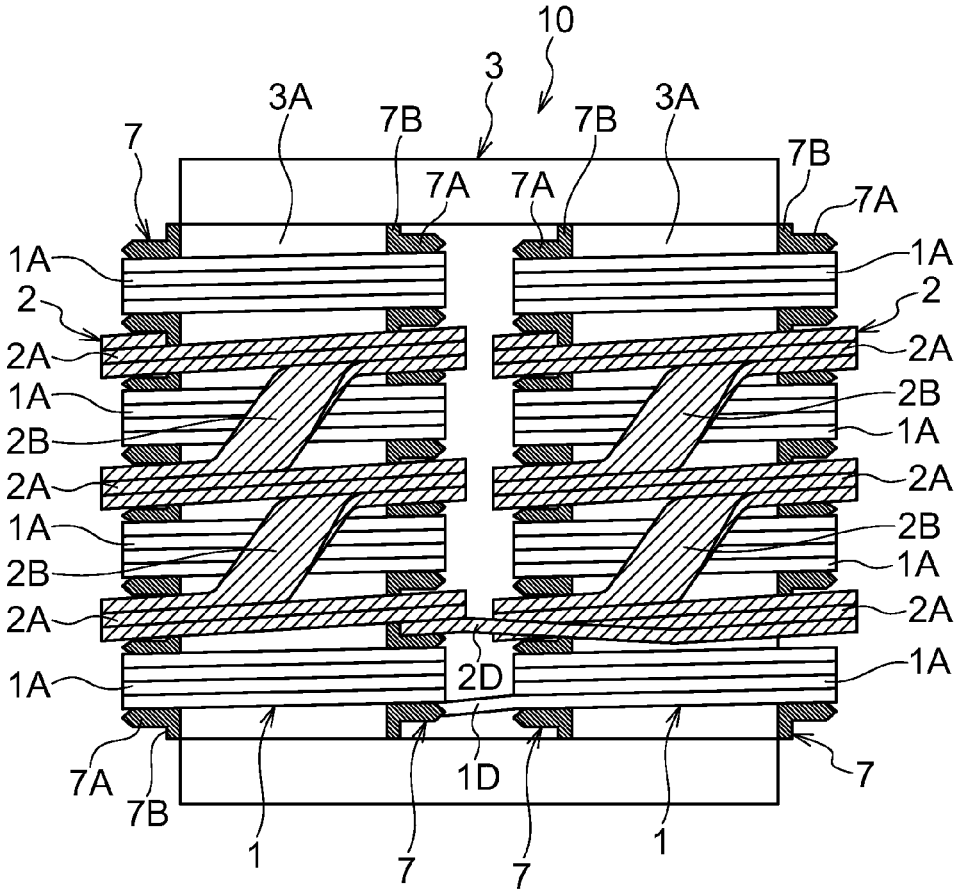
FIG. 4 is a rear view illustrating a configuration of the high frequency transformer according to the first exemplary embodiment as viewed along the direction of arrow C in FIG. 1.
Figure 5A:
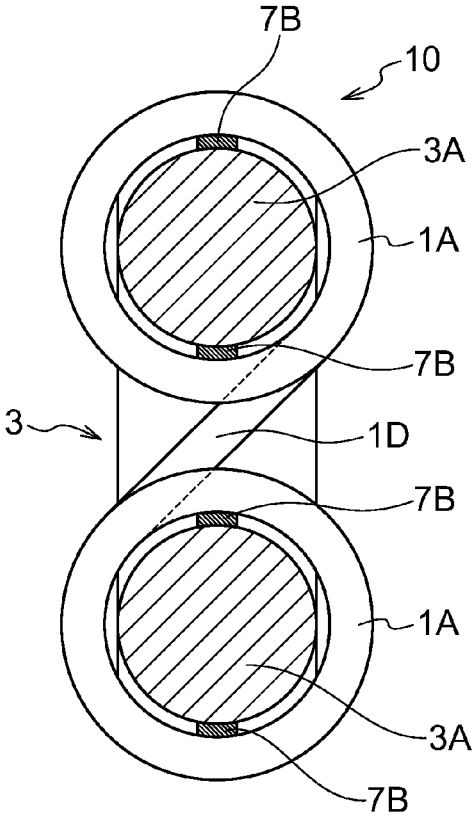
FIG. 5A is a plan view of the high frequency transformer of the first exemplary embodiment taken along plane X-X in FIG. 3.
Figure 5B:
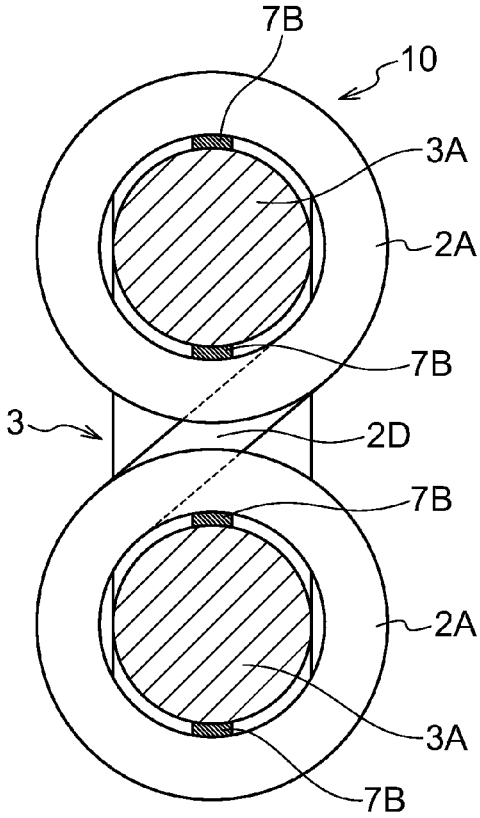
FIG. 5B is a plan view of the high frequency transformer of the first exemplary embodiment taken along plane Y-Y in FIG. 3.

Explanation follows regarding an example of an exemplary embodiment of the high frequency transformer of the present invention, in which a primary coil assembly and a secondary coil assembly are respectively formed from single flat wires, and in which secondary coils are inserted between primary coils.

As illustrated in FIG. 1 to FIG. 6, a high frequency transformer 10 of the first exemplary embodiment is provided with a core-type ferrite core 3 that includes two circular cylinder shaped cores 3A and that is configured with an overall square frame shape. The high frequency transformer 10 also includes a pair of primary coil assemblies 1 and a pair of secondary coil assemblies 2 into which the respective cylinder shaped cores 3A is inserted.

As illustrated in FIG. 1 to FIG. 7, the pair of primary coil assemblies 1 are arrayed in series, with the overall pair of primary coil assemblies 1 formed from a single continuous surface insulated flat wire. Each of the primary coil assemblies 1 is formed with four primary coils 1A in uniform intervals, with each of the primary coils 1A configured by four turns of the flat wire wound edgewise. Note that winding edgewise refers to a winding method in which the flat wire is wound along the width direction.

The pair of secondary coil assemblies 2 is similarly arrayed in series, with the overall pair of secondary coil assemblies 2 formed from a single continuous surface insulated flat wire. The respective secondary coil assemblies 2 are formed with three secondary coils 2A in uniform intervals, respectively configured by three turns of the flat wire wound edgewise. Note that as illustrated in FIG. 1 to FIG. 5, the secondary coils 2A employ flat wire that is greater in both width and thickness than the flat wire of the primary coils 1A.

The primary coils 1A of the primary coil assemblies 1 are formed such that a winding end portion of one of mutually adjacent primary coils 1A opposes a winding start portion of the other of the mutually adjacent primary coils 1A. Similarly, the secondary coils 2A of the secondary coil assemblies 2 are formed such that a winding end portion of one of mutually adjacent secondary coils 2A opposes a winding start portion of the other of the mutually adjacent secondary coils 2A.

In the primary coil assemblies 1 and the secondary coil assemblies 2, the secondary coils 2A are disposed inserted between adjacent primary coils 1A such that the winding start portion of each of the secondary coils 2A of the secondary coil assemblies 2 opposes the winding end portion of one of adjacent primary coils 1A of the primary coil assemblies 1, and the winding end portion of each of the secondary coils 2A opposes the winding start portion of the other of the adjacent primary coils 1A. In other words, the primary coil assemblies 1 and the secondary coil assemblies 2 are configured with the primary coils 1A and the secondary coils 2A combined with each other such that the secondary coils 2A of the secondary coil assemblies 2 are inserted coaxially between the primary coils 1A of the primary coil assemblies 1.

Note that the number of turns of the primary coils 1A and the secondary coils 2A do not necessarily have to be the number of turns illustrated in FIG. 1 to FIG. 6, and may be determined based on a ratio between the high frequency current input into the primary coil assemblies 1 and the high frequency current output from the secondary coils. For example, in cases in which the high frequency transformer 10 outputs large currents of high frequency, each of the primary coils 1A may be configured with seven turns, and each of the secondary coils 2A may be configured with two turns, or the 2 primary coils 1A positioned at both end portions of the respective primary coil assemblies 1 may be configured with six turns, and the two primary coils 1A positioned at central portions of the primary coil assemblies 1 may be configured with eight turns, with each of the secondary coils 2A configured with two turns. Note that in the drawings from FIG. 1 onwards, the primary coils 1A and the secondary coils 2A are respectively illustrated such that the respective flat wires appear to be in close contact, however in reality gaps are provided between adjacent portions of the flat wires. This is also the case in the second exemplary embodiment onwards.

In the primary coil assemblies 1, the flat wire between adjacent primary coils 1A configures crossing wires 1B that are pulled out to the outside of the primary coils 1A. The crossing wires 1B are formed so as to straddle the outside of the secondary coils 2A that are adjacent to the primary coils 1A. Similarly, in the secondary coil assemblies 2 the flat wire between adjacent secondary coils 2A configures crossing wires 2B that are pulled out to the outside of the secondary coils 2A. The crossing wires 2B are formed so as to straddle the outside of the primary coils 1A that are adjacent to the secondary coils 2A.

As illustrated in FIG. 1 to FIG. 6, at the winding start portion of one of the primary coils 1, the flat wire that forms the pair of primary coil assemblies 1 configures a lead wire 1C leading to the outside of the one primary coil 1. At the winding end portion of the one primary coil 1, the flat wire configures a crossing wire 1D that continues to the other of the pair of primary coils 1. At the winding end portion of the other primary coil assembly 1, the flat wire configures a lead wire 1C leading to the outside of the other primary coil assembly 1 similarly to at the winding start portion of the one primary coil 1. The lead wire 1C is connected to an input source that inputs high frequency current to the primary coils 1.

Similarly, at the winding start portion of one of the secondary coils 2, the flat wire that forms the pair of secondary coil assemblies 2 configures a lead wire 2C leading to the outside of the one secondary coil 2. At the winding end portion of the one secondary coil 2, the flat wire configures a crossing wire 2D that continues to the other of the pair of secondary coils 2. At the winding end portion of the other secondary coil assembly 2, the flat wire configures a lead wire 2C leading to the outside of the other secondary coil assembly 2 similarly to at the winding start portion of the one secondary coil assembly 2. The lead wire 2C outputs a high frequency current with a current and voltage corresponding to the ratio of turns between the primary coils 1 and the secondary coils.

Figure 6A:
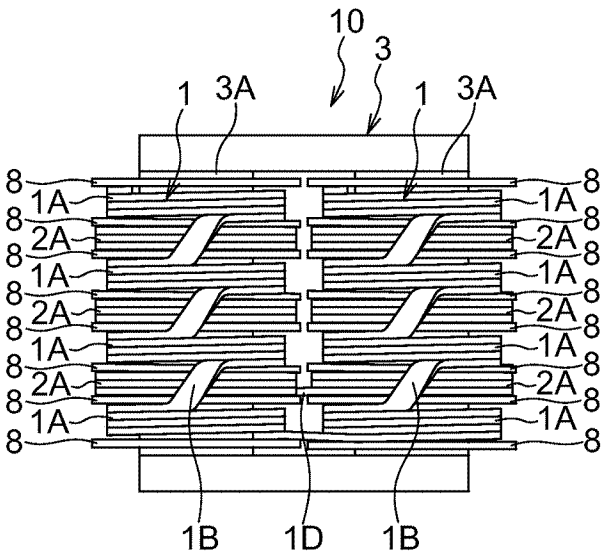
Figure 6B:
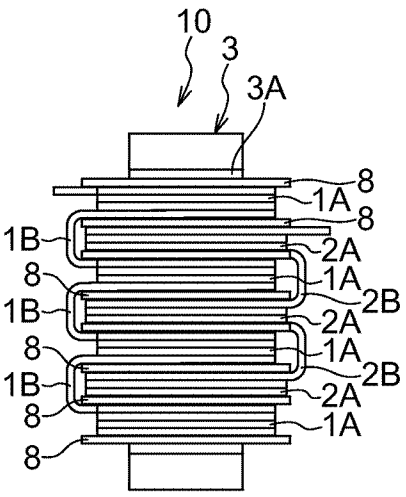
FIG. 6B is a side view of this example.
Figure 6C:
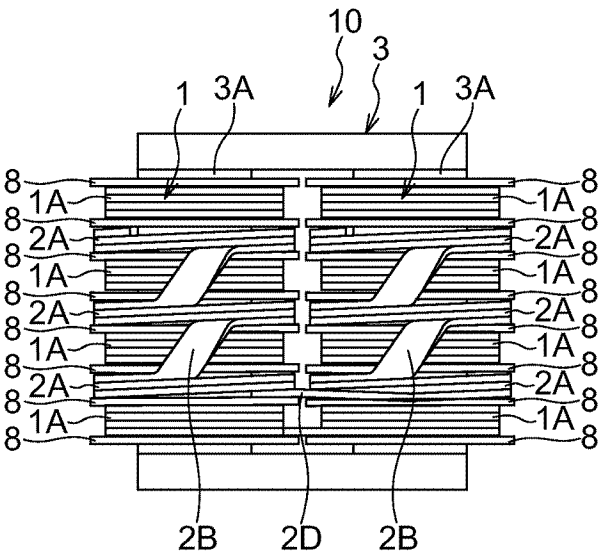
FIG. 6C is a rear view of this example.
Figure 7:
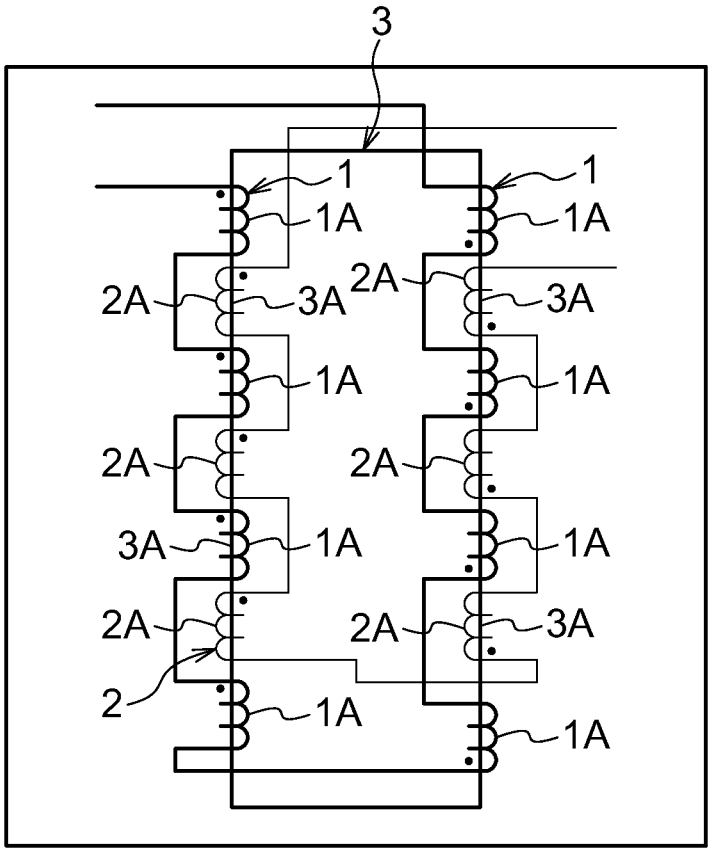
FIG. 7 is a wiring diagram illustrating wiring of primary coils and secondary coils of the high frequency transformer of the first exemplary embodiment.
Figure 8:
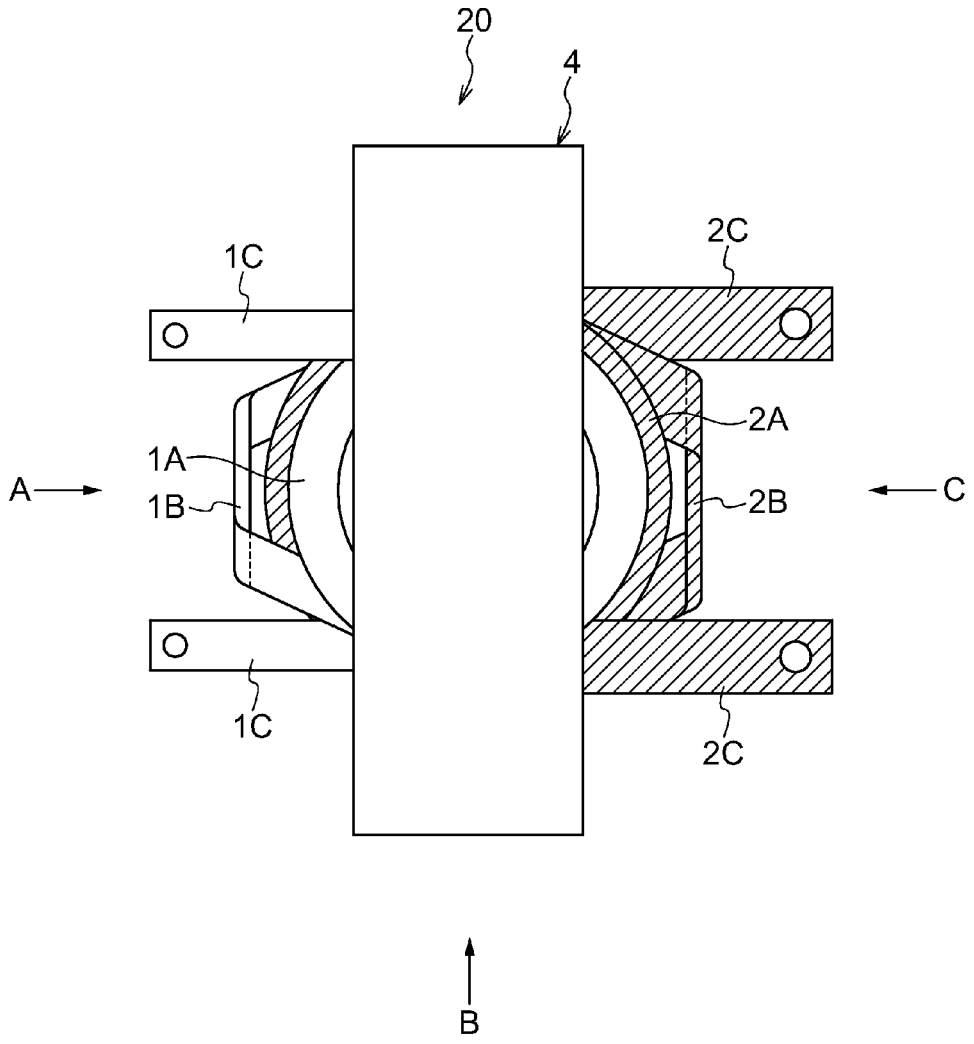
FIG. 8 is a plan view of a high frequency transformer of a second exemplary embodiment.
Figure 9:
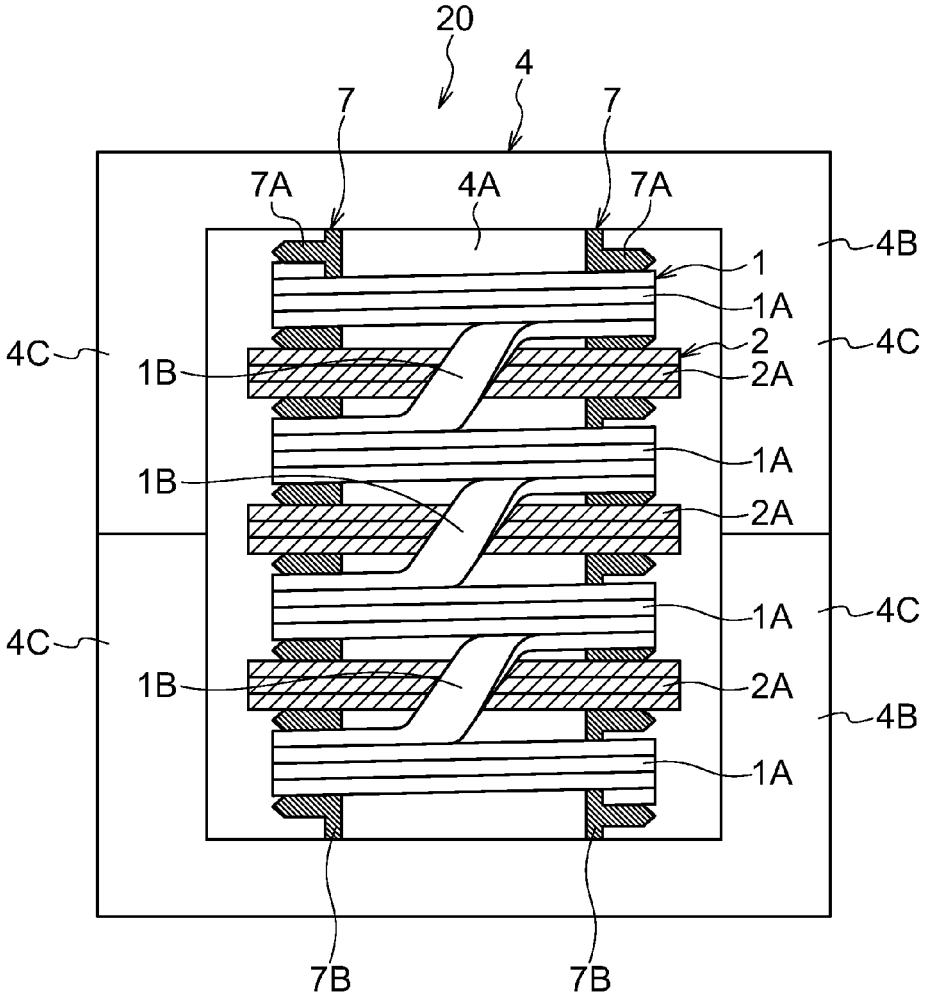
FIG. 9 is a front view illustrating the configuration of the high frequency transformer of the second exemplary embodiment as viewed along the direction of arrow A in FIG. 8.
Figure 10:
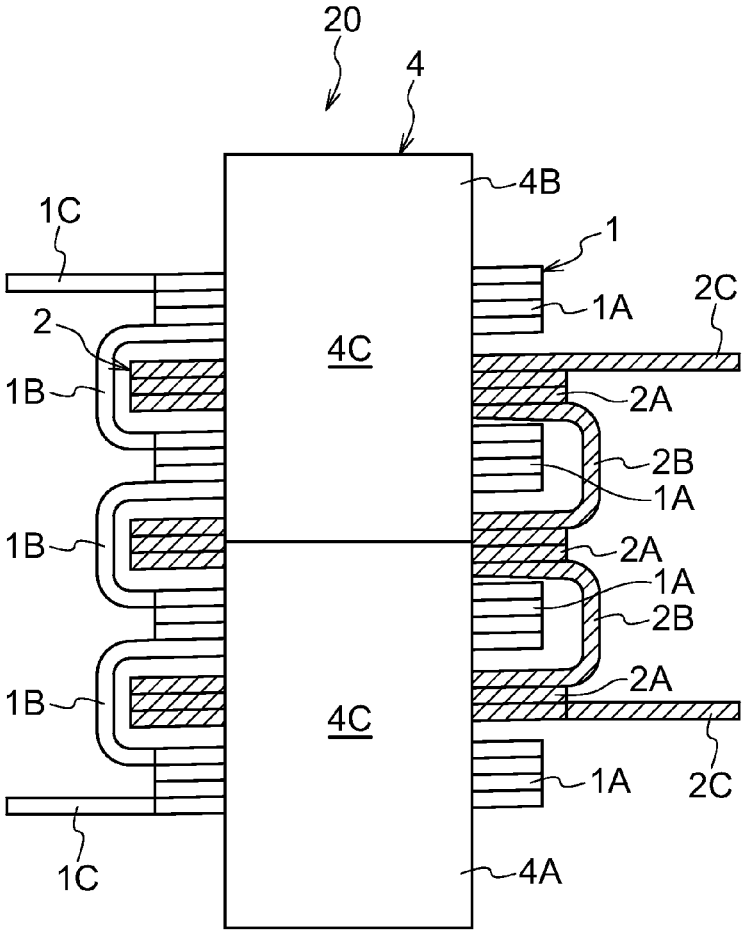
FIG. 10 is a side view illustrating the configuration of the high frequency transformer of the second exemplary embodiment as viewed along the direction of arrow B in FIG. 8.
Figure 11:
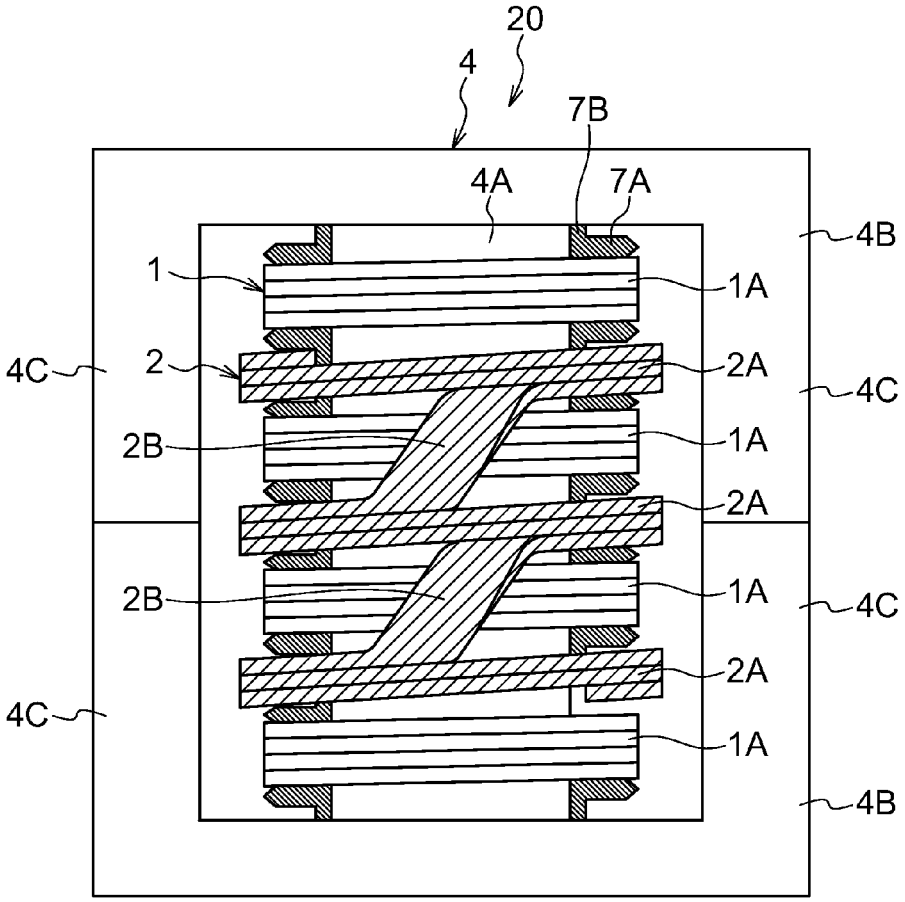
FIG. 11 is a rear view illustrating the configuration of the high frequency transformer of the second exemplary embodiment as viewed along the direction of arrow C in FIG. 8.

As illustrated in FIG. 1 to FIG. 5, insulating members 7 are inserted between the respective primary coil assemblies 1 and the secondary coil assemblies 2 and the cores 3A of the core-type ferrite core 3. The insulating members 7 are configured with insulation tabs 7A that extend towards the outside, and an insulation tab retaining member 7B that retains the insulation tabs 7A at specific intervals. The insulation tabs 7A of the insulating members 7 are inserted between the primary coils 1A and the secondary coils 2A, and the insulation tab retaining member 7B is inserted between the primary coils 1A and secondary coils 2A, and the cores 3A. Note that in the high frequency transformer 10 the insulating members 7 may be inserted from the outside of the primary coils 1A and the secondary coils 2A. Moreover, as illustrated in FIG. 6, insulation washers 8 that are ring shaped insulation plates or insulation sheets, may be inserted between the primary coils 1A and the secondary coils 2A instead of inserting the insulating members 7.

In the high frequency transformer 10 of the first exemplary embodiment, the primary coils 1A and the secondary coils 2A are disposed alternately to each other, and the primary coils 1A positioned at both ends of the primary coil assemblies 1 are disposed further outsides along the axial direction than the secondary coils 2A positioned at both ends of the secondary coil assemblies 2. Accordingly, when a high frequency current flows in the primary coils, a uniform magnetic field generated by the primary coils passes through the secondary coils, such that leakage inductance can be made extremely small. The degree of coupling between the primary coils and the secondary coils is accordingly very close to 1, thereby enabling an energy transfer rate from the primary coils to the secondary coils of almost 100%, such that loss during energy transfer from the primary coils to the secondary coils can be suppressed to a very small amount.

Since the primary coil assemblies 1 have a greater overall number of turns than the secondary coil assemblies 2, application is suited to situations in which a high voltage, low current high frequency current is input, and a low voltage, large current high frequency current is output.

Moreover, the primary coils 1A and the secondary coils 2A are of similar internal diameter to each other and are coaxially disposed. The degree of coupling between the primary coil assemblies 1 and the secondary coil assemblies 2 is accordingly higher, and magnetic flux leakage is even smaller than when the primary coils 1A and the secondary coils 2A have different internal diameters to each other and are not coaxially disposed. The high frequency transformer 10 is therefore suitably employed in high capacity power conversion equipment and high capacity power source equipment.

Moreover, a higher conversion efficiency can be achieved compared with a high frequency transformer having two or three primary coils 1A and one or two secondary coils 2A through which one core 3A is inserted.

Moreover, since the insulation tabs 7A of the insulating members 7 are inserted between the primary coils 1A and the secondary coils 2A, insulation between the primary coils 1A and the secondary coils 2A is more secure than in a high frequency transformer in which the insulating members 7 are not inserted between the primary coils 1A and the secondary coils 2A.

In the secondary coils 2A, a flat wire of greater width and greater thickness than that of the primary coils 1A is employed. The high-frequency transformer 10 is accordingly suitably employed as a high frequency transformer wherein a high voltage, low current high frequency current is input into the primary coil assemblies 1 and a high frequency current with a large current is obtained from the secondary coil assemblies 2.

Due to employing the core-type ferrite core 3 for the core, loss can be suppressed to a smaller amount when employing high frequencies compared to when an iron core configured from for example a silicon steel plate is employed. Moreover, the ratio of the core with respect to the primary coil assemblies 1 and the secondary coil assemblies 2 is decreased, thereby leading to stronger copper machine characteristics. A large number of turns of the primary coils and the secondary coils can accordingly be secured, in particular giving a margin in the density of magnetic flux passing through the inside of the core in cases in which frequency control is performed, such as in a parallel resonant inverter or in a series resonant inverter. The high-frequency transformer 10 is accordingly suitably applied when a control range is widened as far as low frequencies (in the region of 10 kHz to 200 kHz).

Moreover, since the primary coil assemblies 1 and the secondary coil assemblies 2 are respectively formed by winding a single continuous flat wire edgewise at specific intervals, the effort of connecting together separately formed primary coils 1A and secondary coils 2A to manufacture the primary coil assemblies 1 and the secondary coil assemblies 2 is not required. The high-frequency transformer 10 can accordingly be manufactured more easily than a high frequency transformer in which separately formed primary coils 1A and secondary coils 2A are connected together to configure the primary coil assemblies 1 and the secondary coil assemblies 2. There is moreover no need to for a connection operation such as soldering in order to connect together the primary coils 1A and the secondary coils, thus enabling a lead-free configuration with good environmental characteristics.

An example has been given above in which the primary coil assemblies 1 and the secondary coil assemblies 2 are connected in series, however configuration may be made wherein the primary coil assemblies 1 and the secondary coil assemblies 2 are connected in parallel. Configuration may also be made wherein the primary coil assemblies 1 are connected in series and the secondary coil assemblies 2 are connected in parallel, or wherein the primary coil assemblies 1 are connected in parallel and the secondary coil assemblies 2 are connected in series.

2. Second Exemplary Embodiment

Explanation follows regarding an example of another embodiment of the high frequency transformer of the present invention, wherein a primary coil assembly and a secondary coil assembly are respectively formed from a single flat wire and wherein the secondary coils are inserted between the primary coils.

As illustrated in FIG. 8 to FIG. 12, a high frequency transformer 20 of the second exemplary embodiment is provided with a shell-type ferrite core 4 that includes a single circular cylinder shaped central core 4A, and a primary coil assembly 1 and a secondary coil assembly 2 both of which are inserted onto the central core 4A.

The shell-type ferrite core 4 is configured from a two-part combination of E-shaped central cores 4B that are formed by sintering ferrite into an E-shape and are pressed together along an up-down direction using for example clamping fasteners (not illustrated in the drawings) so as to face each other. As illustrated in FIG. 8 to FIG. 12, the shell-type ferrite core 4 can be split into the central core 4A and an outside core 4C that is positioned so as to enclose the central core 4A from the outside. Note that instead of forming the shell-type ferrite core 4 by combining the facing E-shaped central cores 4B that are of similar configuration to each other, configuration may also be made wherein the shell-type ferrite core 4 is configured from a combination of an E-shaped core corresponding to the central core 4A, the outside core 4C, and a lower portion core, and an I-shaped core corresponding to an upper portion core.

Both the central core 4A and the outside core 4C may be formed in a square column shape, however forming the central core 4A in a circular column shape eliminates needless gaps between the core-type ferrite core 4 and the primary coil assembly 1 and secondary coil assembly 2, such that the space factor of the total sum of the cross-section area of the primary coils and the secondary coils is close to 100% with respect to the area of the winding window, thereby contributing to a further reduction in size of the high frequency transformer 20.

The primary coil assembly 1 is configured by four primary coils 1A and the secondary coil assembly 2 is configured by three secondary coils 2A. Both the primary coil assembly 1 and the secondary coil assembly 2 are respectively configured by a single continuous flat wire.

The disposal of the primary coils 1A and the secondary coils 2A, and the configurations of the primary coil assembly 1 and the secondary coil assembly 2 are similar to as described above in the first exemplary embodiment.

As illustrated in FIG. 8 to FIG. 12, a winding start portion and a winding end portion of the flat wire forming the primary coil assembly 1 configure lead wires 1C leading to the outside of the primary coil assembly 1. The lead wires 1C are connected to an input source that inputs high frequency current into the primary coils 1.

Similarly, a winding start portion and a winding end portion of the flat wire forming the secondary coil assembly 2 configure lead wires 2C leading to the outside of the secondary coil assembly 2. The lead wires 2C output a high frequency current with a current and voltage corresponding to the ratio of turns between the primary coils and the secondary coils.

Figure 12A:
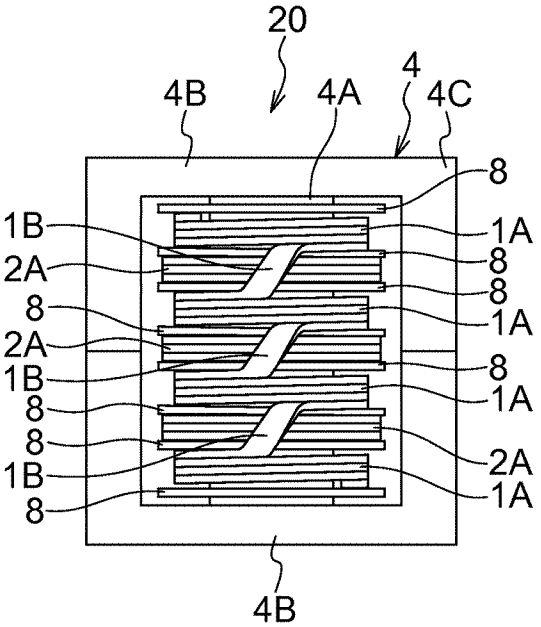
FIG. 12A is a front view of an example of the high frequency transformer of the second exemplary embodiment having insulation washers that are inserted between primary coils and secondary coils instead of an insulating member.
Figure 12B:
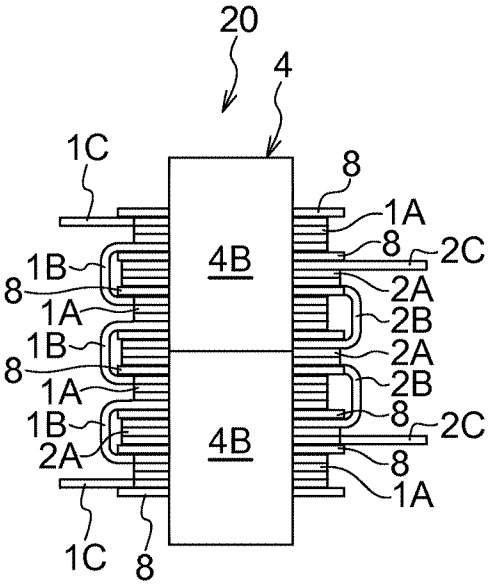
FIG. 12B is a side view of this example.
Figure 12C:
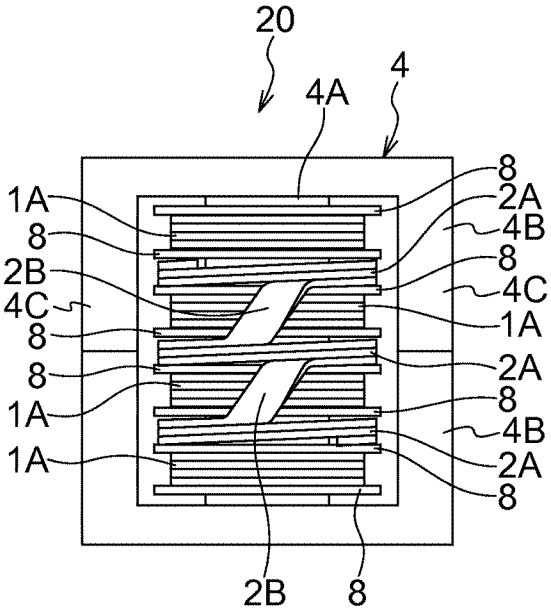
FIG. 12C is a rear view of this example.
Figure 13:
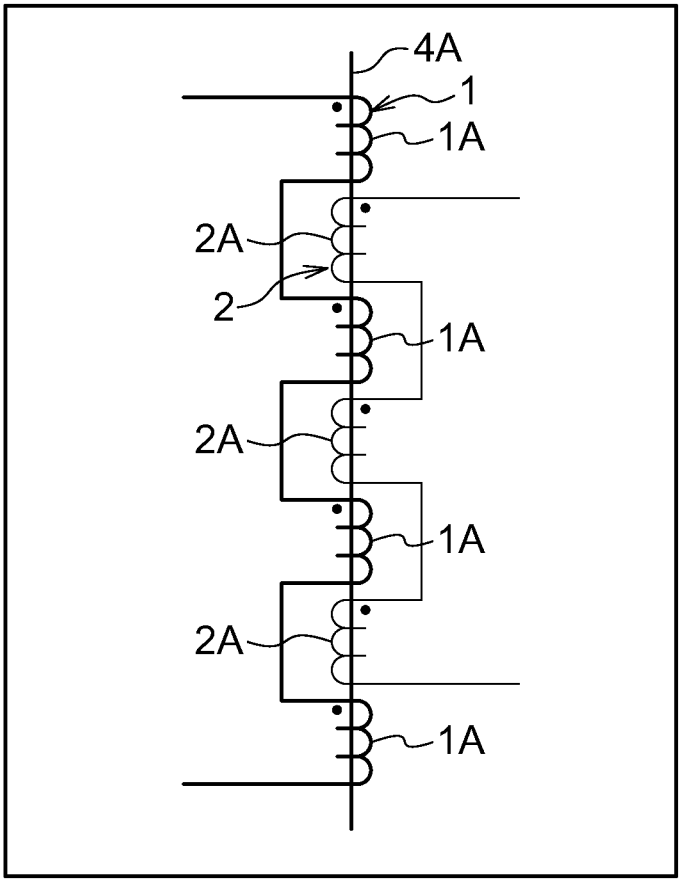
FIG. 13 is a wiring diagram illustrating wiring of primary coils and secondary coils of the high frequency transformer of the second exemplary embodiment.
Figure 14:
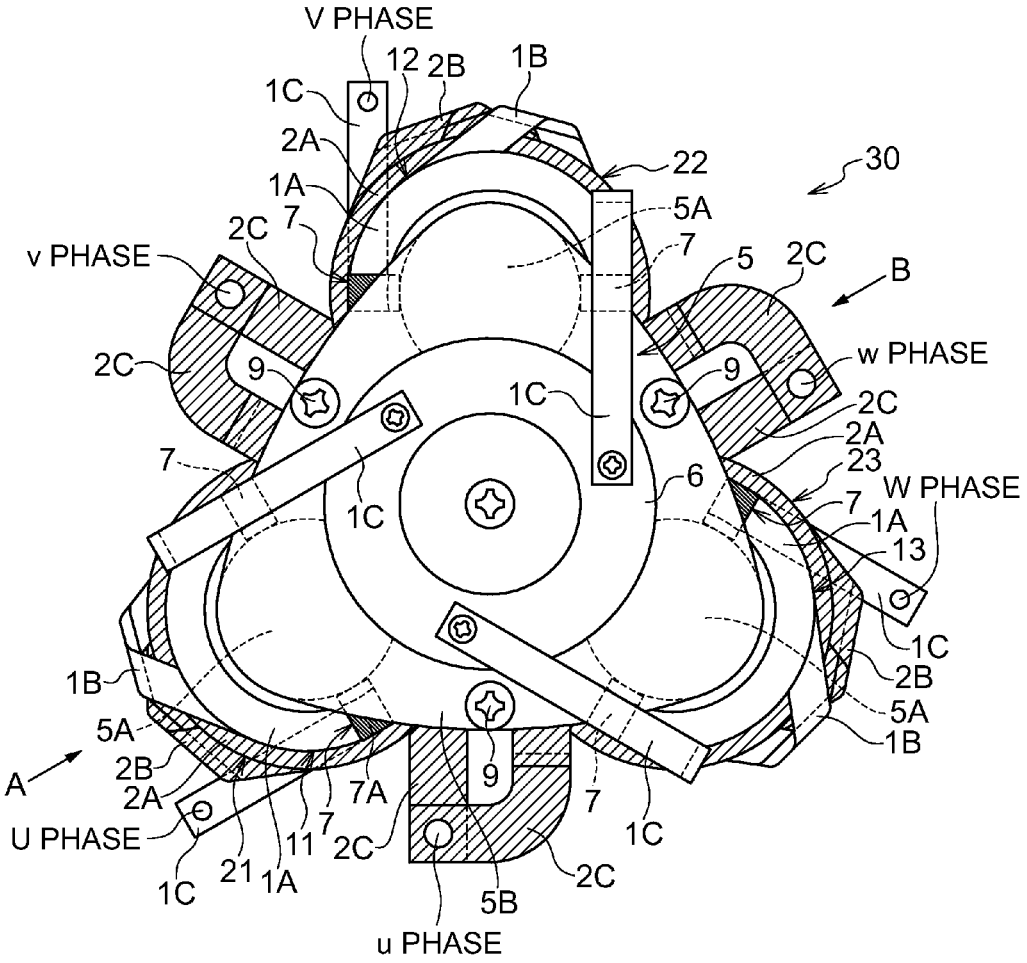
FIG. 14 is a plan view of a three phase high frequency transformer of a third exemplary embodiment.
Figure 15:
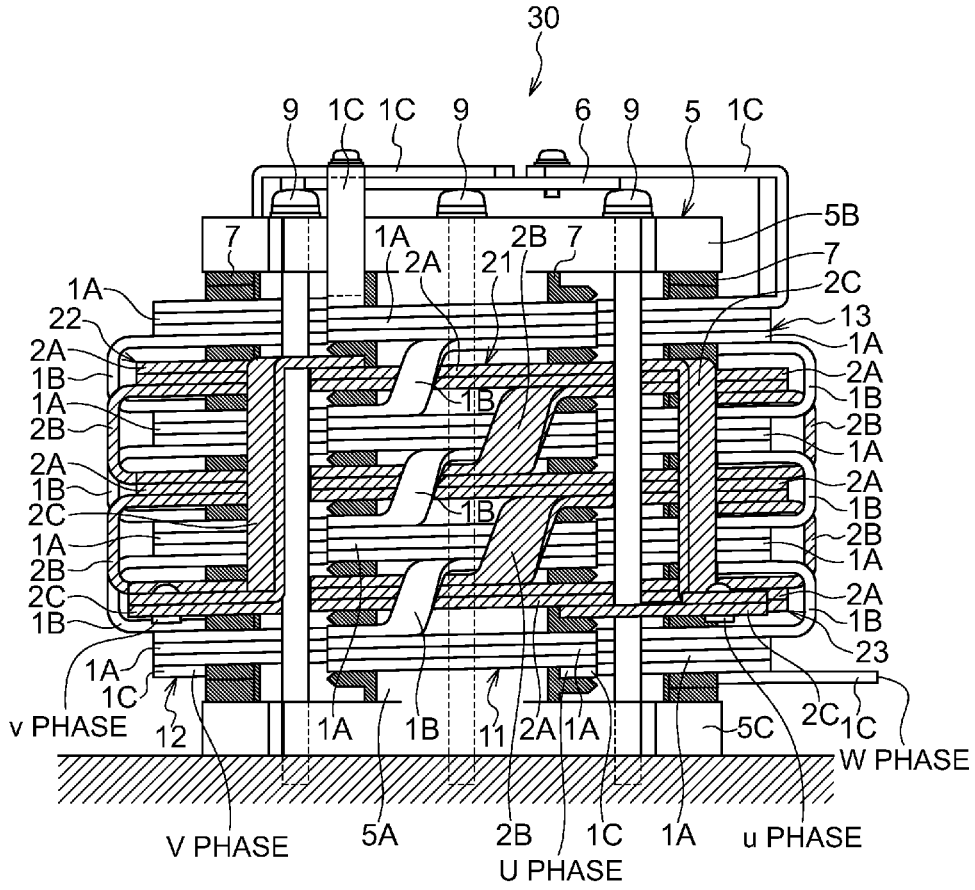
FIG. 15 is a side view illustrating a configuration of the three-phase high frequency transformer of the third exemplary embodiment as viewed along the direction of arrow A in FIG. 14.
Figure 16:
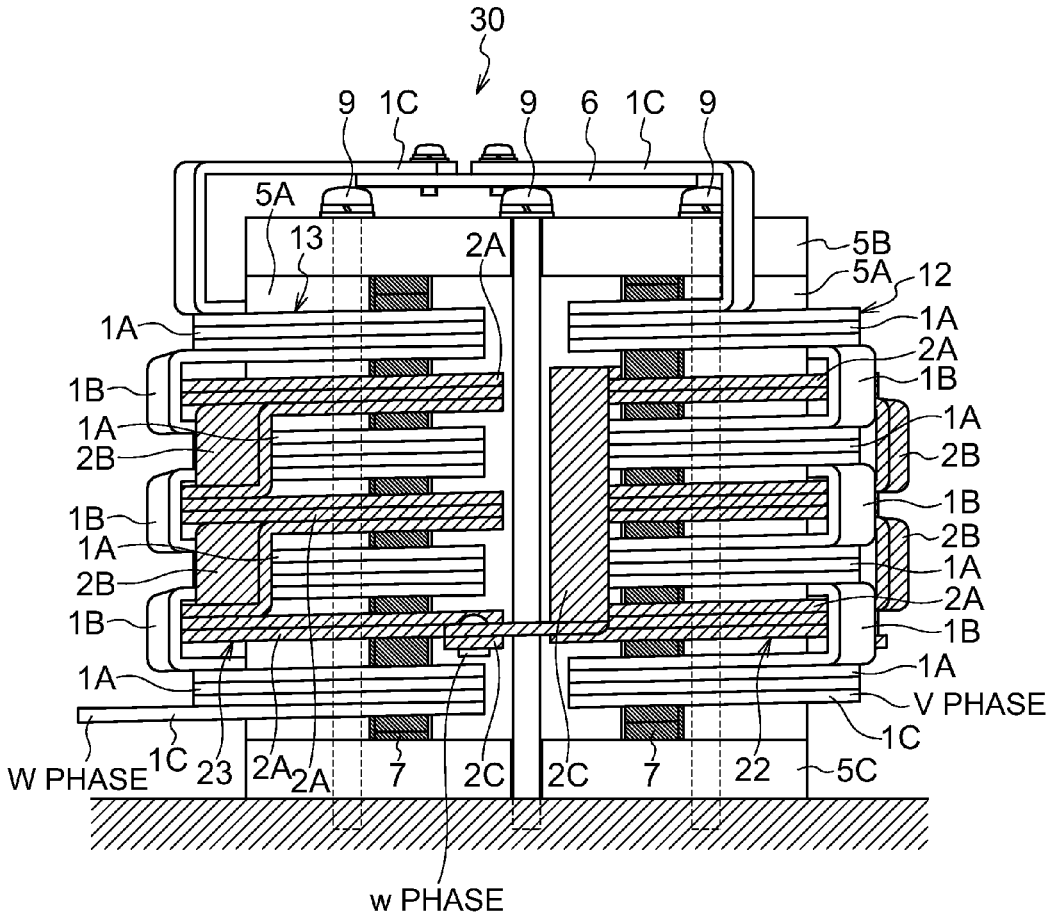
FIG. 16 is a side view illustrating a configuration of the three phase high frequency transformer of the third exemplary embodiment as viewed along the direction of arrow B in FIG. 14.

As illustrated in FIG. 8 to FIG. 11, insulating members 7 are inserted between the primary coil assembly 1 and secondary coil assembly 2 and the central core 4A of the shell-type ferrite core 4. The insulating members 7 are configured by insulation tabs 7A that extend towards the outside, and an insulation tab retaining member 7B that retains the insulation tabs 7A at specific intervals. The insulation tabs 7A of the insulating members 7 are inserted between the primary coils 1A and the secondary coils 2A, and the insulation tab retaining member 7B is inserted between the primary coils 1A and secondary coils 2A and the core 3A. Note that in the high frequency transformer 20, the insulating members 7 may be inserted from the outside of the primary coils 1A and the secondary coils 2A. Moreover, as illustrated in FIG. 12 insulation washers 8 that are ring shaped insulation plates or insulation sheets may be inserted between the primary coils 1A and the secondary coils 2A instead of inserting the insulating members 7.

In the high frequency transformer 20 of the second exemplary embodiment, the shell-type ferrite core 4 is employed as the core, thereby increasing the ratio of the core with respect to the coils in comparison to the high frequency transformer of the first exemplary embodiment in which the ferrite core is a core-type core, thus leading to stronger iron machine characteristics. Accordingly, in addition to the features of the high frequency transformer of the first exemplary embodiment, there is also the advantageous effect of being suitably applied in applications with a small number turns of the primary coils and the secondary coils, in particular in high frequency inverters (in the region of 50 kHz to 1 MHz).

Moreover, since the primary coil assembly 1 and the secondary coil assembly 2 are respectively formed by winding a single continuous flat wire at specific intervals the effort of connecting together separately formed primary coils 1A and secondary coils 2A to manufacture the primary coil assembly 1 and the secondary coil assembly 2 is not required. The high frequency transformer 20 is accordingly easily manufactured in comparison to high frequency transformers in which separately formed primary coils 1A and secondary coils 2A are respectively connected together to configure the primary coil assembly 1 and the secondary coil assembly 2. Good environmental characteristics are also exhibited due to having a lead-free configuration.

3. Third Exemplary Embodiment

Explanation follows regarding a three phase high frequency transformer included in the high frequency transformer of the present invention, wherein the primary coil assembly and the secondary coil assembly are respectively formed from a single flat wire, and wherein the secondary coils are inserted between the primary coils.

As illustrated in FIG. 14 to FIG. 17, in a three phase high frequency transformer 30 according to the third exemplary embodiment a three phase, three-legged ferrite core 5 is inserted into primary coil assemblies 11, 12, 13 and secondary coil assemblies 21, 22, 23. Two insulating members 7 are fitted into each of the respective primary coil assemblies 11, 12, 13 and secondary coil assemblies 21, 22, 23 at symmetrical positions about the axes of respective columnar cores 5A, which are described later. The insulating members 7 are of similar configuration to those described above in the first exemplary embodiment.

The three-legged ferrite core 5 is included in the ferrite core of the high frequency transformer of the present invention, and as illustrated in FIG. 14 to FIG. 17, the three-legged ferrite core 5 includes three columnar cores 5A that are formed from ferrite and are disposed at 120 degree intervals around the circumference of the three-legged ferrite core 5, a plate shaped top plate 5B that is formed from ferrite and is coupled to upper ends of the three columnar cores 5A, and a bottom plate 5C that is formed from ferrite and is coupled to lower ends of the three columnar cores 5A.

The top plate 5B and the bottom plate 5C are respectively configured in an equilateral triangular shape with rounded apexes and with each edge bulging towards the outside in a circular arc shape in plan view. A bolt insertion through hole is provided at a central portion, and bolt insertion grooves are respectively provided at a central portion on each edge. Fixing bolts 9 are passed through the bolt insertion through hole and the bolt insertion grooves, thereby fixing together the top plate 5B, the columnar cores 5A, and the bottom plate 5C.

In the three-legged ferrite core 5, configuration may be made such that the columnar cores 5A can be divided into upper and lower parts along a plane orthogonal to the respective axes of the columnar cores 5A, with the upper side halves being integral to the top plate 5B and the lower side halves being integral to the bottom plate 5C. Moreover, the columnar cores 5A may be configured such that instead of having a upper-lower divided configuration, the columnar cores 5A are integrally formed to one of the top plate 5B and the bottom plate 5C such that the other of the top plate 5B and the bottom plate 5C can be separated from the columnar cores 5A.

One of the three columnar cores 5A is mounted with the primary coil assembly 11 and the secondary coil assembly 21, one of the other columnar cores 5A is mounted with the primary coil assembly 12 and the secondary coil assembly 22, and the other of the columnar cores 5A is mounted with the primary coil assembly 13 and the secondary coil assembly 23.

As illustrated in FIG. 14 to FIG. 18, the primary coil assemblies 11, 12, 13 and the secondary coil assemblies 21, 22, 23 are respectively configured by a single continuous flat wire. The primary coil assemblies 11, 12, 13 are respectively formed with four primary coils 1A of four turns each, formed in uniform intervals such that in two adjacent primary coils 1A, a winding end portion of one of the adjacent primary coils 1A opposes a winding start portion of the other of the adjacent primary coils 1A. Similarly, the secondary coil assemblies 21, 22, 23 are respectively formed with three secondary coils 2A of three turns, formed in uniform intervals such that in two adjacent secondary coils 2A, a winding end portion of one of the adjacent secondary coils 2A opposes a winding start portion of the other of the adjacent secondary coils 2A.

The flat wire configuring the primary coil assemblies 11, 12, 13 configures crossing wires 1B pulled out to the outside of the primary coils 1A at portions between the primary coils 1A. The crossing wires 1B are formed so as to straddle the outside of the adjacent secondary coils 2A. Similarly, the flat wire configuring the secondary coil assemblies 21, 22, 23 configures crossing wires 2B pulled out to the outside of the secondary coils 2A at portions between the secondary coils 2A. The crossing wires 2B are formed so as to straddle the outside of the adjacent primary coils 1A.

Figure 17:
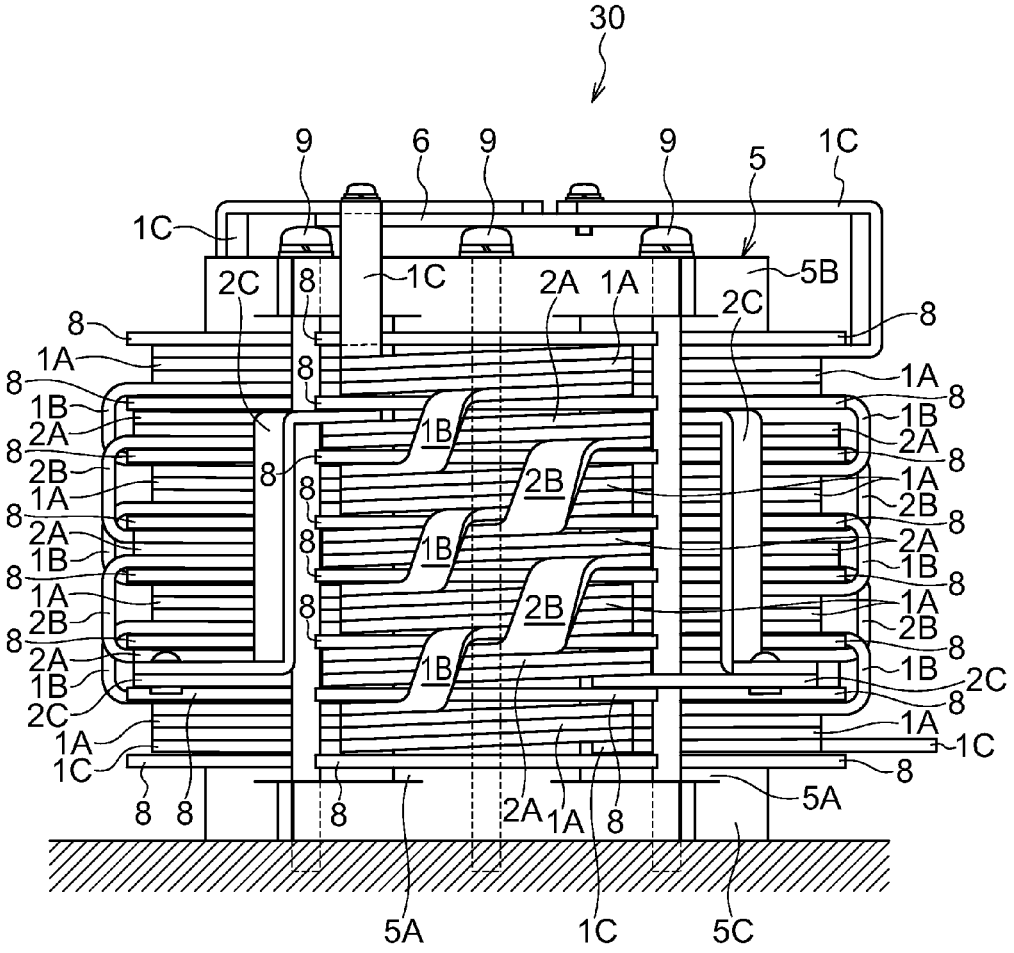
FIG. 17 is a side view illustrating an example of the three phase high frequency transformer of the third exemplary embodiment having insulation washers that are inserted between primary coils and secondary coils instead of insulating members.

The insulating members 7 are inserted between the primary coil assemblies 11, 12, 13, the secondary coil assemblies 21, 22, 23, and the columnar cores 5A. The insulating members 7 are of similar configuration to that described above in the first exemplary embodiment and the second exemplary embodiment. Note that in the high frequency transformer 30 the insulating members 7 may be inserted from the outside of the primary coils 1A and the secondary coils 2A. Moreover, as illustrated in FIG. 17 configuration may be made wherein insulation washers 8 that are ring shaped insulation plates or insulation sheets are inserted between the primary coils 1A and the secondary coils 2A instead of inserting the insulating members 7.

Figure 18:
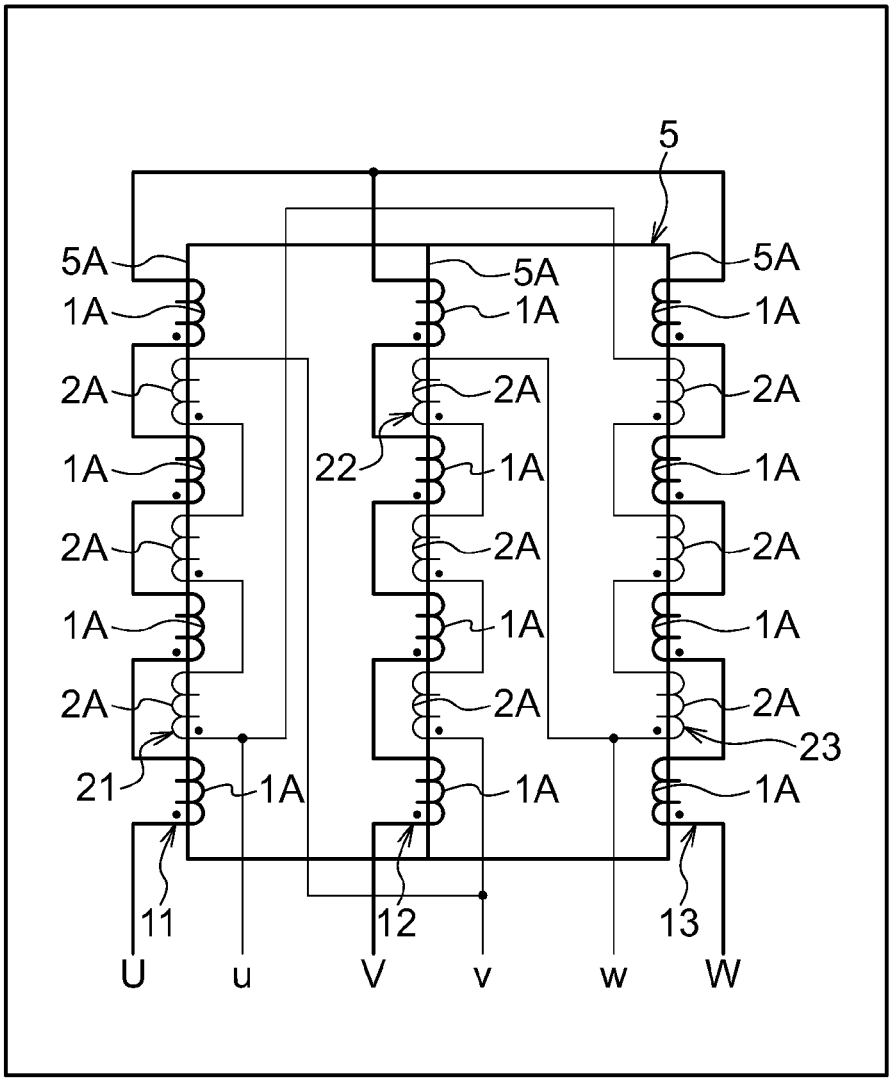
FIG. 18 is a wiring diagram illustrating wiring of primary coils and secondary coils of the three phase high frequency transformer of the third exemplary embodiment.
Figure 19:
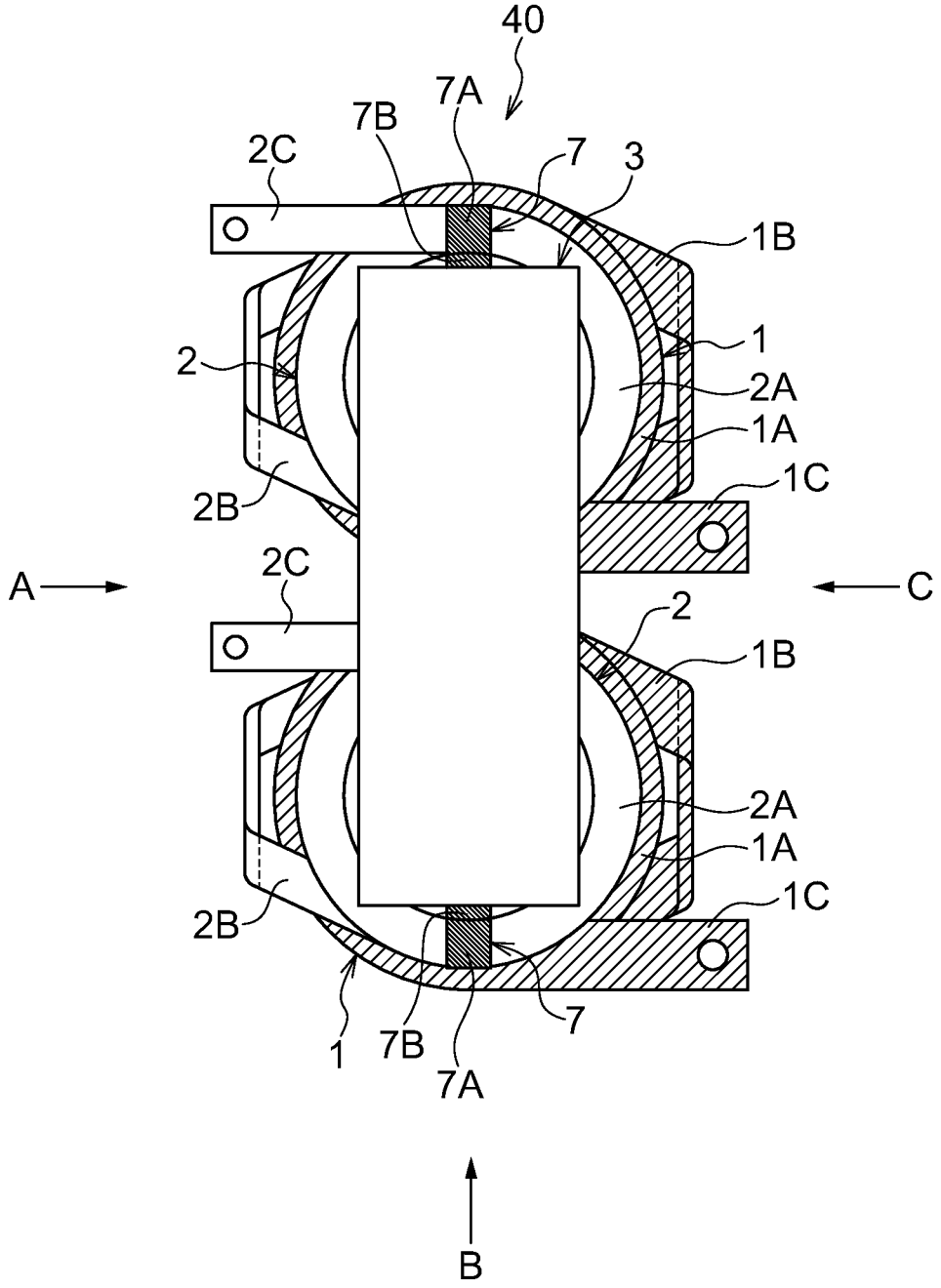
FIG. 19 is a plan view of a high frequency transformer of a fourth exemplary embodiment.
Figure 20:
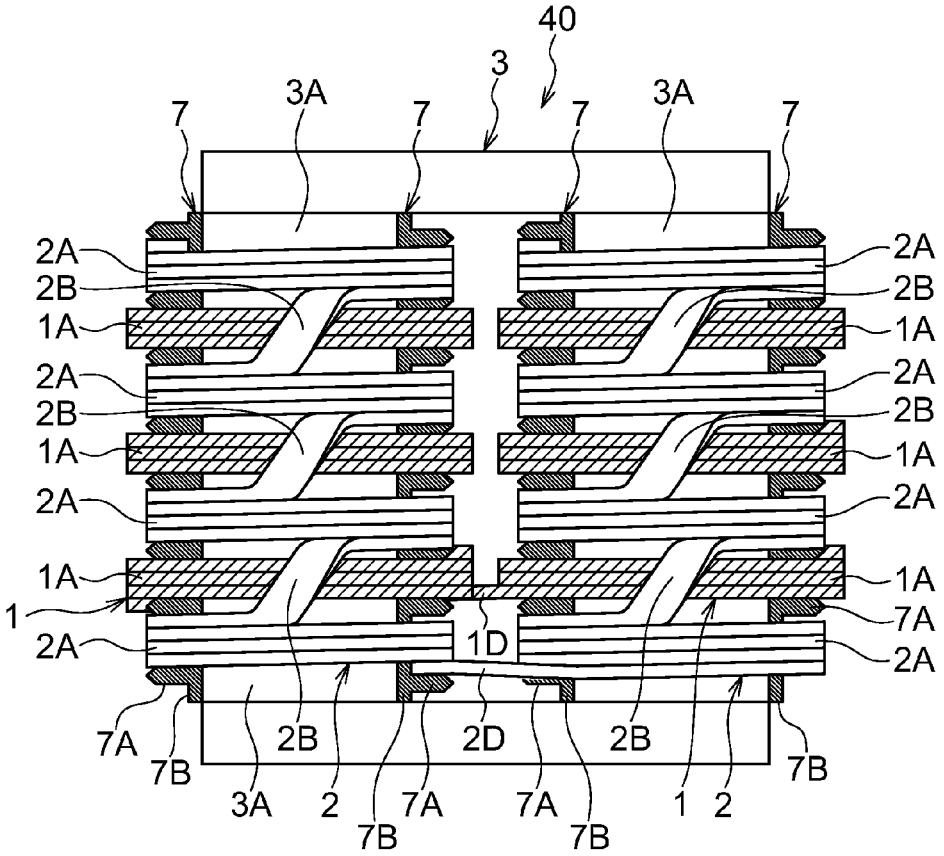
FIG. 20 is a front view illustrating a configuration of the high frequency transformer of the fourth exemplary embodiment as viewed along the direction of arrow A in FIG. 19.
Figure 21:
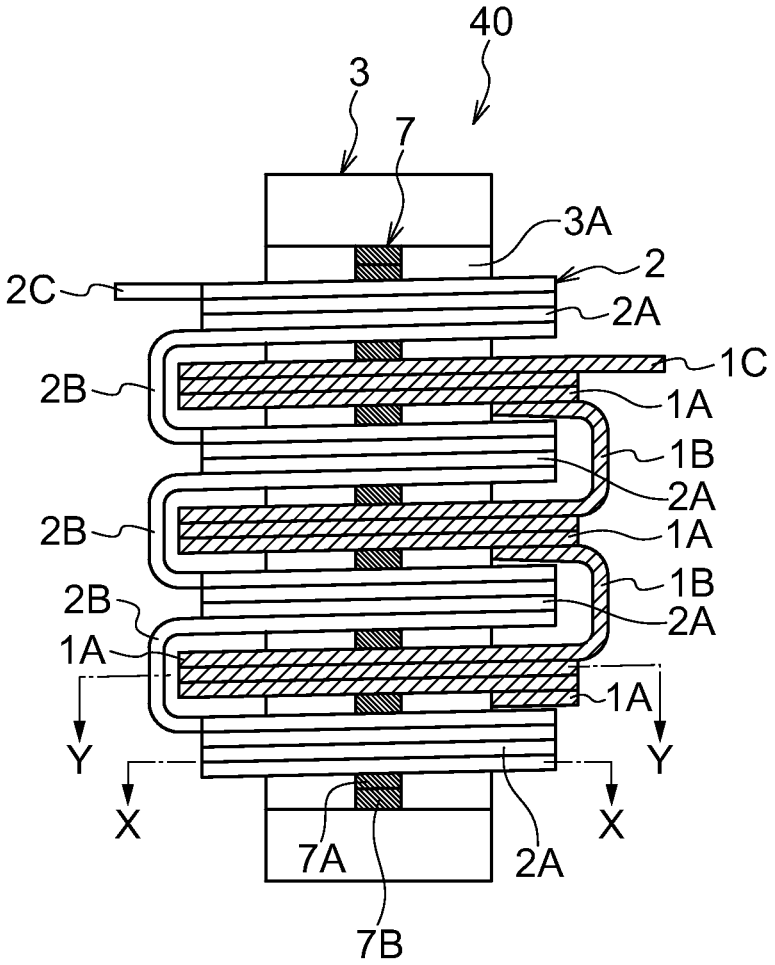
FIG. 21 is a side view illustrating a configuration of the high frequency transformer of the fourth exemplary embodiment as viewed along the direction of arrow B in FIG. 19.
Figure 22:
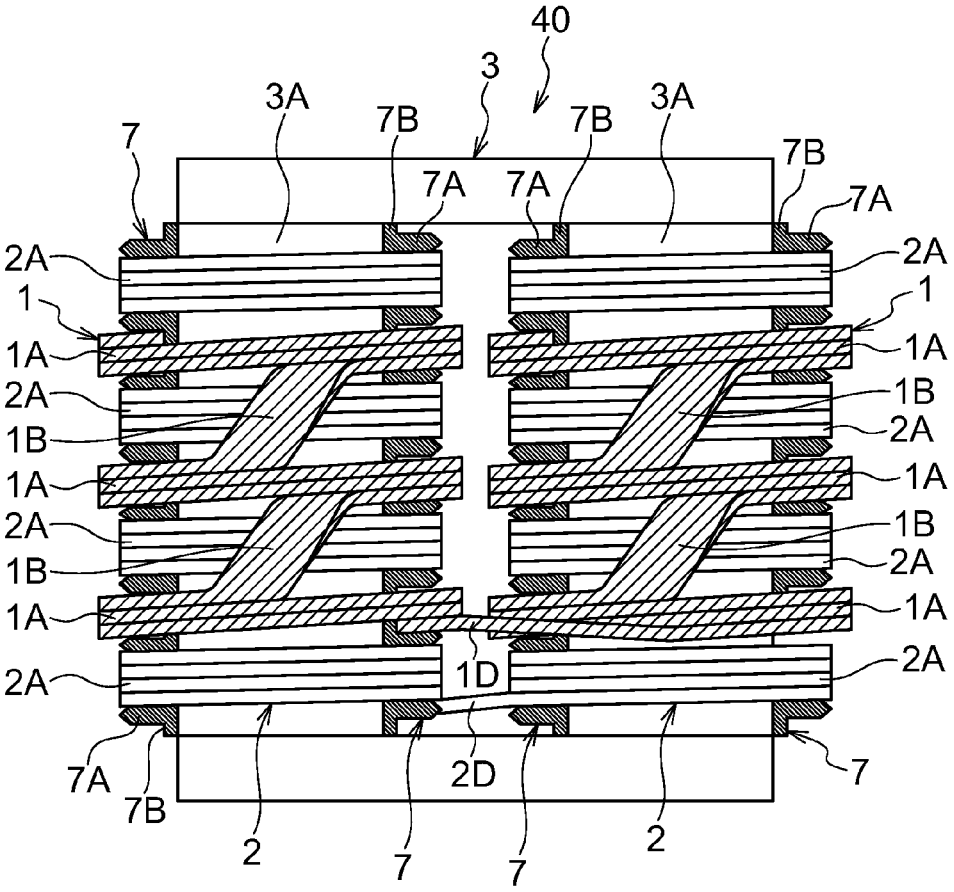
FIG. 22 is a rear view illustrating a configuration of the high frequency transformer of the fourth exemplary embodiment as viewed along the direction of arrow C in FIG. 19.
Figure 23A:
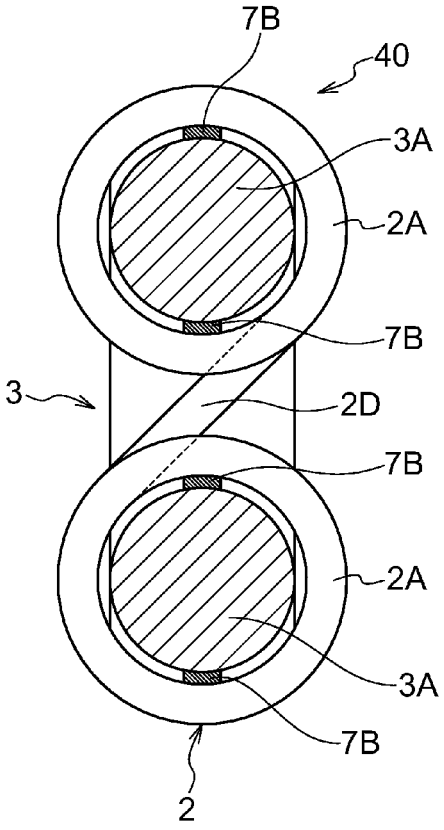
FIG. 23A is a plan view of a high frequency transformer of the fourth exemplary embodiment taken along plane X-X in FIG. 21.
Figure 23B:
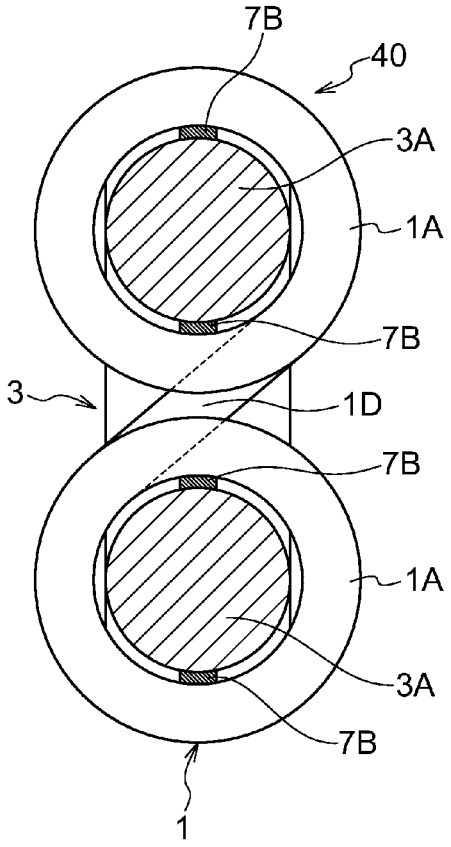
FIG. 23B is a plan view of a high frequency transformer of the fourth exemplary embodiment taken along plane Y-Y in FIG. 21.

As illustrated in FIG. 14 to FIG. 17, in the primary coil assemblies 11, 12, 13, the winding start portions and the winding end portions of the respective primary coil assemblies 11, 12, 13 configure lead wires 1C leading out to the outside of the primary coil assemblies 11, 12, 13. One of the lead wires 1C of each of the primary coil assemblies 11, 12, 13 is bent upwards and respectively connected to a connection ring 6 that is a circular ring shaped conducting body. The other lead wires 1C of the respective primary coil assemblies 11, 12, 13 respectively configure a U phase input terminal, a V phase input terminal and a W phase input terminal. The primary coil assemblies 11, 12, 13 are accordingly configured with a Y connection, as illustrated in FIG. 18.

As illustrated in FIG. 14 to FIG. 17, in the secondary coil assemblies 21, 22, 23 the winding start portions and the winding end portions of the respective secondary coil assemblies 21, 22, 23 configure lead wires 2C leading out to the outside of the secondary coil assemblies 21, 22, 23. The winding end lead wire 2C of the secondary coil assembly 21 is connected to the winding start lead wire 2C of the secondary coil assembly 22, the winding end lead wire 2C of the secondary coil assembly 22 is connected to the winding start lead wire 2C of the secondary coil assembly 23, and the winding end lead wire 2C of the secondary coil assembly 23 is connected to the lead wire 2C of the secondary coil assembly 21. A connection portion between the secondary coil assembly 23 and the secondary coil assembly 21 is connected to a u phase, a connection portion between the secondary coil assembly 21 and the secondary coil assembly 22 is connected to a v phase, and a connection portion between the secondary coil assembly 22 and the secondary coil assembly 23 is connected to a w phase. The secondary coil assemblies 21, 22, 23 are accordingly configured with a delta connection, as illustrated in FIG. 18.

In the three phase high frequency transformer 30, the primary coil assemblies 11, 12, 13 are thus configured with a Y connection, and the secondary coil assemblies 21, 22, 23 are configured with a delta connection, however configuration may be made wherein the primary coil assemblies 11, 12, 13 are configured with a delta connection and the secondary coil assemblies 21, 22, 23 are configured with a Y connection, or configuration may be made wherein each of the primary coil assemblies 11, 12, 13 and the secondary coil assemblies 21, 22, 23 are configured with either a delta connection or a Y connection.

The high frequency transformer 30 of the third exemplary embodiment is suitably employed in applications in which high voltage electrical energy is passed back and forth between two mutually insulated circuits by configuring both the primary coil assemblies 11, 12, 13 and the secondary coil assemblies 21, 22, 23 with Y connections.

The high frequency transformer 30 is suitably employed in applications in which an alternating current of a large current is output on the secondary coil assemblies 21, 22, 23 side by configuring the primary coil assemblies 11, 12, 13 with a delta connection and configuring the secondary coil assemblies 21, 22, 23 with a Y connection. Moreover, when unwanted harmonics are contained in the high frequency current that is input on the primary side, a high frequency current that does not contain the unwanted harmonics can be obtained from the secondary side since the harmonics contained in the input circulate in the primary coil assemblies 11, 12, 13 that are configured with a delta connection.

The high frequency transformer 30 is suitably employed in applications in which a high voltage alternating current is output from the secondary coil assemblies 21, 22, 23 side by configuring the primary coil assemblies 11, 12, 13 with a Y connection and configuring the secondary coil assemblies 21, 22, 23 with a delta connection. Moreover, even when unwanted harmonics are included in the high frequency current that is input on the primary side, since the harmonics included in the input circulate in the secondary coil assemblies 21, 22, 23 that are configured with a delta connection, the harmonics are not included in the high frequency current that is output from the secondary side.

Moreover, the high frequency transformer 30 is suitably employed in applications in which electrical energy is passed back and forth between two mutually insulated circuits at large currents and high voltages by configuring both the primary coil assemblies 11, 12, 13 and the secondary coil assemblies 21, 22, 23 with delta connections. Moreover, even when unwanted harmonics are included in the high frequency current input on the primary side, since the harmonics included in the input circulate in the primary coil assemblies 11, 12, 13 that are connected with a delta connection and in the secondary coil assemblies 21, 22, 23 that are similarly configured with a delta connection, the harmonics are not included in the high frequency current that is output from the secondary side.

4. Fourth Exemplary Embodiment

Explanation follows regarding an example of a high frequency transformer of the present invention wherein primary coil assemblies and secondary coil assemblies are respectively formed from a single flat wire, and the primary coils are inserted between the secondary coils in the primary coil assemblies and the secondary coil assemblies.

As illustrated in FIG. 19 to FIG. 23, a high frequency transformer 40 of the fourth exemplary embodiment is provided with a core-type ferrite core 3 similar to that of the first exemplary embodiment, and primary coil assemblies 1 and secondary coil assemblies 2 respectively mounted onto 2 cores 3A.

The primary coil assemblies 1 are formed from a single flat wire as described above, and are respectively formed with three primary coils 1A of three turns each, disposed with uniform intervals therebetween. The three primary coils 1A are formed such that a winding end portion of a first of mutually adjacent primary coils 1A opposes a winding start portion of the other of the mutually adjacent primary coils 1A.

The secondary coil assemblies 2 are also formed from a single flat wire as described above, and each of the secondary coil assemblies 2 is formed with four secondary coils 2A of four turns, disposed with uniform intervals therebetween. The four secondary coils 2A are formed such that a winding end portion of a first of mutually adjacent secondary coils 2A opposes a winding start portion of the other of the mutually adjacent secondary coils 2A. Note that the number of turns of the primary coils 1A and the secondary coils 2A does not necessarily have to be the number of turns illustrated in FIG. 19 to FIG. 23, and may be determined based on the ratio between the high frequency current input into the primary coil assemblies 1 and the high frequency current output from the secondary coils 2A.

Figure 24:
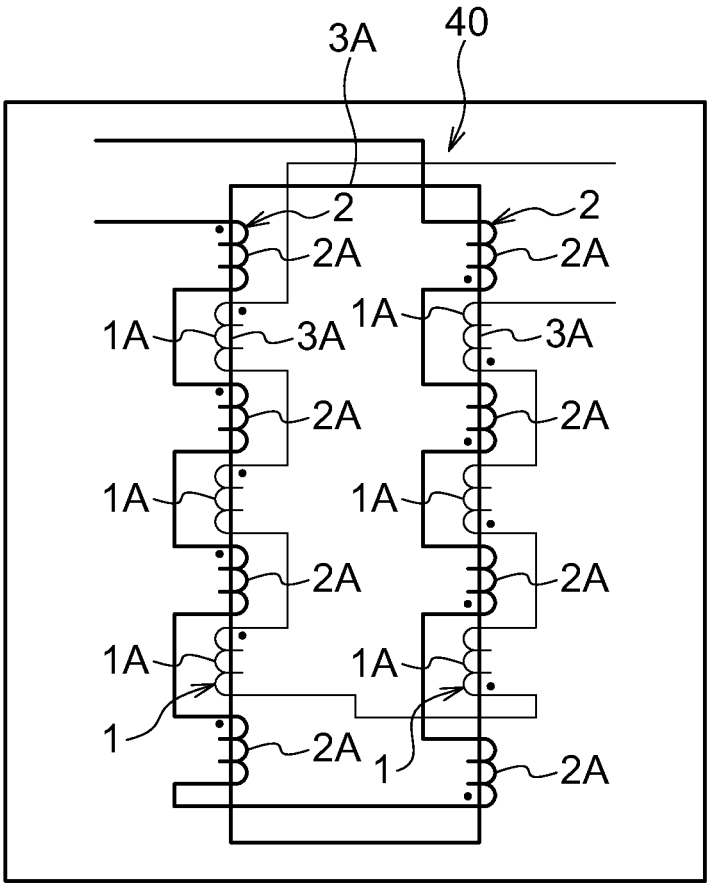
FIG. 24 is a wiring diagram illustrating wiring of primary coils and secondary coils of the high frequency transformer of the fourth exemplary embodiment.
Figure 25:
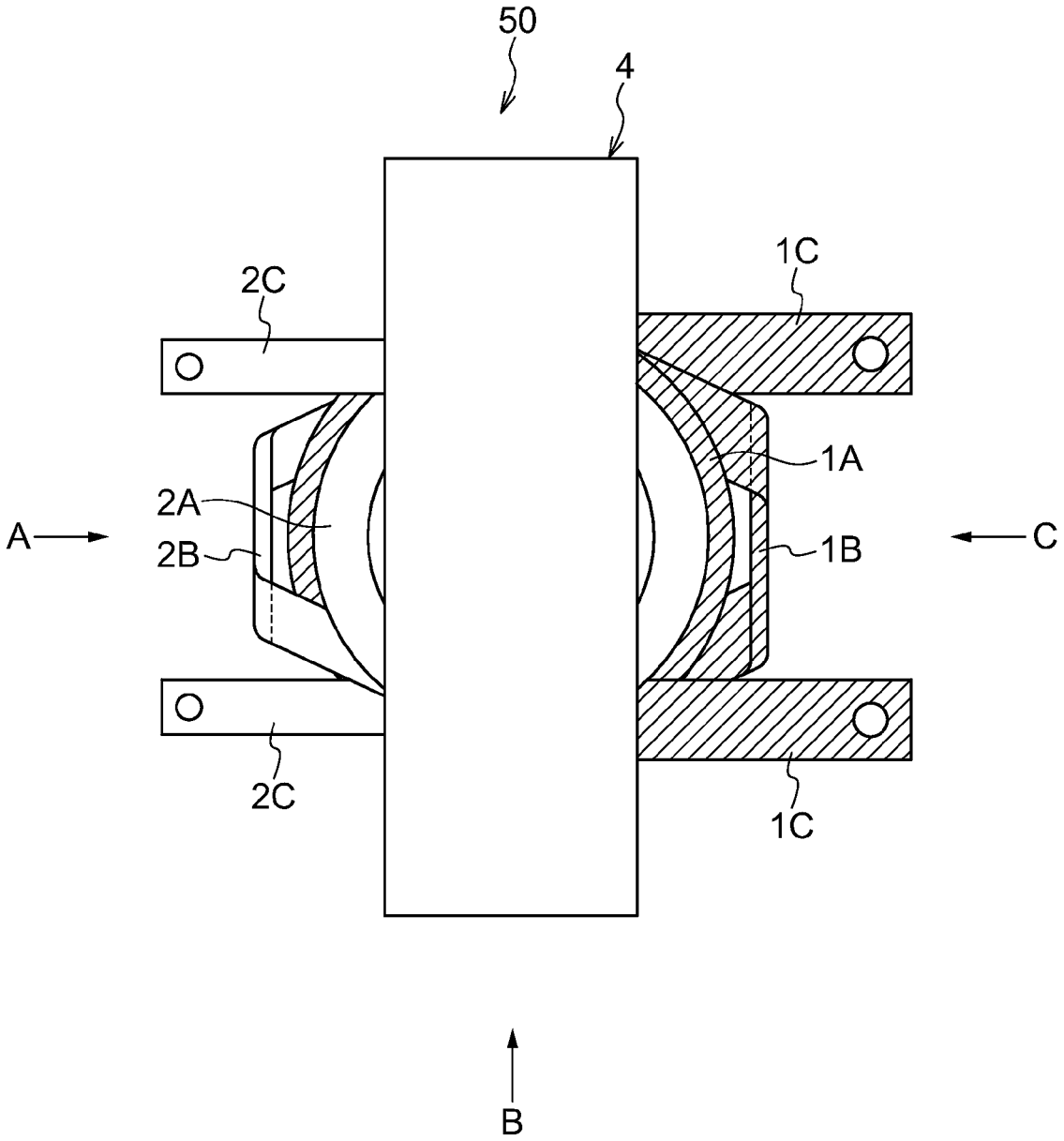
FIG. 25 is a plan view of a high frequency transformer of a fifth exemplary embodiment.
Figure 26:
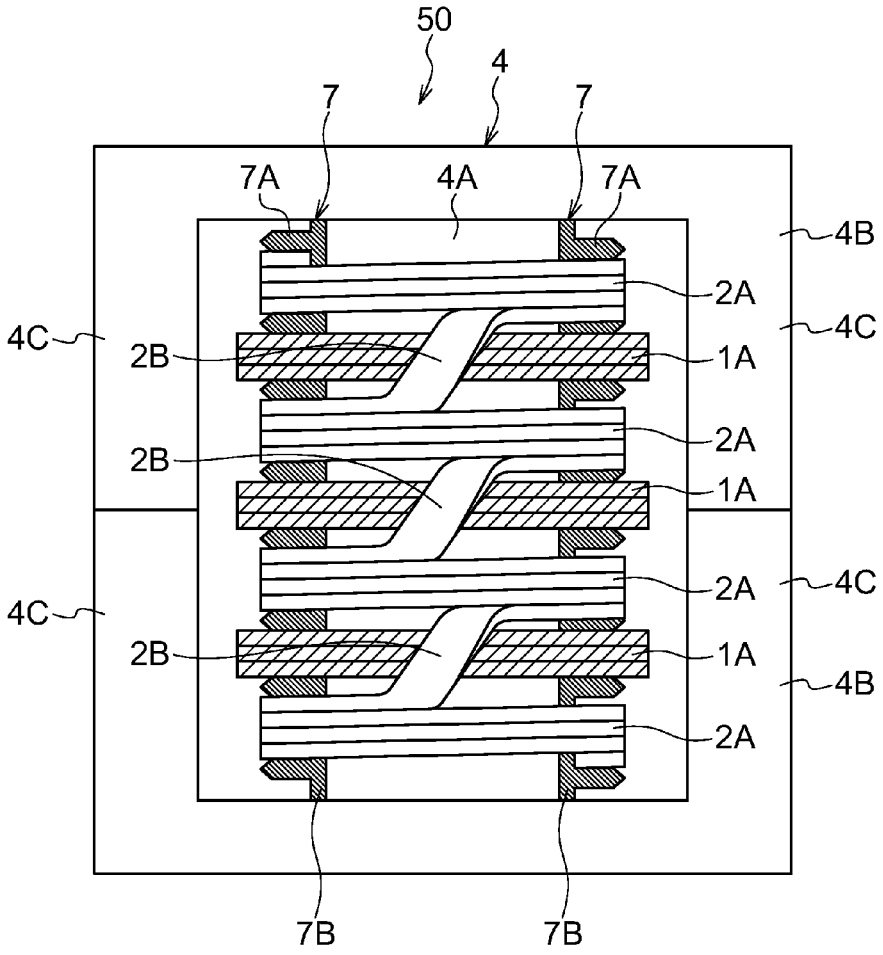
FIG. 26 is a front view illustrating a configuration of the high frequency transformer of the fifth exemplary embodiment as viewed along the direction of arrow A in FIG. 25.
Figure 27:
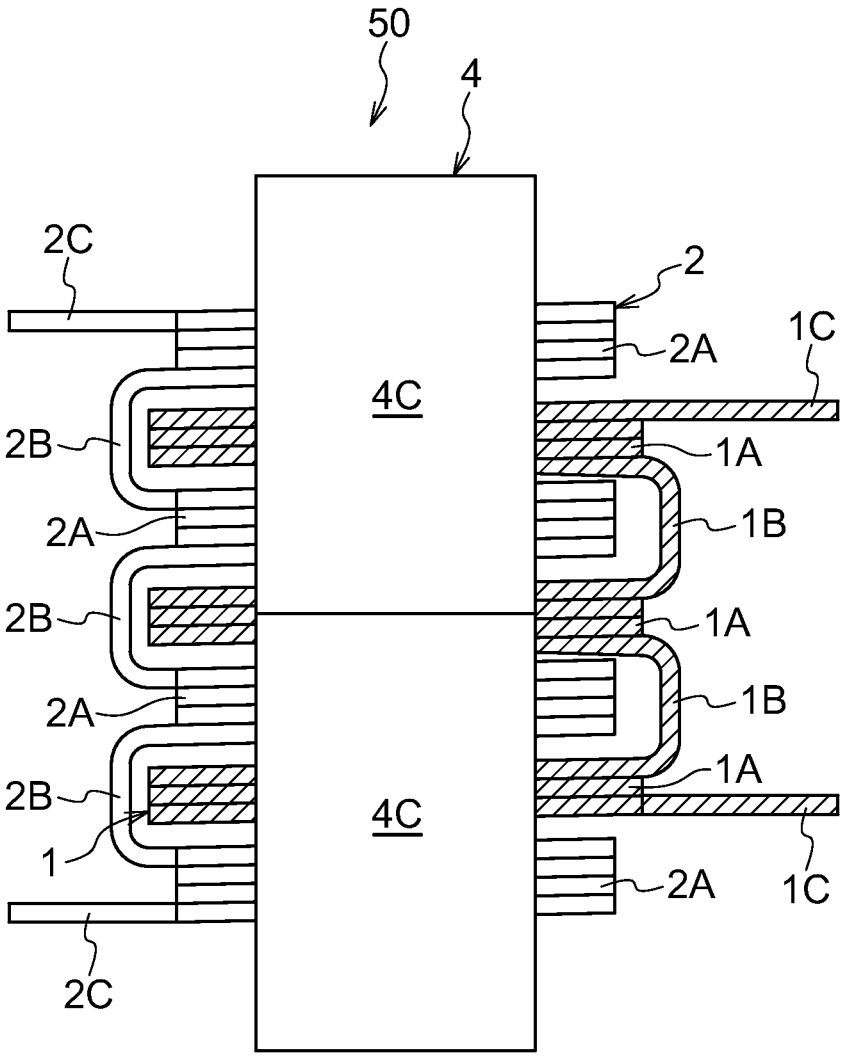
FIG. 27 is a side view illustrating a configuration of the high frequency transformer of the fifth exemplary embodiment as viewed along the direction of arrow B in FIG. 25.
Figure 28:
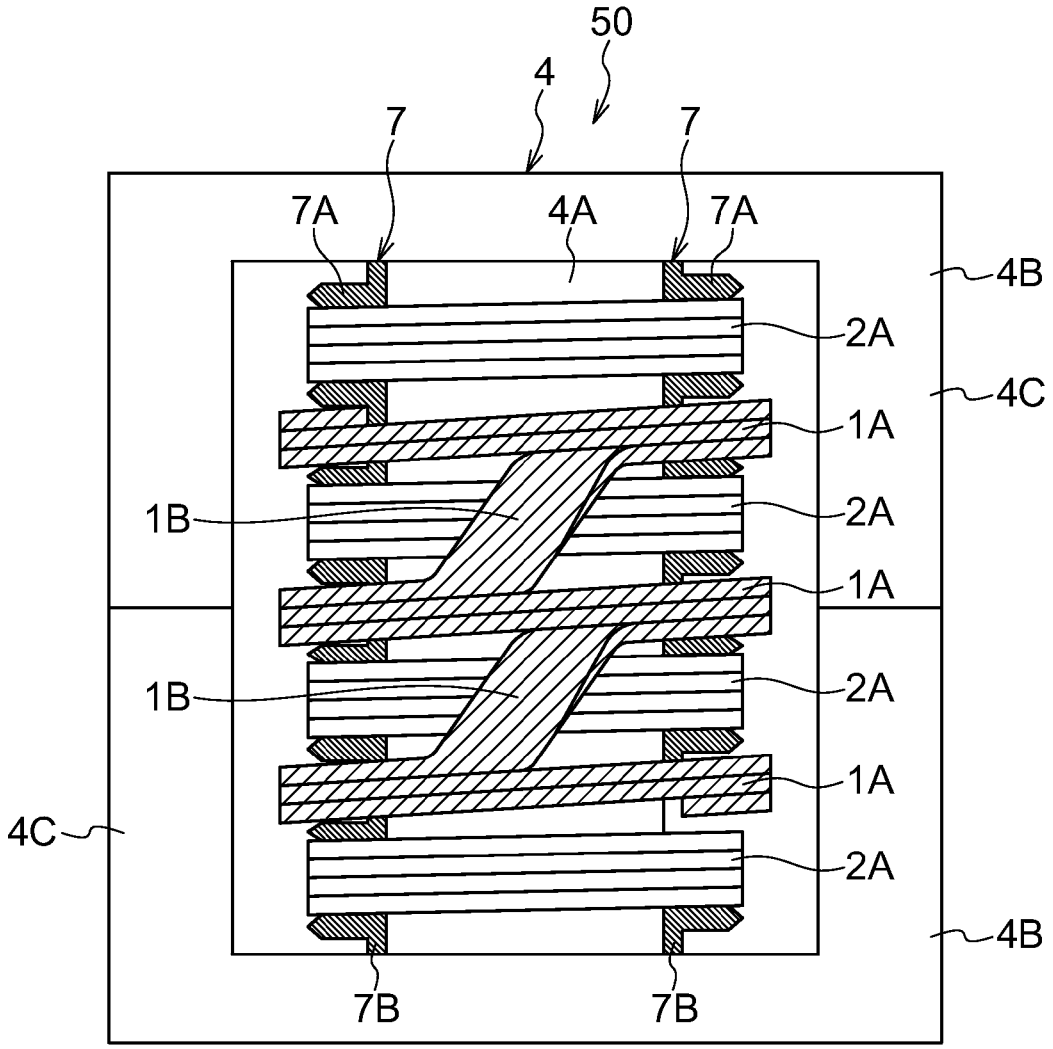
FIG. 28 is a rear view illustrating a configuration of the high frequency transformer of the fifth exemplary embodiment as viewed along the direction of arrow C in FIG. 25.

Accordingly, as illustrated in FIG. 24 the primary coils 1A and the secondary coils 2A are respectively configured in series in both the primary coil assemblies 1 and the secondary coil assemblies 2. The pair of primary coil assemblies 1 and the pair of secondary coil assemblies 2 are also respectively connected in series.

As illustrated in FIG. 19 to FIG. 23, the secondary coils 2A are formed from surface insulated flat wire wound edgewise, and the primary coils 1A are similarly formed from surface insulated flat wire wound edgewise. Note that winding edgewise refers to a winding method in which the flat wire is wound along the width direction. However, in the primary coils 1A, flat wire that is greater in both width and thickness than those of the secondary coils 2A is employed.

The primary coil assemblies 1 and the secondary coil assemblies 2 are combined together such that the primary coils 1A configuring the primary coil assemblies 1 are inserted between one and another of the mutually adjacent secondary coils 2A of the secondary coil assemblies 2, and such that the winding start portion of each of the primary coils 1A opposes the winding end portion of the one secondary coil 2A, and the winding end portion of the primary coil opposes the winding start portion of the other secondary coil 2A.

Other than in the points described above, the high frequency transformer 40 of the fourth exemplary embodiment is similar to the high-frequency transformer 10 of the first exemplary embodiment.

Similarly to the high-frequency transformer 10 of the first exemplary embodiment, since in the high frequency transformer 40 of the fourth exemplary embodiment the pair of primary coil assemblies 1 and the pair of secondary coil assemblies 2 are respectively formed by winding a single continuous flat wire at a specific interval, the effort of connecting together separately formed primary coils 1A and secondary coils 2A in order to manufacture the primary coil assemblies 1 and the secondary coil assemblies 2 is not required. The high-frequency transformer 40 can accordingly be manufactured more easily than a high frequency transformer in which separately formed primary coils 1A and secondary coils 2A are connected together to configure the primary coil assemblies 1 and the secondary coil assemblies 2. Environmental characteristics are moreover good due to having a lead-free configuration.

Since the secondary coils 2A are disposed at both ends in the high frequency transformer 40, the overall secondary coil assemblies 2 can easily be configured with a greater number of turns of the flat wire than the primary coil assemblies 1 in comparison to the high-frequency transformer 10 of the first exemplary embodiment. The high frequency transformer 40 is accordingly suitably employed in applications in which a high voltage high frequency current is output.

Explanation has been given above regarding an example in which both the primary coil assemblies 1 and the secondary coil assemblies 2 are respectively connected in series, however the primary coil assemblies 1 and the secondary coil assemblies 2 may be connected together in parallel. Moreover, configuration may be made wherein the primary coil assemblies 1 are connected together in series and the secondary coil assemblies are connected together in parallel, or configuration may be made wherein the primary coil assemblies 1 are connected together in parallel and the secondary coil assemblies are connected together in series.

5. Fifth Exemplary Embodiment

Explanation follows regarding another example of a high frequency transformer of the present invention, wherein a primary coil assembly and a secondary coil assembly are respectively formed from a single flat wire, and the primary coils are inserted between the secondary coils. As illustrated in FIG. 25 to FIG. 28, a high frequency transformer 50 of the fifth exemplary embodiment is provided with a shell-type ferrite core 4 provided with a single circular cylinder shaped central core 4A, and a primary coil assembly 1 and a secondary coil assembly 2 that are mounted onto the central core 4A.

The shell-type ferrite core 4 can be split into the central core 4A and an outside core 4C positioned so as to enclose the central core 4A from the outside similarly to in the high frequency transformer 20 of the second exemplary embodiment. Both the central core 4A and the outside core 4C are configured similarly to as described above in the second exemplary embodiment.

As illustrated in FIG. 25 to FIG. 28, the primary coil assembly 1 and the secondary coil assembly 2 are respectively formed from a single continuous flat wire. The primary coil assembly 1 is formed with three primary coils 1A of three turns each, formed in uniform intervals such that a winding end portion of one of adjacent primary coils 1A opposes a winding start portion of the other of the adjacent primary coils 1A. The secondary coil assembly 2 is formed with four secondary coils 2A of four turns each, formed in uniform intervals such that a winding end portion of one of adjacent secondary coils 2A opposes a winding start portion of the other of the adjacent secondary coils 2A.

The primary coil assembly 1 and the secondary coil assembly 2 are combined together such that the primary coils 1A are inserted between adjacent secondary coils 2A, and the winding start portion of each of the respective primary coils 1A of the primary coil assembly 1 opposes the winding end portion of one of adjacent secondary coils 2A of the secondary coil assembly 2, and the winding end portion of the primary coil 1A opposes the winding start portion of the other of the adjacent secondary coils 2A. All of the primary coils 1A and the secondary coils 2A are moreover arrayed coaxially to one another.

The flat wire configuring the primary coil assembly 1 configures crossing wires 1B that are pulled out to the outside of the primary coils 1A at portions between the primary coils 1A. The crossing wires 1B are formed so as to straddle the outside of the secondary coils 2A adjacent to the primary coils 1A. Similarly, the flat wire configuring the secondary coil assembly 2 configures crossing wires 2B that are pulled out to the outside of the secondary coils 2A at portions between the secondary coils 2A.

Figure 29:
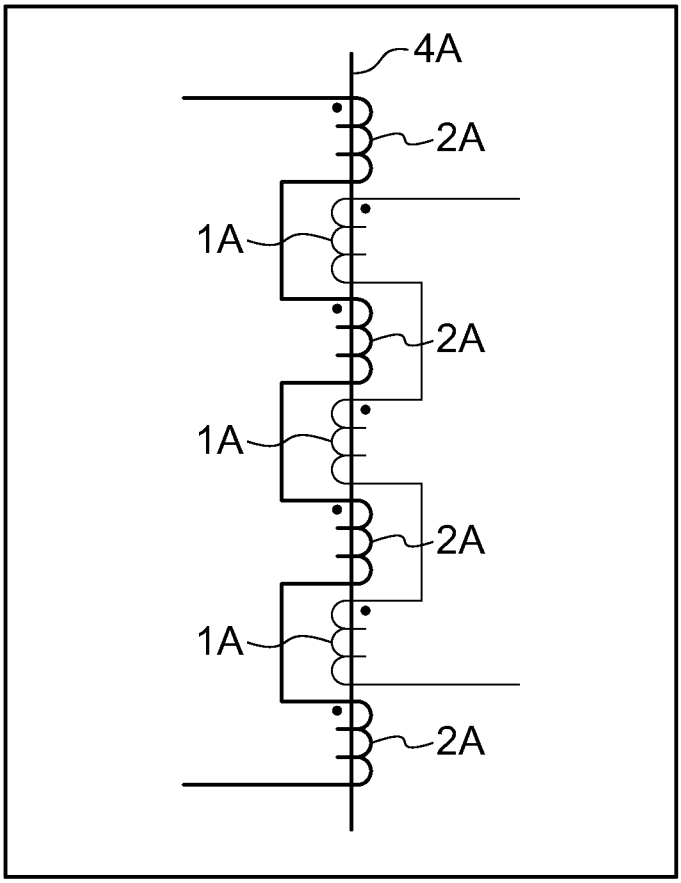
FIG. 29 is a wiring diagram illustrating wiring of primary coils and secondary coils of a high frequency transformer of the fifth exemplary embodiment.
Figure 30:
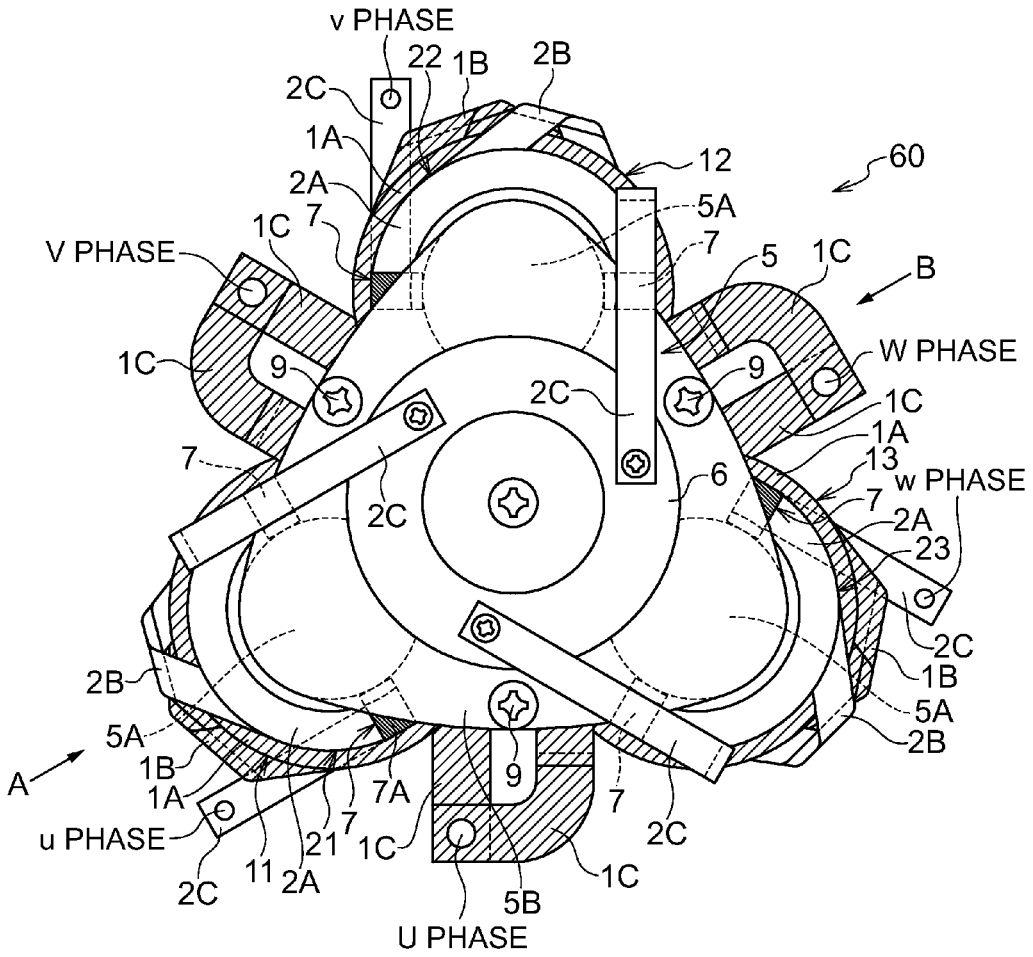
FIG. 30 is a plan view of a three phase high frequency transformer of a sixth exemplary embodiment.
Figure 31:
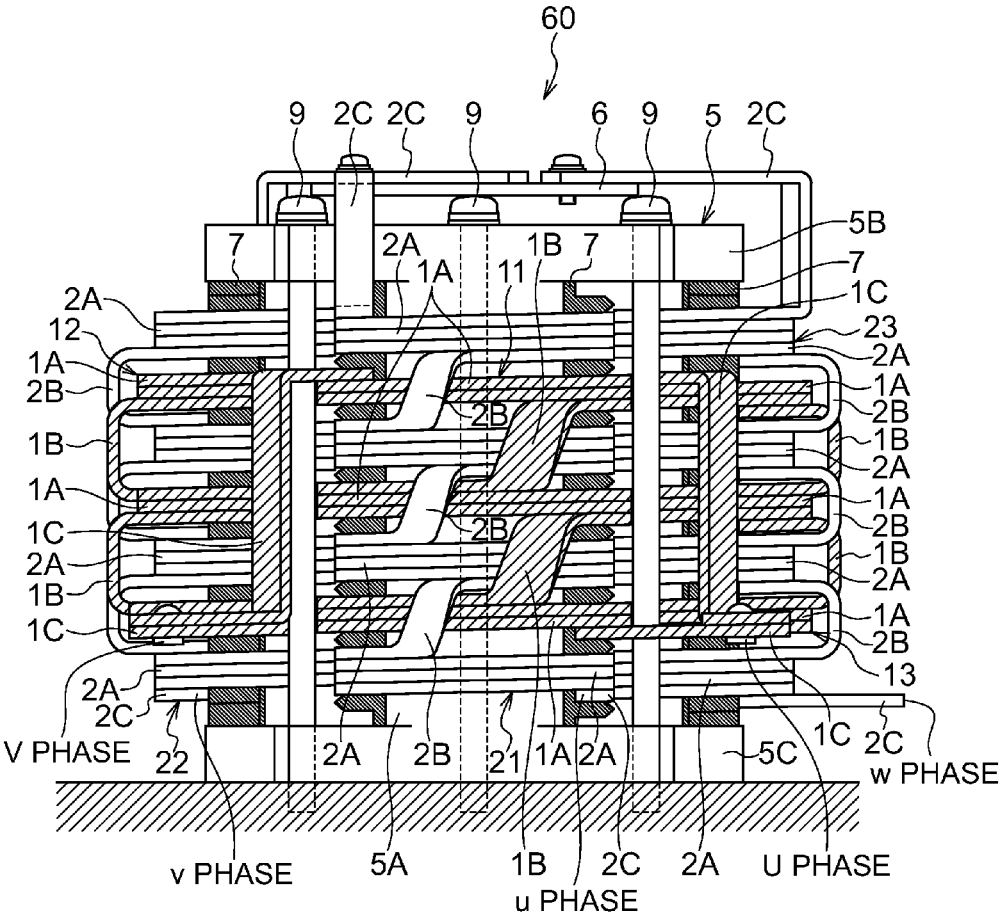
FIG. 31 is a side view illustrating a configuration of the three phase high frequency transformer of the sixth exemplary embodiment as viewed along the direction of arrow A in FIG. 30.
Figure 32:
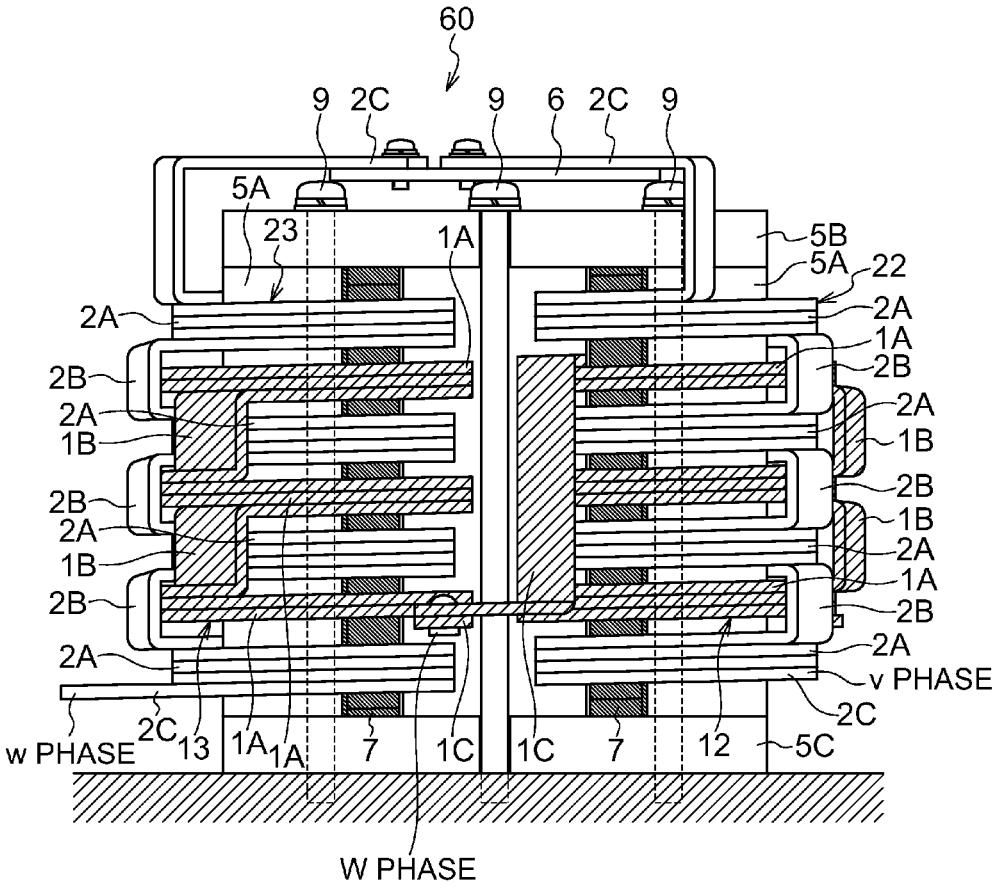
FIG. 32 is a side view illustrating a configuration of the three phase high frequency transformer of the sixth exemplary embodiment as viewed along the direction of arrow B in FIG. 30.

As illustrated in FIG. 29, the primary coils 1A of the primary coil assembly 1 are accordingly configured in series, and the secondary coils 2A of the secondary coil assembly 2 are also configured in series.

As illustrated in FIG. 25 to FIG. 28, portions of the flat wire forming the primary coil assembly 1 configure lead wires 1C that lead out to the outside of the primary coils 1 at the winding start portion and winding end portion of the primary coil assembly 1. The lead wires 1C are connected to an input source that inputs a high frequency current into the primary coils 1.

Similarly, portions of the flat wire forming the secondary coil assembly 2 configure lead wires 2C that lead out to the outside of the secondary coils 2 at the winding start portion and the winding end portion. High frequency current with a voltage and current corresponding to the ratio of the number of turns between the primary coils and the secondary coils is output from the lead wires 2C.

Insulating members 7 are inserted between the primary coil assembly 1 and secondary coil assembly 2, and the central core 4A of the shell-type ferrite core 4. The insulating members 7 are configured by insulation tabs 7A that extend towards the outside, and an insulation tab retaining member 7B that retains the insulation tabs 7A at specific intervals. The insulation tabs 7A of the insulating members 7 are inserted between the primary coils 1A and the secondary coils 2A, and the insulation tab retaining member 7B is inserted between the primary coils 1A and the secondary coils 2A and the core 3A.

The high frequency transformer 50 of the fifth exemplary embodiment moreover employs the shell-type ferrite core 4 as the core, similarly to the high frequency transformer 20 of the second exemplary embodiment, thereby increasing the ratio of the core with respect to the coils in comparison to the high frequency transformer of the first exemplary embodiment that employs a core-type core as the ferrite core, thereby strengthening the iron machine characteristics. Accordingly, in addition to the features of the high frequency transformer of the fourth exemplary embodiment, there is also the advantageous effect of being suitably applied in applications with a small number of turns of the primary coils and the secondary coils, in particular in high frequency inverters (in the region of 50 kHz to 1 MHz).

Moreover, similarly to the high frequency transformer 20 of the second exemplary embodiment, the high frequency transformer 50 has a lead-free configuration, thus giving good environmental characteristics.

In the high frequency transformer 50 the secondary coils 2A are disposed at both ends, thereby making it easy to configure a greater number of turns of the flat wire in the overall secondary coil assembly 2 than the number of turns of the overall primary coil assembly 1 than in the high frequency transformer 20 of the second exemplary embodiment. The high frequency transformer 50 is accordingly suitably employed in applications in which a high voltage high frequency current is output.

6. Sixth Exemplary Embodiment

Explanation follows regarding a three phase high frequency transformer included in the high frequency transformer of the present invention wherein the primary coil assemblies and the secondary coil assemblies are respectively formed from a single flat wire, and the primary coils are inserted between the secondary coils.

As illustrated in FIG. 30 to FIG. 34, in a three phase high frequency transformer 60 of the sixth exemplary embodiment, a three phase, three-legged ferrite core 5 is inserted into primary coil assemblies 11, 12, 13 and secondary coil assemblies 21, 22, 23. Two insulating members 7 are fitted into each of the primary coil assemblies 11, 12, 13 and secondary coil assemblies 21, 22, 23 at symmetrical positions about the axis of respective columnar cores 5A, which is described later.

The configuration of the three-legged ferrite core 5, and the relationships between the three-phase ferrite core 5, the primary coil assemblies 11, 21, 13 and the secondary coil assemblies 21, 22, 23 are similar to as described above in the third exemplary embodiment.

As illustrated in FIG. 30 to FIG. 34, the primary coil assemblies 11, 12, 13 and the secondary coil assemblies 21, 22, 23 are respectively formed from a single continuous flat wire. The primary coil assemblies 11, 12, 13 are respectively formed with three primary coils 1A of three turns each, formed in uniform intervals such that in two adjacent primary coils 1A, a winding end portion of one of the adjacent primary coils 1A opposes a winding start portion of the other of the adjacent primary coils 1A. Similarly, the secondary coil assemblies 21, 22, 23 are respectively formed with four secondary coils 2A of four turns each, formed in uniform intervals such that in two adjacent secondary coils 2A, a winding end portion of one of the adjacent secondary coils 2A opposes a winding start portion of the other of the adjacent secondary coils 2A.

The flat wire configuring the primary coil assemblies 11, 12, 13 configures crossing wires 1B that are pulled out to the outside of the primary coils 1A at portions between the primary coils 1A. The crossing wires 1B are formed so as to straddle the outside of the adjacent secondary coil 2A. Similarly, the flat wire configuring the secondary coil assemblies 21, 22, 23 configures crossing wires 2B that are pulled out to the outside of the secondary coils 2A at portions between the secondary coils 2A. The crossing wires 2B are formed so as to straddle the outside of the adjacent primary coil 1A.

Figure 33:
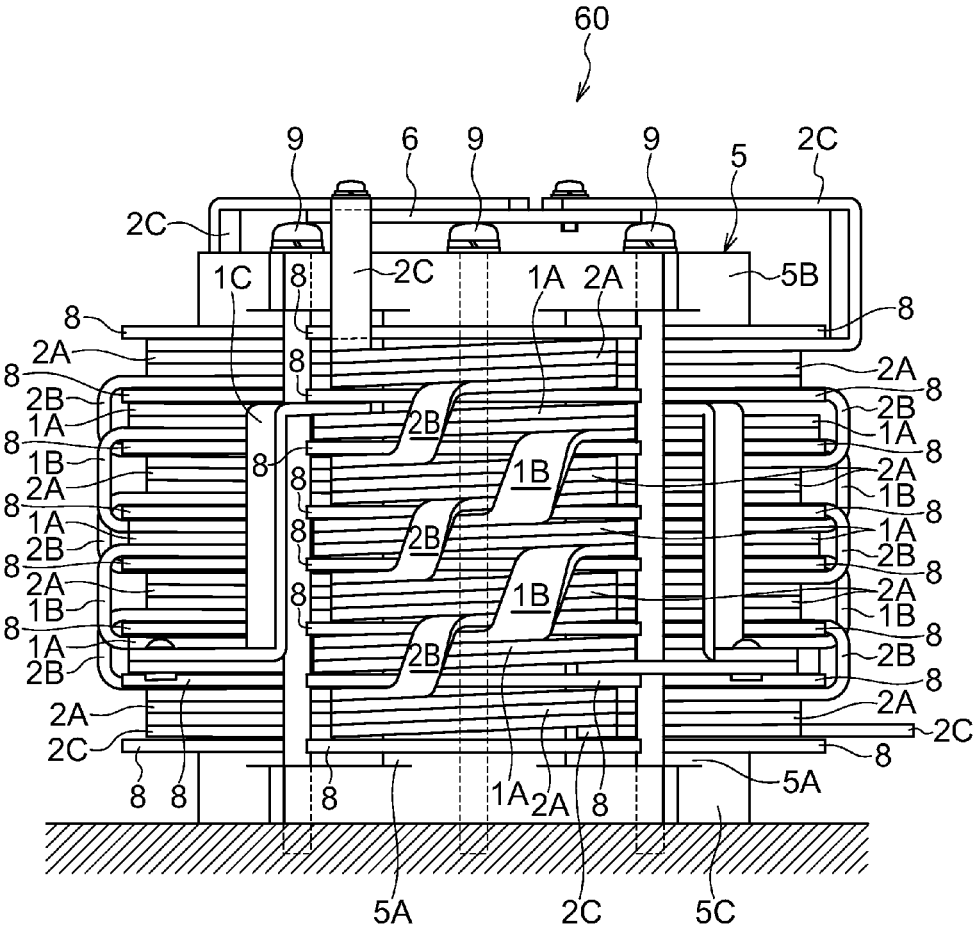
FIG. 33 is a side view illustrating an example of the three phase high frequency transformer of the sixth exemplary embodiment having insulation washers that are inserted between primary coils and secondary coils instead of insulating members.
Figure 34:
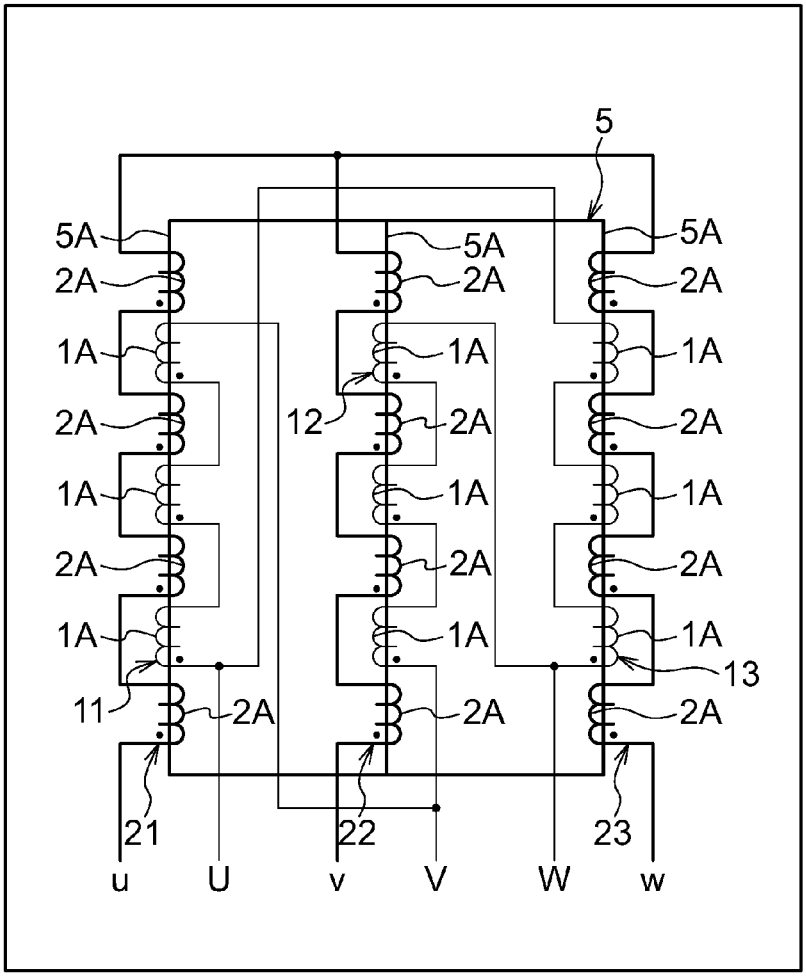
FIG. 34 is a wiring diagram illustrating wiring of primary coils and secondary coils of a three phase high frequency transformer of the sixth exemplary embodiment.

The insulating members 7 are disposed similarly to as described above in the third exemplary embodiment. Moreover, as illustrated in FIG. 33, configuration may be made wherein insulation washers 8 that are insulation plates or insulation sheets are inserted between the primary coils 1A and the secondary coils 2A instead of the insulating members 7.

Figure 35:
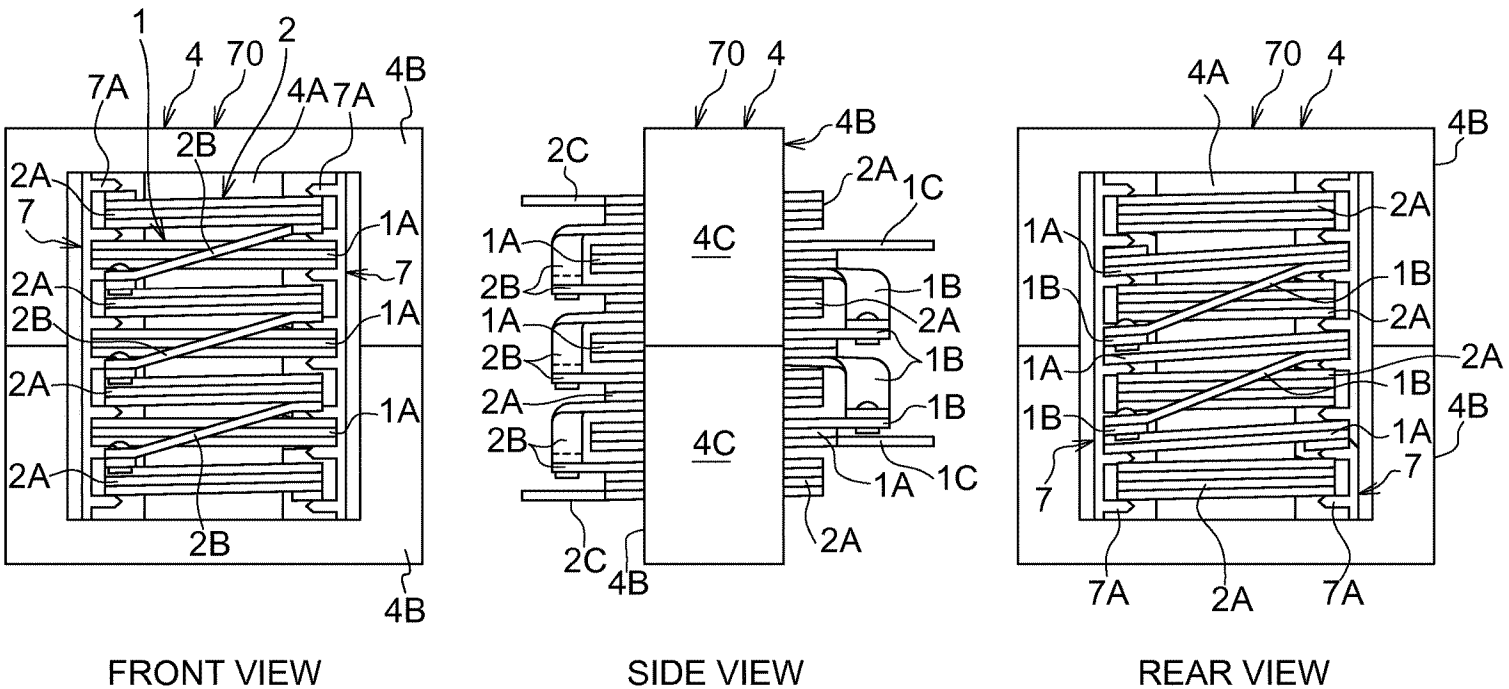
FIG. 35 includes a front view, a side view and a rear view of a high frequency transformer of a seventh exemplary embodiment.

As illustrated in FIG. 30 to FIG. 33, in the primary coil assemblies 11, 12, 13 the winding start portions and the winding end portions of the respective primary coil assemblies 11, 12, 13 configure lead wires 1C leading out to the outside of the primary coil assemblies 11, 12, 13. The winding end lead wire 1C of the primary coil assembly 11 is connected to the winding start lead wire 1C of the primary coil assembly 12, the winding end lead wire 1C of the primary coil assembly 12 is connected to the winding start lead wire 1C of the primary coil assembly 13, and the winding end lead wire 1C of the primary coil assembly 13 is connected to the lead wire 1C of the primary coil assembly 11. A connection portion between the primary coil assembly 13 and the primary coil assembly 11 is connected to a u phase, a connection portion between the primary coil assembly 11 and the primary coil assembly 12 is connected to a v phase, and a connection portion between the primary coil assembly 12 and the primary coil assembly 13 is connected to a w phase. The primary coil assemblies 11, 12, 13 are accordingly configured with a delta connection, as illustrated in FIG. 35.

However, as illustrated in FIG. 30 to FIG. 33, in the secondary coil assemblies 21, 22, 23 the winding start portions and the winding end portions of the respective secondary coil assemblies 21, 22, 23 configure lead wires 2C leading out to the outside of the secondary coil assemblies 21, 22, 23. One of the lead wires 2C of each of the secondary coil assemblies 21, 22, 23 is bent upwards and respectively connected to a connection ring 6 that is a circular ring shaped conducting body. The other lead wires 2C of the respective secondary coil assemblies 21, 22, 23 respectively configure a U phase input terminal, a V phase input terminal and a W phase input terminal. The secondary coil assemblies 21, 22, 23 are accordingly configured with a Y connection, as illustrated in FIG. 35.

In the three phase high frequency transformer 60, the primary coil assemblies 11, 12, 13 are thus configured with a delta connection, and the secondary coil assemblies 21, 22, 23 are configured with a Y connection, however configuration may be made wherein the primary coil assemblies 11, 12, 13 are configured with a Y connection and the secondary coil assemblies 21, 22, 23 are configured with a delta connection, or configuration may be made wherein the primary coil assemblies 11, 12, 13 and the secondary coil assemblies 21, 22, 23 are both configured with either a delta connection or a Y connection.

The high frequency transformer 60 of the sixth exemplary embodiment is suitably employed in applications in which high voltage electrical energy is passed back and forth between two mutually insulated circuits by configuring both the primary coil assemblies 11, 12, 13 and the secondary coil assemblies 21, 22, 23 with Y connections.

The high frequency transformer 60 is suitably employed in applications in which a large alternating current is output on the secondary coil assemblies 21, 22, 23 side by configuring the primary coil assemblies 11, 12, 13 with a delta connection and configuring the secondary coil assemblies 21, 22, 23 with a Y connection. Moreover, when unwanted harmonics are included in the high frequency current that is input on the primary side, a high frequency current that does not include the unwanted harmonics can be obtained from the secondary side since the harmonics included in the input circulate in the primary coil assemblies 11, 12, 13 that are configured with a delta connection.

The high frequency transformer 60 is suitably employed in applications in which a high voltage alternating current is output on the secondary coil assemblies 21, 22, 23 side by configuring the primary coil assemblies 11, 12, 13 with a Y connection and configuring the secondary coil assemblies 21, 22, 23 with a delta connection. Moreover, even when unwanted harmonics are included in the high frequency current that is input on the primary side, since the harmonics included in the input circulate in the secondary coil assemblies 21, 22, 23 that are configured with a delta connection, the harmonics are not included in the high frequency current that is output from the secondary side.

Moreover, the high frequency transformer 60 can be suitably employed in applications in which electrical energy is passed back and forth between two mutually insulated circuits at large currents and high voltages by configuring both the primary coil assemblies 11, 12, 13 and the secondary coil assemblies 21, 22, 23 with delta connections. Moreover, even when unwanted harmonics are included in the high frequency current that is input on the primary side, since the harmonics included in the input circulate in the primary coil assemblies 11, 12, 13 that are connected with a delta connection and in the secondary coil assemblies 21, 22, 23 that are similarly configured with a delta connection, the harmonics are not included in the high frequency current that is output from the secondary side.

7. Seventh Exemplary Embodiment

Explanation follows regarding an example of a high frequency transformer of the present invention wherein a primary coil assembly and a secondary coil assembly are formed by inserting the primary coils between the secondary coils, and connecting together the primary coils and the secondary coils at crossing wires.

Figure 36:
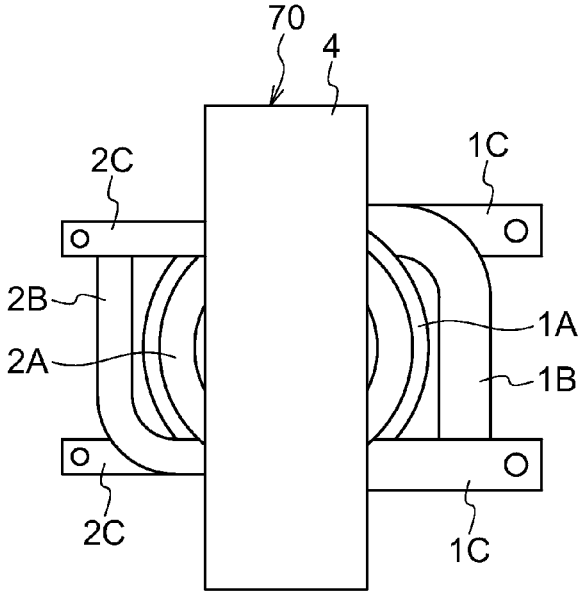
FIG. 36 is a plan view of the high frequency transformer of the seventh exemplary embodiment.
Figure 37:
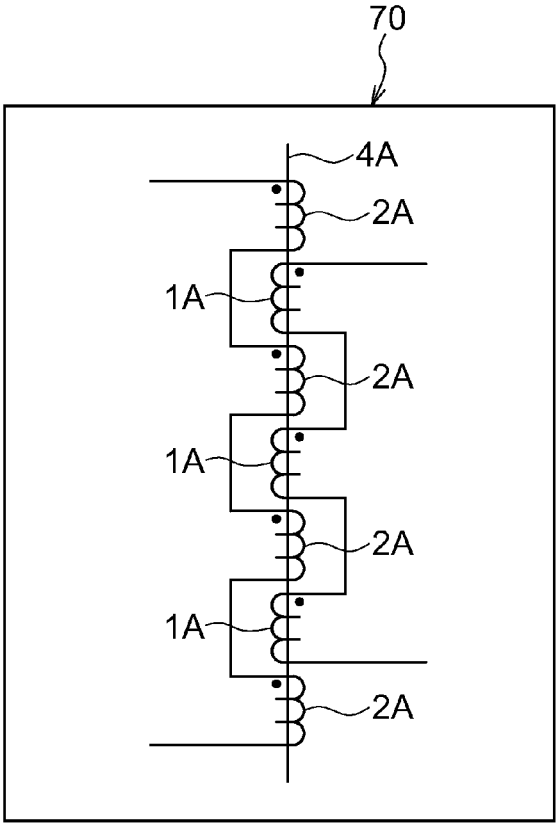
FIG. 37 is a wiring diagram illustrating connections of primary coils and secondary coils in the high frequency transformer of the seventh exemplary embodiment.

As illustrated in FIG. 35 and FIG. 36, a high frequency transformer 70 of the seventh exemplary embodiment is provided with a shell-type ferrite core 4 including a single circular cylinder shaped central core 4A, and a primary coil assembly 1 and a secondary coil assembly 2 into which the central core 4A is inserted.

The shell-type ferrite core 4 is configured similarly to as described above in the second exemplary embodiment and the fifth exemplary embodiment.

The primary coil assembly 1 is configured by three primary coils 1A of three turns each arrayed in series, and the secondary coil assembly 2 is configured by four secondary coils 2A of four turns each arrayed in series.

Start end portions and finish end portions of the flat wire configuring the primary coils 1A configure crossing wires 1B that are pulled out to the outside of the primary coils 1A. Similarly, start end portions and finish end portions of the flat wire configuring the secondary coils 2A configure crossing wires 2B that are pulled out to the outside of the secondary coils 2A. The primary coils 1A are connected together by the crossing wires 1B. Similarly, the secondary coils 2A are connected together by the crossing wires 2B. The means for connecting together the primary coils 1A and the means for connecting together the secondary coils 2A include for example soldering, brazing, welding and bolts.

The winding start side crossing wire 1B of the primary coil 1A positioned at one end of the primary coil assembly 1 and the winding end side crossing wire 1B of the primary coil 1A positioned at the other end of the primary coil assembly 1 respectively configure lead wires 1C. Similarly, the winding start side crossing wire 2B of the secondary coil 2A positioned at one end of the secondary coil assembly 2 and the winding end side crossing wire 2B of the secondary coil 2A positioned at the other end of the secondary coil assembly 2 respectively configure lead wires 2C.

Moreover, the primary coil assembly 1 and the secondary coil assembly 2 are combined together such that the primary coils 1A are inserted between adjacent secondary coils 2A, and the winding start portions of the respective primary coils 1A of the primary coil assembly 1 oppose the winding end portion of one of adjacent secondary coils 2A of the secondary coil assembly 2, and the winding end portion of the primary coil 1A opposes the winding start portion of the other of the adjacent secondary coils 2A. All of the primary coils 1A and the secondary coils 2A are moreover arrayed so as to be coaxial to each other.

The high frequency transformer 70 of the seventh exemplary embodiment employs the shell-type ferrite core 4 as the core, similarly to the high frequency transformer 20 of the second exemplary embodiment, thereby increasing the ratio of the core with respect to the coils in comparison to high frequency transformers in which the ferrite core is a core-type core, thereby strengthening the iron machine characteristics. There is accordingly the advantageous effect of being suitably applied in applications with a small number of turns of the primary coils and the secondary coils, in particular in high frequency inverters (in the region of 50 kHz to 1 MHz).

8. Eighth Exemplary Embodiment

Explanation follows regarding another example of a high frequency transformer of the present invention wherein the primary coil assembly and the secondary coil assembly are formed by inserting the primary coils between the secondary coils, and the primary coils and the secondary coils are respectively connected together at crossing wires.

Figure 38:
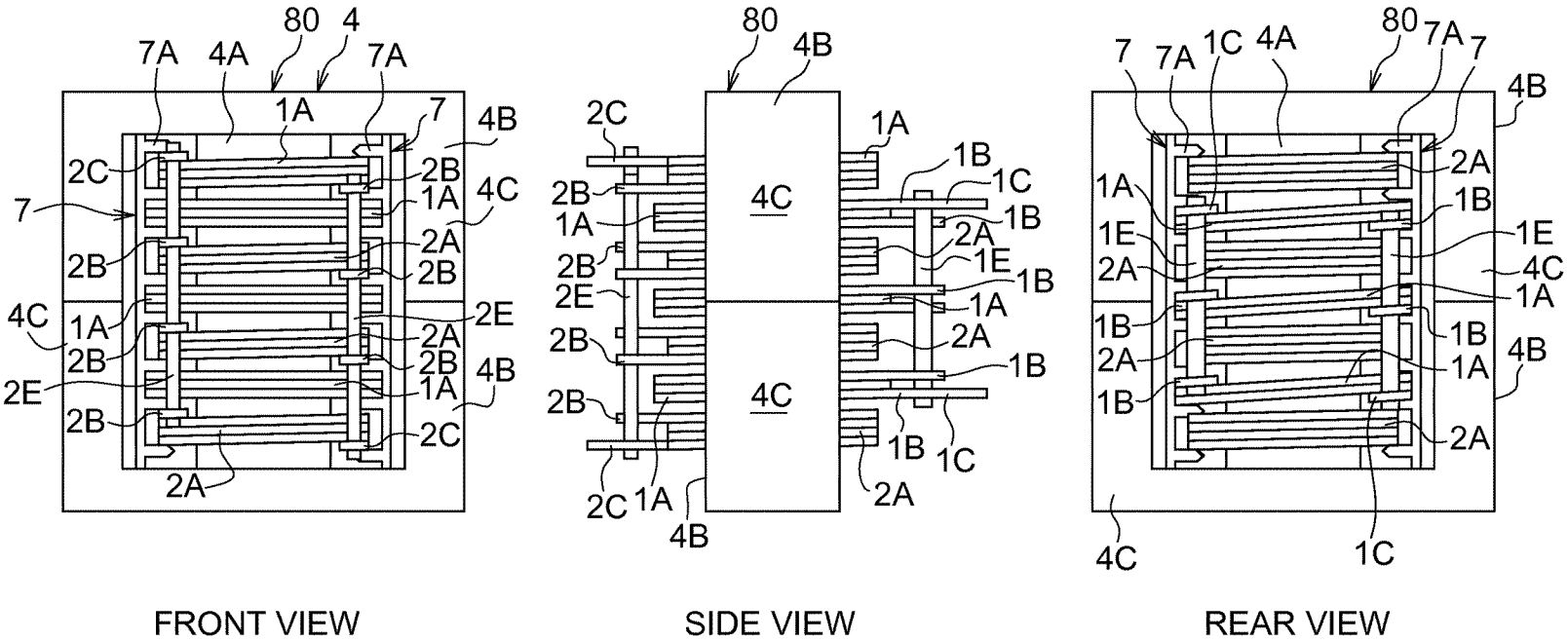
FIG. 38 includes a front view, a side view and a rear view of a high frequency transformer of the eighth exemplary embodiment.
Figure 39:
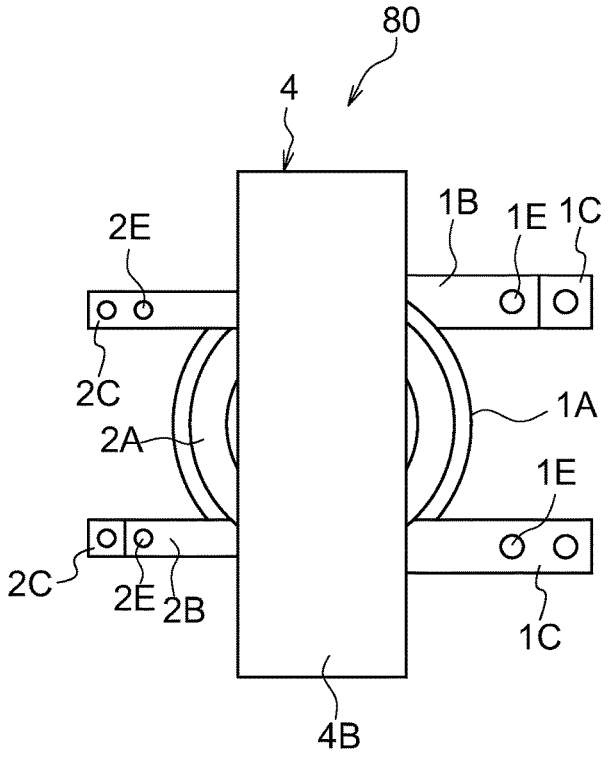
FIG. 39 is a plan view of the high frequency transformer of the eighth exemplary embodiment.

As illustrated in FIG. 38 and FIG. 39, a high frequency transformer 80 of the eighth exemplary embodiment is provided with a shell-type ferrite core 4 including a single circular cylinder shaped central core 4A, and a primary coil assembly 1 and a secondary coil assembly 2 into which the central core 4A is inserted.

The shell-type ferrite core 4 is configured similarly to as described above in the second exemplary embodiment and the fifth exemplary embodiment.

Figure 40:
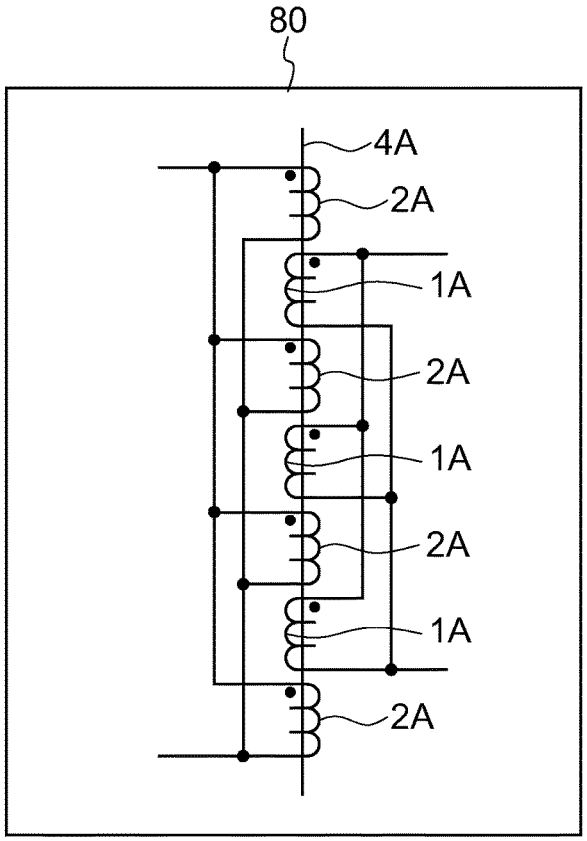
FIG. 40 is a wiring diagram illustrating connection of primary coils and secondary coils of the high frequency transformer of the eighth exemplary embodiment.

As illustrated in FIG. 38 to FIG. 40, in the high frequency transformer 80 of the eighth exemplary embodiment, a primary coil assembly 1 is configured by three primary coils 1A of three turns each that are connected together in parallel by crossing bars 1E at respective pairs of crossing wires 1B. Similarly, a secondary coil assembly 2 is configured by four secondary coils 2A of four turns each that are connected together in parallel by crossing bars 2E at respective pairs of crossing wires 2B.

In the primary coil assembly 1, the winding start portion crossing wire 1B of a first tier primary coil 1A and the winding end portion crossing wire 1B of a third tier primary coil 1A respectively configure lead wires 1C. Similarly, in the secondary coil assembly 2 the winding start portion crossing wire 2B of a first tier secondary coil 2A and the winding end portion crossing wire 2B of a fourth tier secondary coil 2A respectively configure lead wires 2C.

The primary coil assembly 1 and the secondary coil assembly 2 are combined together similarly to the high frequency transformer 70 of the seventh exemplary embodiment, such that the primary coils 1A are inserted between adjacent secondary coils 2A, and the winding start portions of the respective primary coils 1A of the primary coil assembly 1 oppose the winding end portion of one of adjacent secondary coils 2A of the secondary coil assembly 2, and the winding end portion of the primary coil 1A opposes the winding start portion of the other of the adjacent secondary coils 2A. All of the primary coils 1A and the secondary coils 2A are moreover arrayed so as to be coaxial to each other.

As illustrated in FIG. 40, the high frequency transformer 80 is configured with both the three primary coils 1A configuring the primary coil assembly 1 and the four secondary coils 2A configuring the secondary coil assembly 2 respectively connected together in parallel. The high frequency transformer 80 is accordingly particularly suitably employed in applications in which a low voltage, large current high frequency current is input into the primary side and an even lower voltage and larger current high frequency current is output from the secondary side.

9. Ninth Exemplary Embodiment

Explanation follows regarding yet another example of a high frequency transformer of the present invention wherein the primary coil assembly and the secondary coil assembly are formed by inserting the primary coils between the secondary coils, and the primary coils and the secondary coils are respectively connected together at crossing wires.

Figure 41:
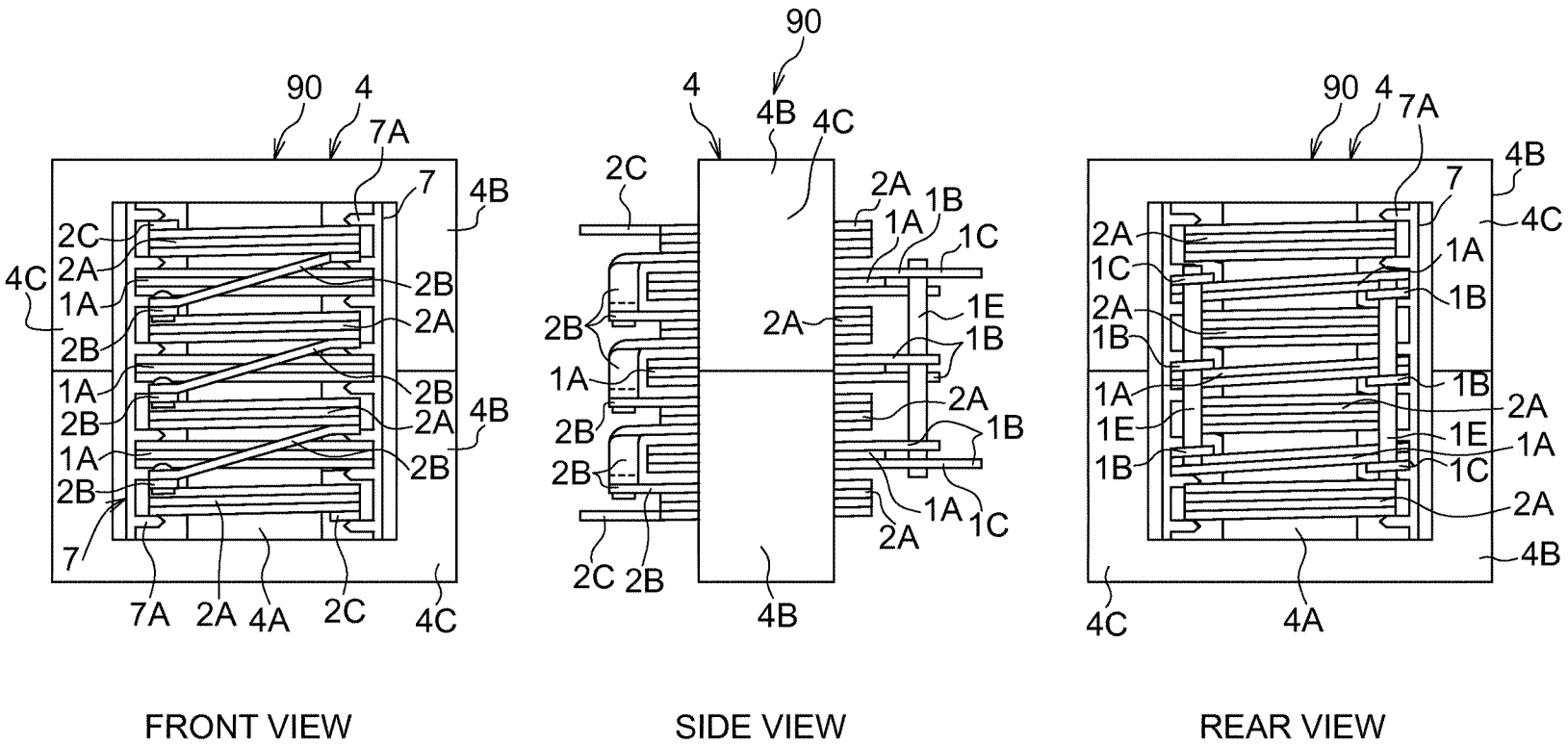
FIG. 41 includes a front view, a side view and a rear view of a high frequency transformer of a ninth exemplary embodiment.
Figure 42:
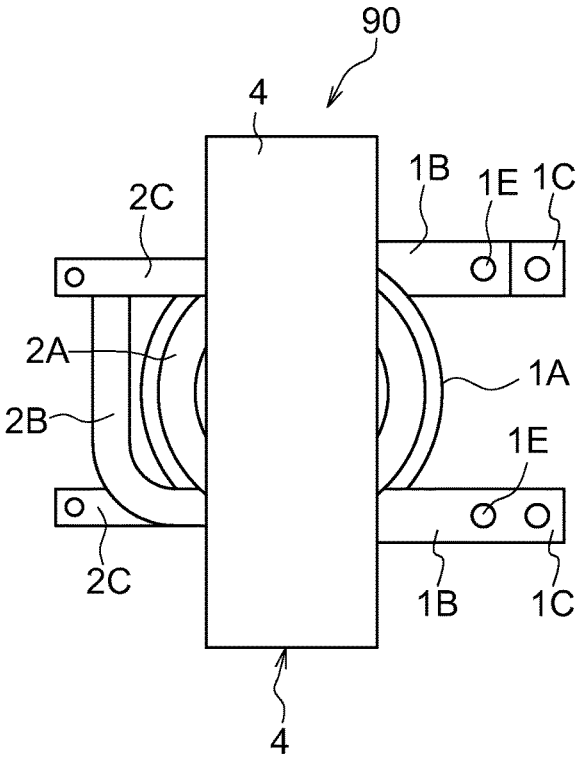
FIG. 42 is a plan view of the high frequency transformer of the ninth exemplary embodiment.

As illustrated in FIG. 41 and FIG. 42, a high frequency transformer 90 of the ninth exemplary embodiment is a core-type transformer provided with a shell-type ferrite core 4 including a single circular cylinder shaped central core 4A, and a primary coil assembly 1 and a secondary coil assembly 2 into which the central core 4A is inserted.

Figure 43:
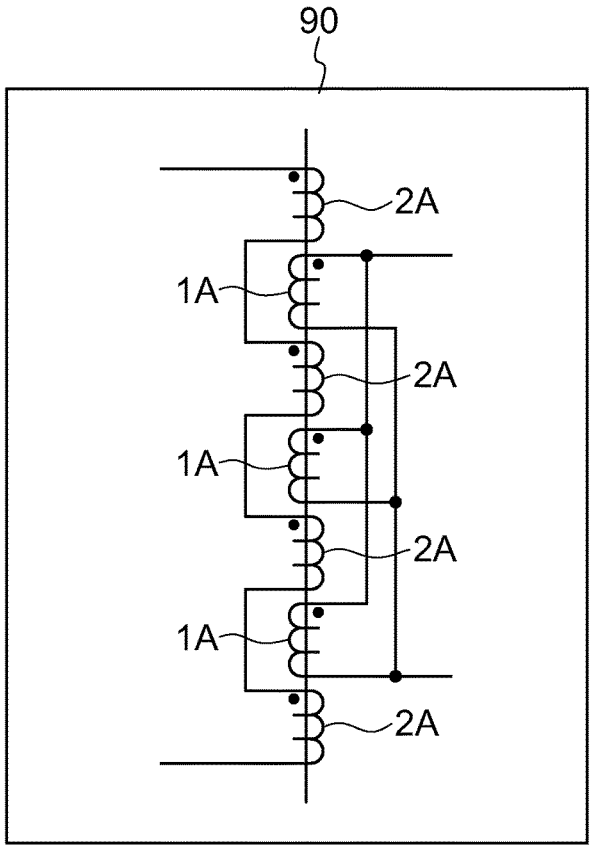
FIG. 43 is a wiring diagram illustrating connections of primary coils and secondary coils in the high frequency transformer of the ninth exemplary embodiment.

As illustrated in FIG. 41 to FIG. 43, the secondary coil assembly 2 is configured by in series connecting together four secondary coils 2A that configure the secondary coil assembly 2 with crossing wires 2B. The winding start portion of a first tier secondary coil 2A and the winding end portion of a fourth tier secondary coil 2A respectively configure lead wires 2C.

However, a primary coil assembly 1 is configured by connecting together in parallel three primary coils 1A that configure the primary coil assembly 1 with crossing bars 1E at one and the other crossing wires 1B. The winding start portion of a first tier primary coil 1A and the winding end portion of a third tier primary coil 1A configure lead wires 2C.

In the high frequency transformer 90, the primary coil assembly 1 and the secondary coil assembly 2 are combined together similarly to in the high frequency transformers of the seventh exemplary embodiment and the eighth exemplary embodiment, such that the primary coils 1A are inserted between adjacent secondary coils 2A, and the winding start portions of the respective primary coils 1A of the primary coil assembly 1 oppose the winding end portion of one of adjacent secondary coils 2A of the secondary coil assembly 2, and the winding end portion of the primary coil 1A opposes the winding start portion of the other of the adjacent secondary coils 2A. All of the primary coils 1A and the secondary coils 2A are moreover arrayed so as to be coaxial to each other.

Note that in the high frequency transformer 90, configuration may be made wherein the primary coils 1A are connected in series together and the secondary coils 2A are connected together in parallel instead of connecting together the primary coils 1A in parallel and in series connecting together the secondary coils 2A.

As illustrated in FIG. 43, in the high frequency transformer 90 the three primary coils 1A configuring the primary coil assembly 1 are connected together in parallel, and the four secondary coils 2A configuring the secondary coil assembly 2 are connected in series together. The high frequency transformer 90 is therefore particularly suitably employed in applications in which a low voltage high frequency current is input into the primary coil assembly 1 and a high voltage high frequency current is output from the secondary coils.

Explanation has been given above regarding embodiments of high frequency coils in which the primary coils are inserted between the secondary coils, with both the primary coils 1A and the secondary coils 2A respectively connected in series together, with both the primary coils 1A and the secondary coils 2A respectively connected together in parallel, and with the primary coils 1A connected together in parallel and the secondary coils 2A connected in series together, however the present invention also includes high frequency coils in which the primary coils 1A are connected in series together and the secondary coils 2A are connected together in parallel.

10. Tenth Exemplary Embodiment

Explanation follows regarding an example of a high frequency transformer of the present invention wherein the high frequency transformer is configured with primary coils inserted between the secondary coils, the primary coil assembly is formed by in series connecting together plural of the primary coils, and the secondary coil assembly is formed from a single flat wire.

As illustrated in FIG. 44 to FIG. 47, a high frequency transformer 100 of the tenth exemplary embodiment is provided with a shell-type ferrite core 4 including a single circular cylinder shaped central core 4A, and a primary coil assembly 1 and a secondary coil assembly 2 into which the central core 4A is inserted. The shell-type ferrite core 4 is configured similarly to as described above in the second exemplary embodiment and the fifth exemplary embodiment.

As illustrated in FIG. 44 to FIG. 47, in the primary coil assembly 1, three primary coils 1A of three turns each are connected in series and arrayed in uniform intervals such that the winding end portion of one of adjacent primary coils 1A opposes the winding start portion of the other of the adjacent primary coils 1A.

On the other hand, the secondary coil assembly 2 is formed from a single flat wire as described above, and is formed with four secondary coils 2A of four turns each, formed in uniform intervals such that the winding end portion of one of adjacent secondary coils 2A opposes the winding start portion of the other of the adjacent secondary coils 2A.

The primary coil assembly 1 and the secondary coil assembly 2 are combined together such that the primary coils 1A are inserted between adjacent secondary coils 2A, and the winding start portions of the respective primary coils 1A of the primary coil assembly 1 oppose the winding end portion of one of adjacent secondary coils 2A of the secondary coil assembly 2, and the winding end portion of the primary coil 1A opposes the winding start portion of the other of the adjacent secondary coils 2A. All of the primary coils 1A and the secondary coils 2A are moreover arrayed so as to be coaxial to each other.

In the primary coil assembly 1, the winding start portions and the winding end portions of the primary coils 1A configure crossing wires 1B that are pulled out to the outside. The crossing wires 1B are formed so as to straddle the outside of the adjacent secondary coils 2A, and the primary coils 1A are connected in series together at the crossing wires 1B to configure the primary coil assembly 1. The method for in series connecting together the primary coils 1A at the crossing wires 1B is similar to as described above in the seventh exemplary embodiment.

While, in the secondary coil assembly 2, the flat wire configuring the secondary coil assembly 2 configures crossing wires 2B that are pulled out to the outside of the secondary coils 2A at portions between adjacent secondary coils 2A.

Figure 47:
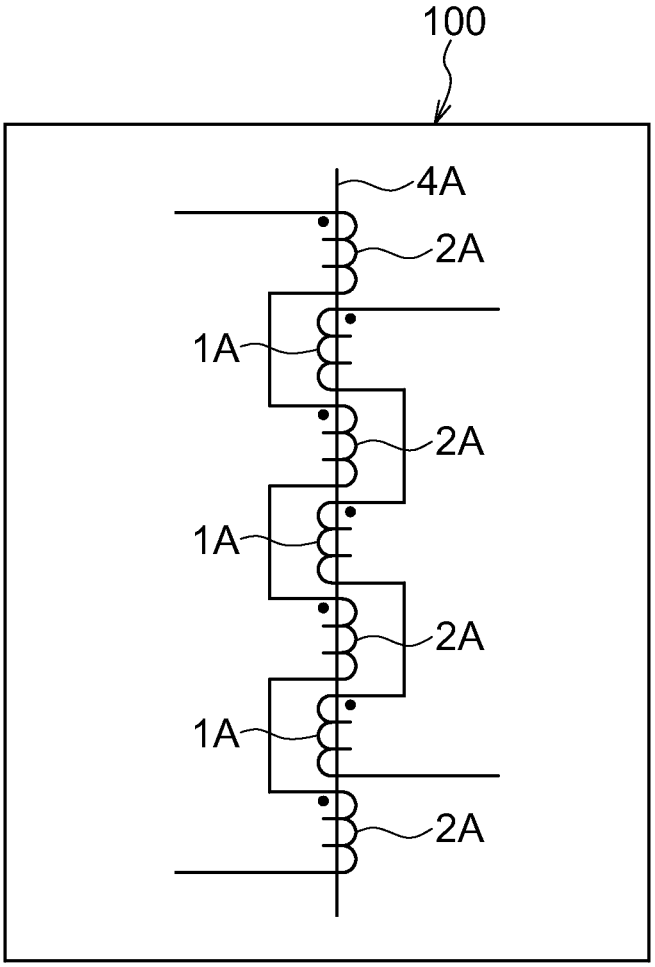
FIG. 47 is a wiring diagram illustrating connections of primary coils and secondary coils in the high frequency transformer of the tenth exemplary embodiment.
Figure 48:
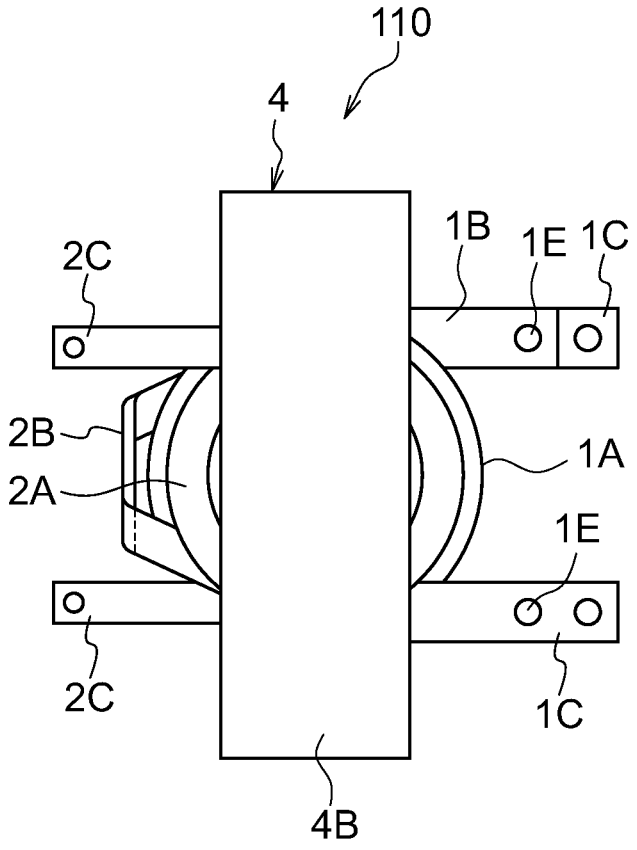
FIG. 48 is a plan view of a high frequency transformer of an eleventh exemplary embodiment.
Figure 49:
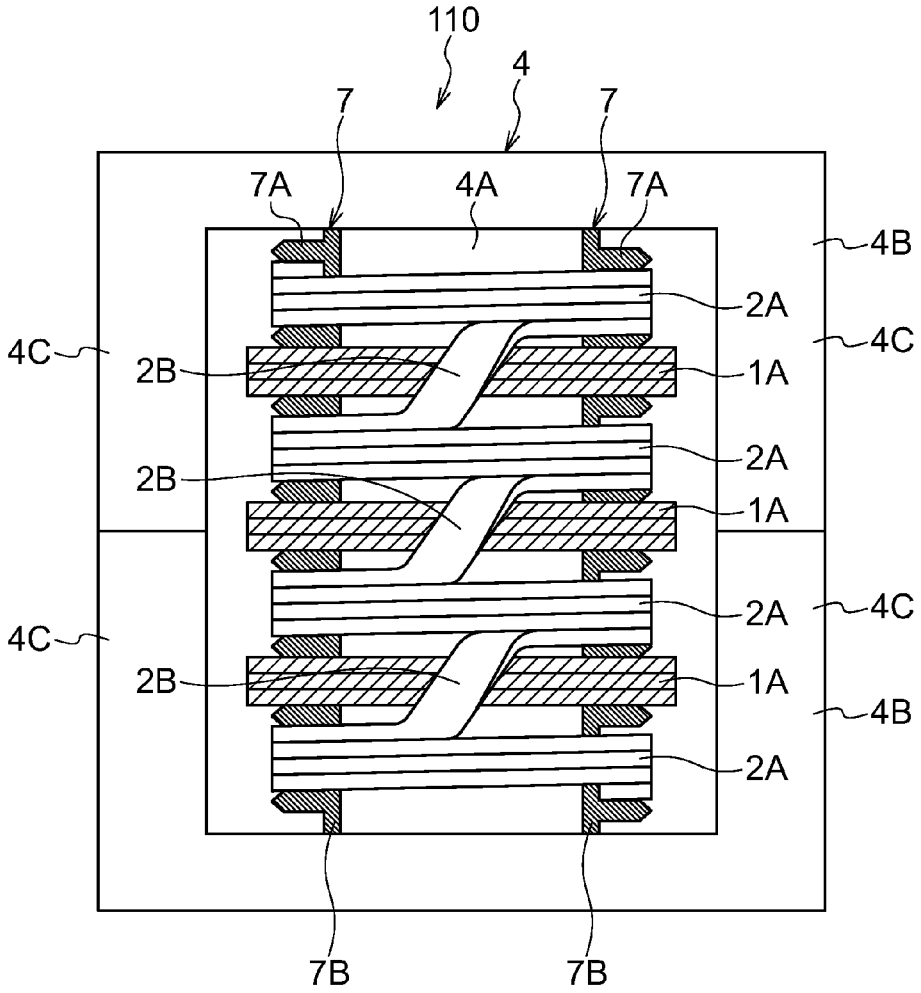
FIG. 49 is a front view of the high frequency transformer of the eleventh exemplary embodiment.
Figure 50:
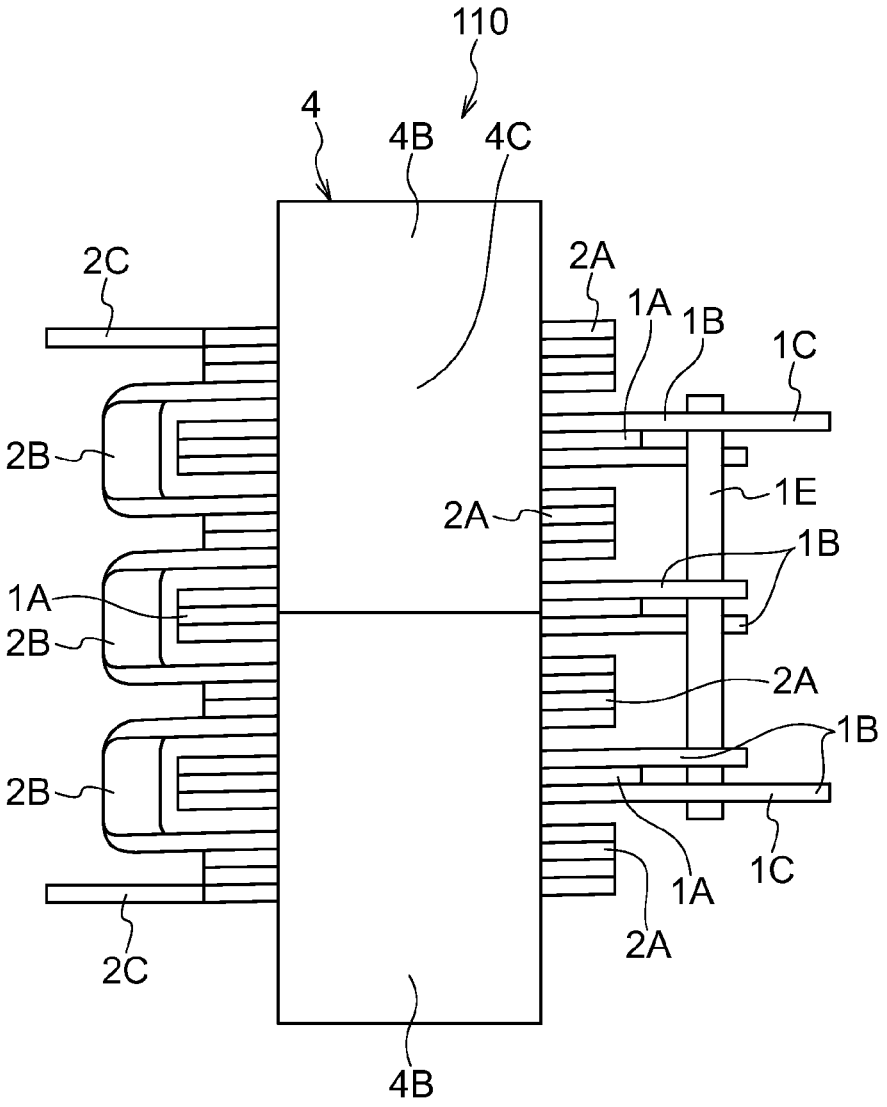
FIG. 50 is a side view of the high frequency transformer of the eleventh exemplary embodiment.
Figure 51:
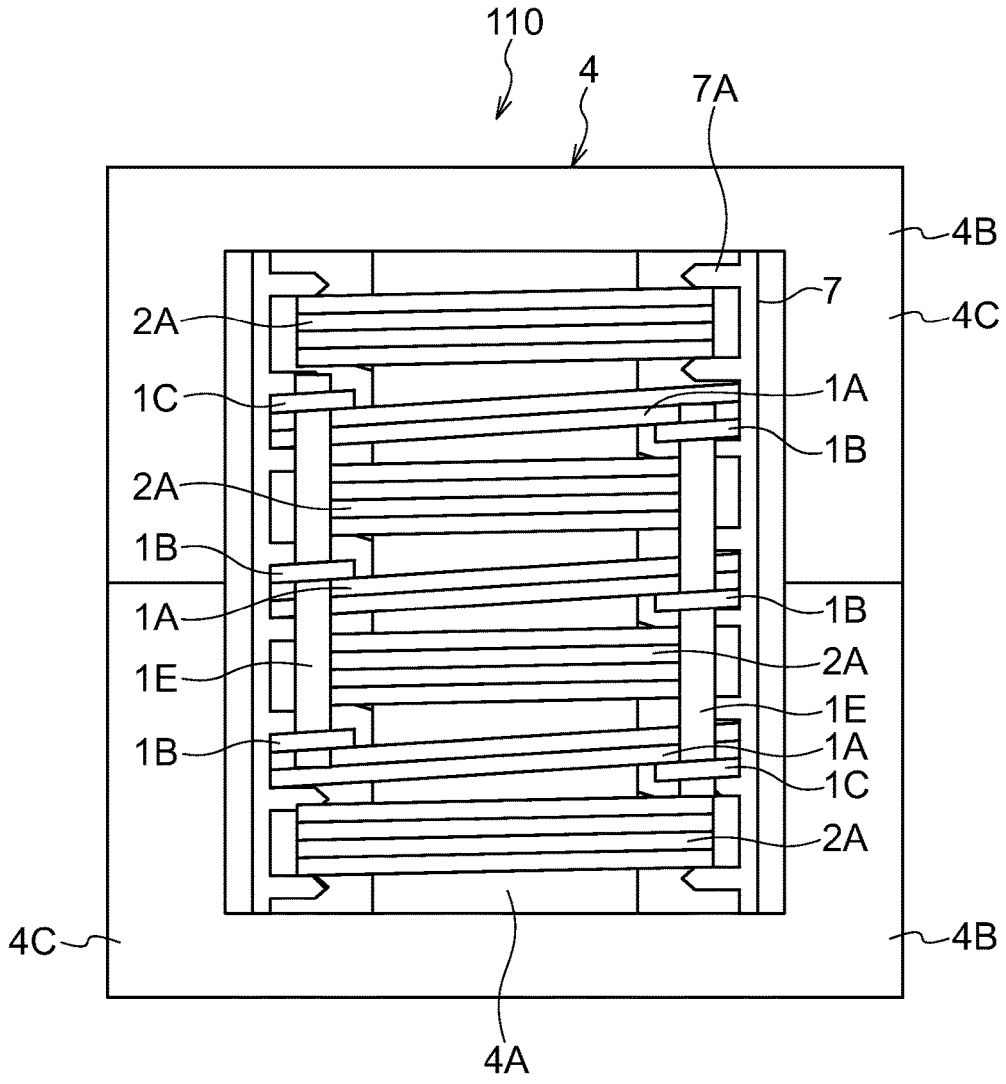
FIG. 51 is a rear view of the high frequency transformer of the eleventh exemplary embodiment.

As illustrated in FIG. 47, the primary coils 1A of the primary coil assembly 1 are accordingly arrayed in series, and the secondary coils 2A of the secondary coil assembly 2 are also arrayed in series.

Figure 44:
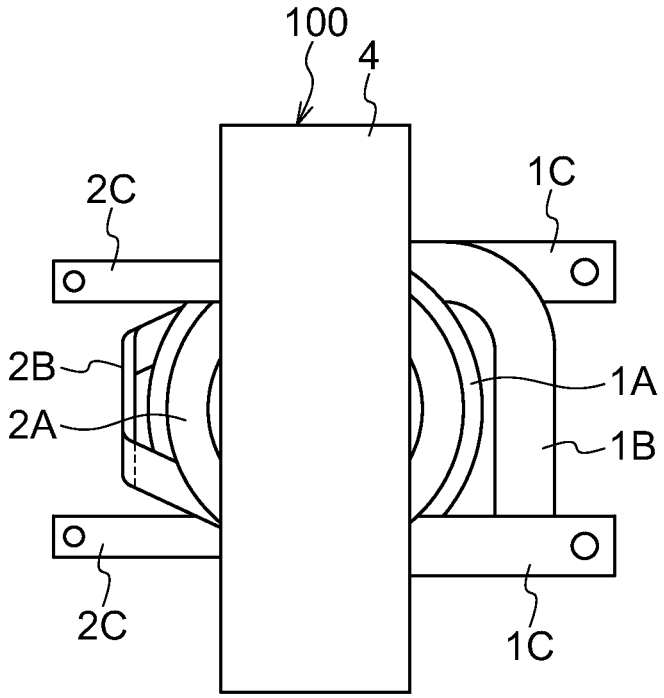
FIG. 44 is a plan view of a high frequency transformer of a tenth exemplary embodiment.
Figure 45:
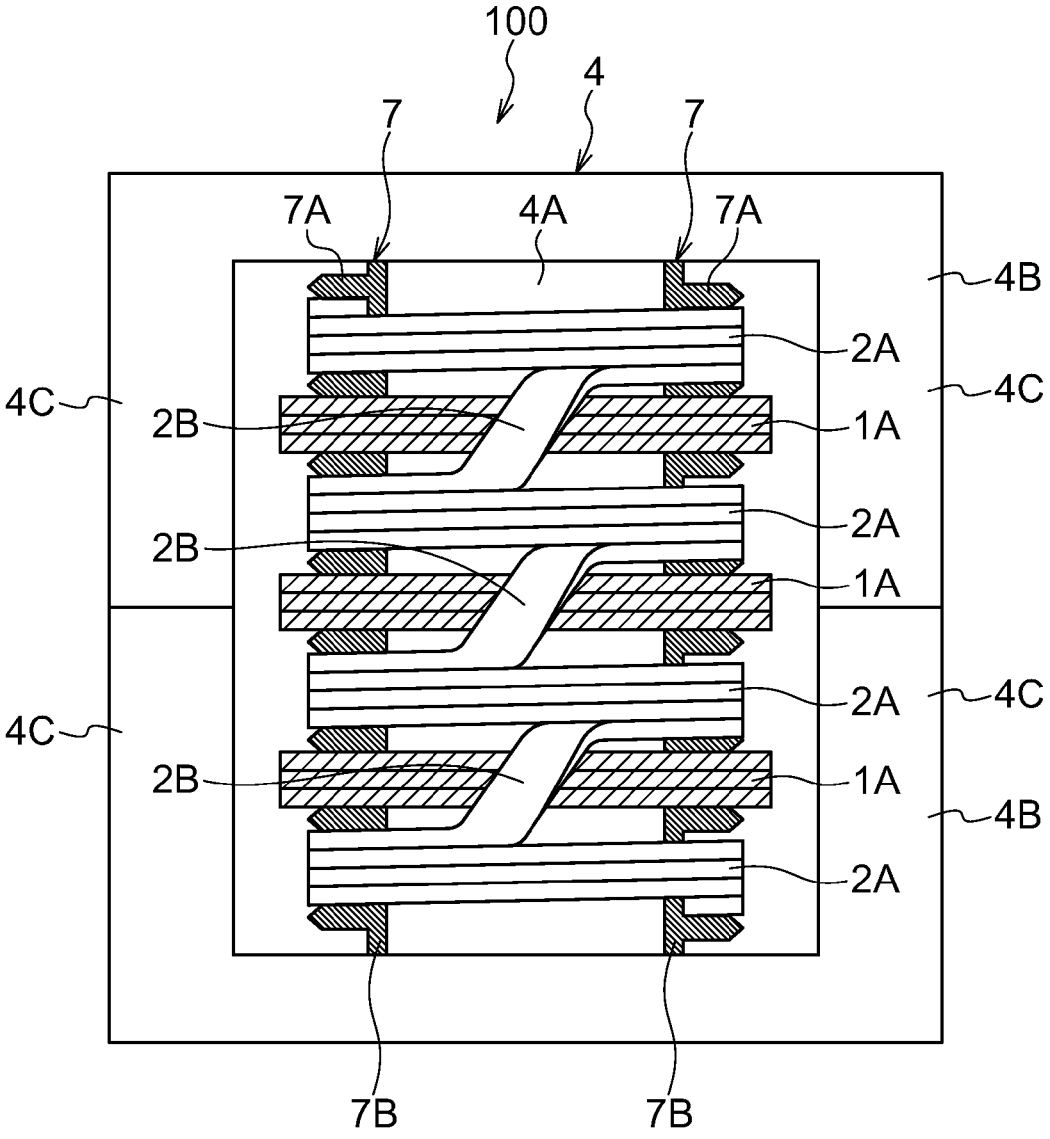
FIG. 45 is a front view of the high frequency transformer of the tenth exemplary embodiment.
Figure 46:
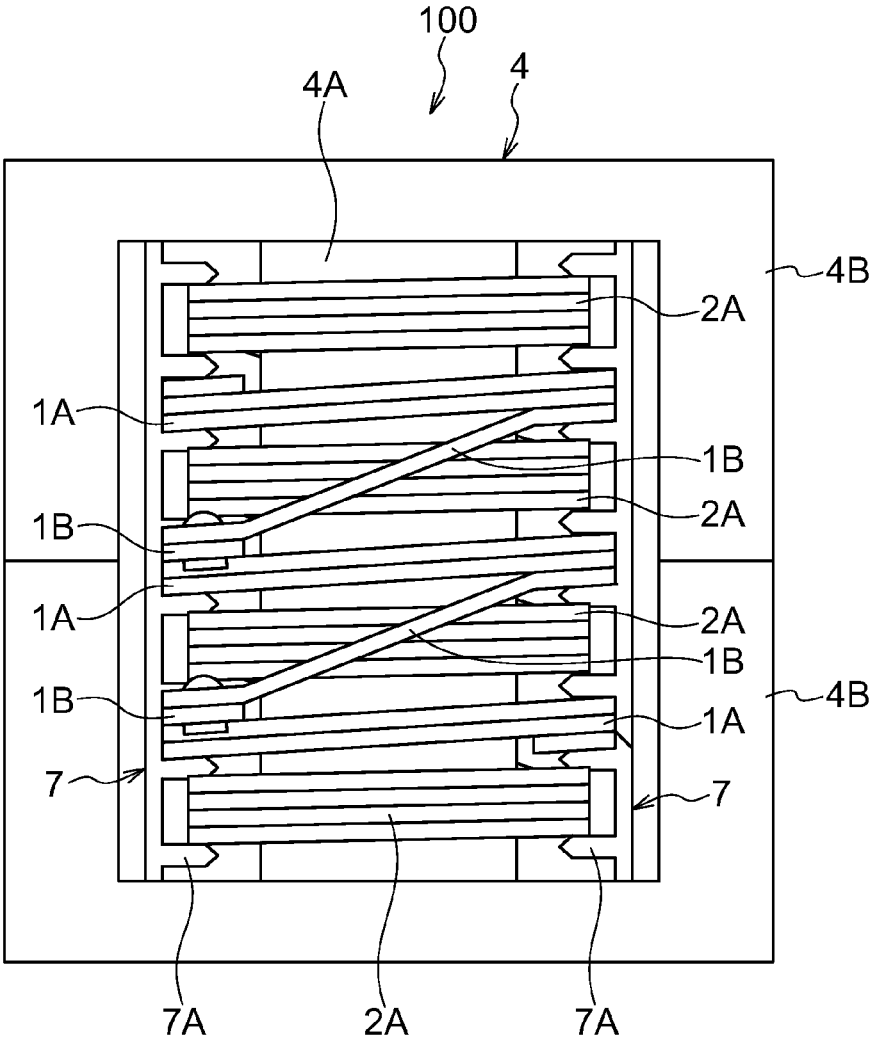
FIG. 46 is a rear view of the high frequency transformer of the tenth exemplary embodiment.

As illustrated in FIG. 44 to FIG. 46, out of the three primary coils 1A that form the primary coil assembly 1, the winding start portion of a first tier primary coil 1A and the flat wire winding end portion of a third tier primary coil 1A out of the three primary coils 1A are pulled out to the outside of the primary coils 1 to configure lead wires 1C. The lead wires 1C are connected to an input source that inputs a high frequency current into the primary coils 1.

Similarly, the winding start portion and the winding end portion of the flat wire that forms the secondary coil assembly 2 configure lead wires 2C that are pulled out to the outside of the secondary coils 2. A high frequency current that has a voltage and current corresponding to the ratio of turns between the primary coils 1 and the secondary coils 2 is output from the lead wires 2C.

Insulating members 7 are inserted between the primary coil assembly 1, the secondary coil assembly 2 and the central core 4A of the shell-type ferrite core 4 similarly to in the high frequency transformer of the fourth exemplary embodiment. Insulation tabs are configured similarly to as described above in the fourth exemplary embodiment.

The high frequency transformer 100 of the tenth exemplary embodiment employs the shell-type ferrite core 4 as the core similarly to the high frequency transformer 20 of the second exemplary embodiment, thereby increasing the ratio of the core with respect to the coils in comparison to high frequency transformers in which the ferrite core is a core-type core, thereby strengthening the iron machine characteristics. There is accordingly the advantageous effect of being suitably applied in applications with a small number of turns of the primary coils and the secondary coils, in particular in high frequency inverters (in the region of 50 kHz to 1 MHz).

In the high frequency transformer 100 the secondary coils 2A are moreover disposed at both ends, thereby making it easier to set a greater number of turns of the flat wire of the overall secondary coil assembly 2 than the number of turns of the flat wire of the overall primary coil assembly 1 than in a high frequency transformer configured with the primary coils 1A at both ends. The high frequency transformer 100 is accordingly suitably employed in applications in which a high voltage high frequency current is output.

11. Eleventh Exemplary Embodiment

Explanation follows regarding an example of a high frequency transformer of the present invention wherein the high frequency transformer is configured with the primary coils inserted between the secondary coils, the primary coil assembly is formed by connecting together plural of the primary coils in parallel, and the secondary coil assembly is formed from a single flat wire.

As illustrated in FIG. 48 to FIG. 51, a high frequency transformer 110 of the eleventh exemplary embodiment is provided with a shell-type ferrite core 4 including a single circular cylinder shaped central core 4A, and a primary coil assembly 1 and a secondary coil assembly 2 into which the central core 4A is inserted. The shell-type ferrite core 4 is configured similarly to as described above in the second exemplary embodiment and the fifth exemplary embodiment.

In the primary coil assembly 1, start end portions and finish end portions of the flat wires that form the primary coils 1A configure crossing wires 1B that are pulled out to the outside of the primary coil assembly 1. The crossing wires 1B are connected in parallel by crossing bars 1E. The primary coil assembly 1 is thus configured by connecting together in parallel three primary coils 1A that are of three turns each.

The winding start side crossing wire 1B of the primary coil 1A positioned at a first tier of the primary coil assembly 1 and the winding end side crossing wire 1B of the primary coil 1A positioned at a third tier of the primary coil assembly 1 respectively configure lead wires 1C.

The secondary coil assembly 2 is configured similarly to as described above in the tenth exemplary embodiment.

Figure 52:
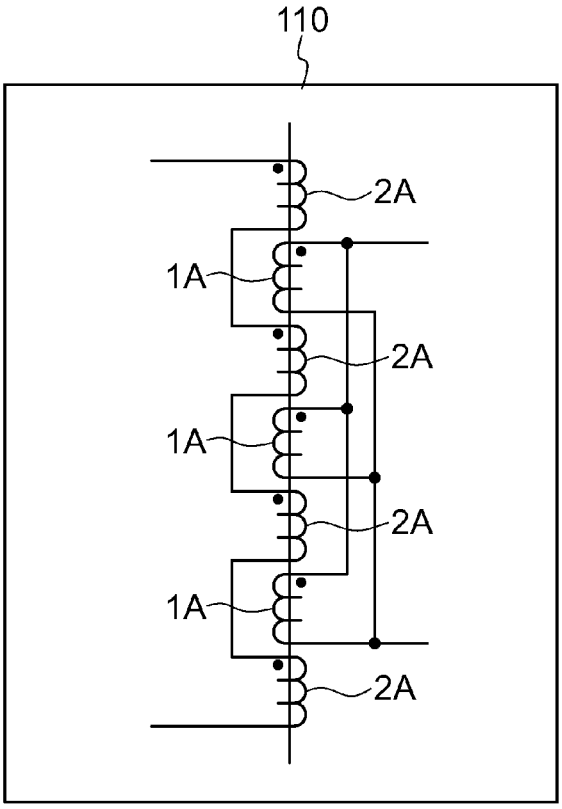
FIG. 52 is a wiring diagram illustrating connections of primary coils and secondary coils in the high frequency transformer of the eleventh exemplary embodiment.
Figure 53:
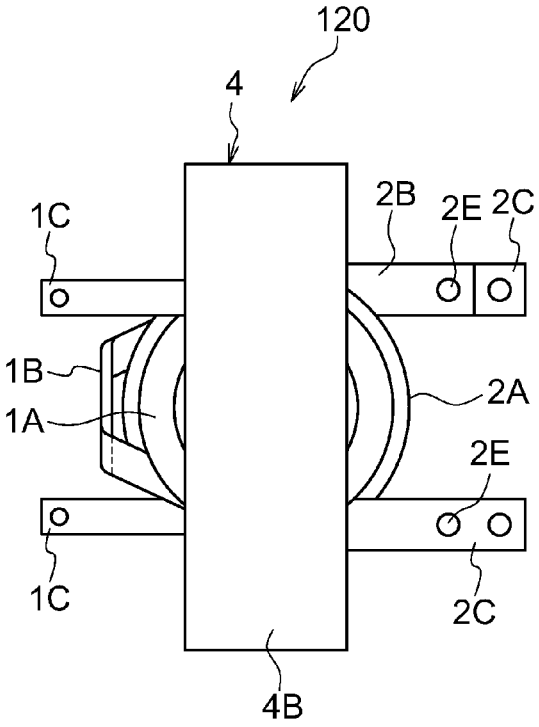
FIG. 53 is a plan view of a high frequency transformer of a twelfth exemplary embodiment.
Figure 54:
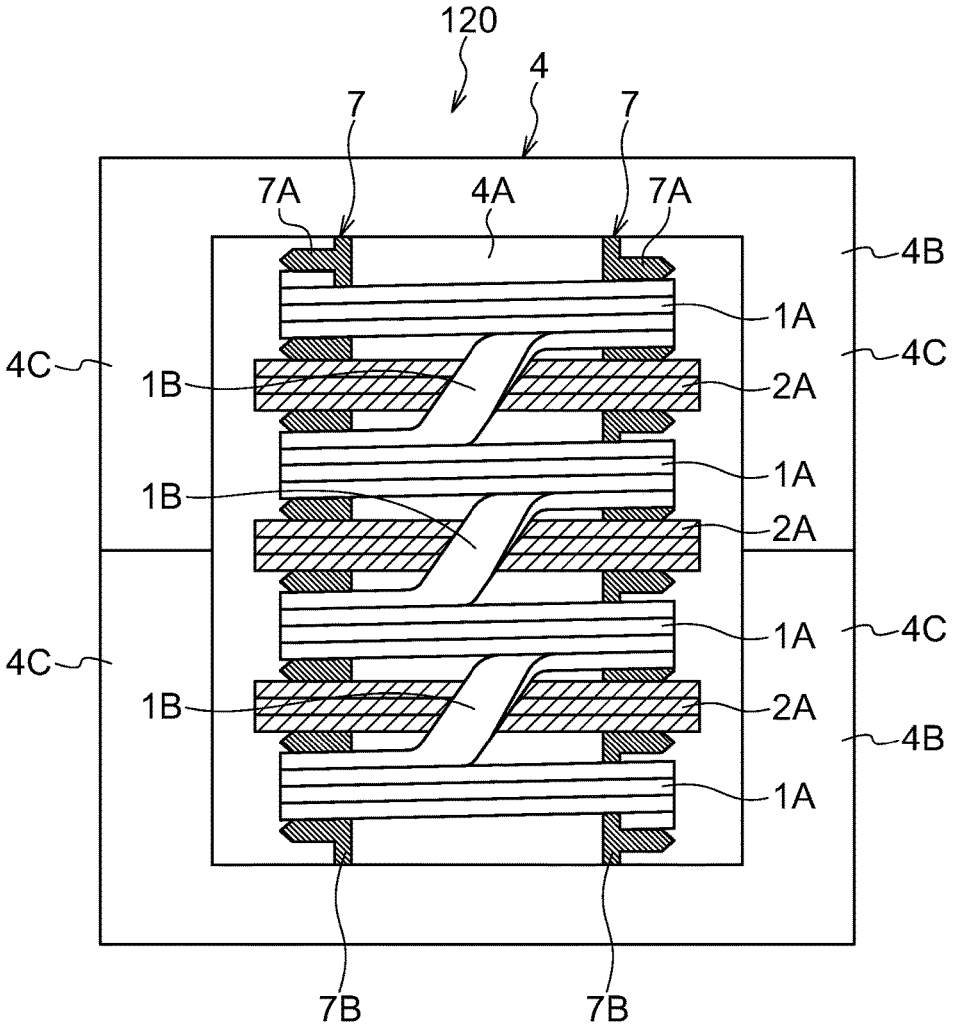
FIG. 54 is a front view of the high frequency transformer of the twelfth exemplary embodiment.
Figure 55:
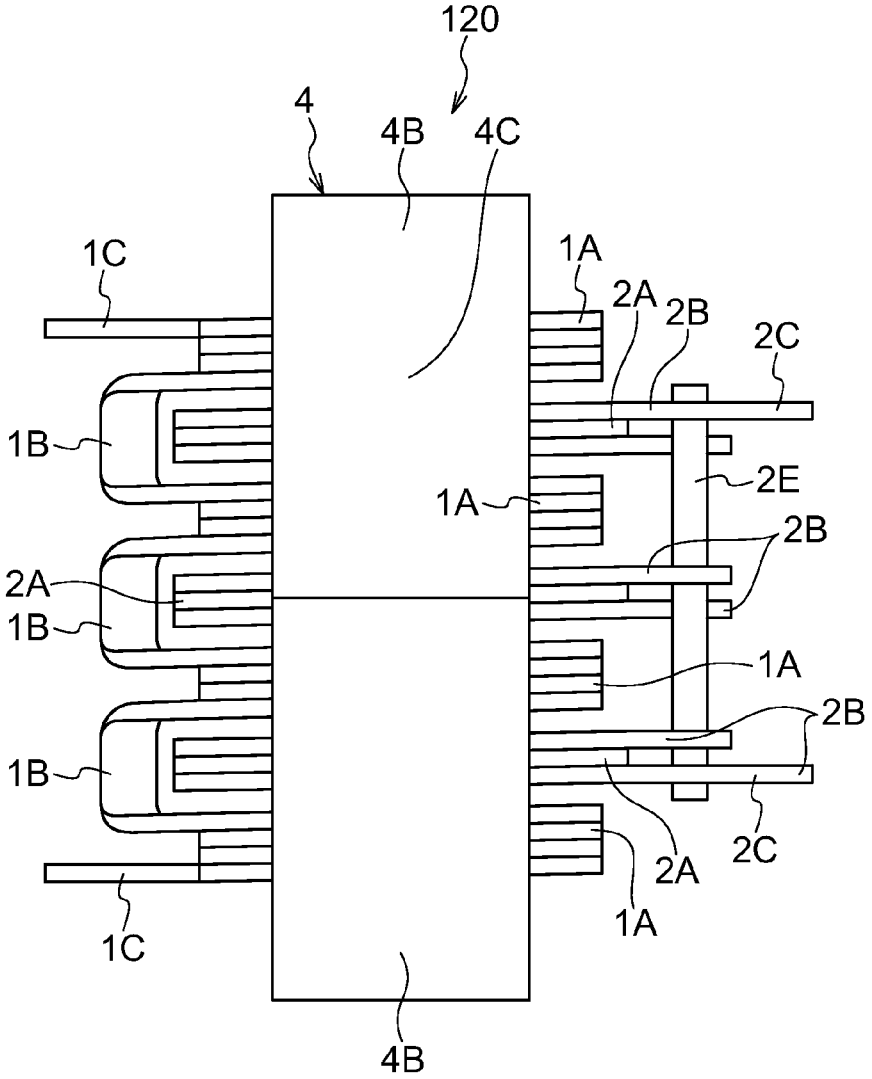
FIG. 55 is a side view of the high frequency transformer of the twelfth exemplary embodiment.
Figure 56:
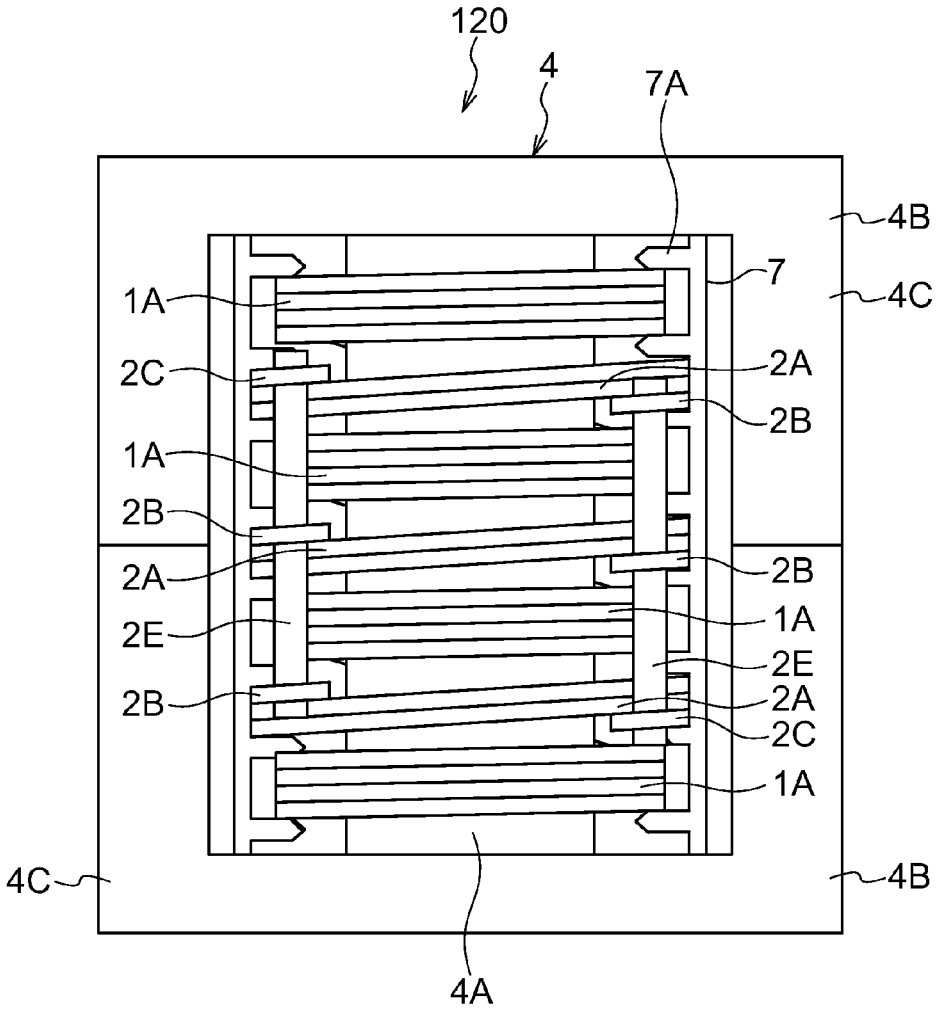
FIG. 56 is a rear view of the high frequency transformer of the twelfth exemplary embodiment.

As illustrated in FIG. 52, the primary coils 1A of the primary coil assembly 1 are configured in parallel, and the secondary coils 2A of the secondary coil assembly 2 are configured in series.

The primary coil assembly 1 and the secondary coil assembly 2 are combined together similarly to as described above in the tenth exemplary embodiment.

In the high frequency transformer 110 it is easier to set a greater number of turns of the flat wire of the overall secondary coil assembly 2 than the number of turns of the flat wire of the overall primary coil assembly 1 than in a high frequency transformer configured with the primary coils 1A at both ends. Since the primary coils 1A are connected together in parallel, the high frequency transformer 110 is accordingly suitably employed in applications in which a high frequency current of a large current is input and a high voltage high frequency current is output.

12. Twelfth Exemplary Embodiment

Explanation follows regarding an example of a high frequency transformer of the present invention wherein the secondary coils are inserted between the primary coils, the primary coil assembly is formed from a single flat wire, and the secondary coil assembly is formed by connecting together plural secondary coils in parallel.

As illustrated in FIG. 53 to FIG. 56, a high frequency transformer 120 of the twelfth exemplary embodiment is provided with a shell-type ferrite core 4 including a single circular cylinder shaped central core 4A, and a primary coil assembly 1 and a secondary coil assembly 2 into which the central core 4A is inserted. The shell-type ferrite core 4 is configured similarly to as described above in the second exemplary embodiment and the fifth exemplary embodiment.

The primary coil assembly 1 is configured similarly to as described above in the first exemplary embodiment.

In the secondary coil assembly 2, start end portions and finish end portions of the flat wires that configure the secondary coils 2A configure crossing wires 2B that are pulled out to the outside. The crossing wires 2B are connected in parallel by crossing bars 2E. The secondary coil assembly 2 is thus configured by connecting together in parallel three secondary coils 2A that are of three turns each.

The winding start side crossing wire 2B of the secondary coil 2A positioned at a first tier of the secondary coil assembly 2 and the winding end side crossing wire 2B of the secondary coil 2A positioned at a third tier of the secondary coil assembly 2 respectively configure lead wires 2C.

Figure 57:
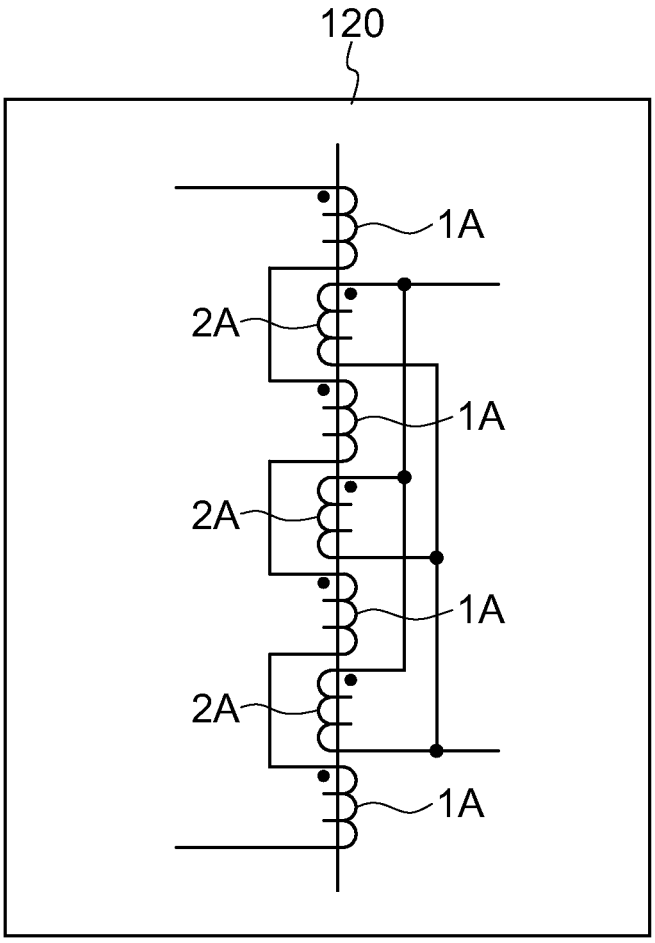
FIG. 57 is a wiring diagram illustrating connections of primary coils and secondary coils in the high frequency transformer of the twelfth exemplary embodiment.

As illustrated in FIG. 57, the primary coils 1A of the primary coil assembly 1 are configured in series, and the secondary coils 2A of the secondary coil assembly 2 are configured in parallel.

The primary coil assembly 1 and the secondary coil assembly 2 are combined together similarly to as described above in the tenth exemplary embodiment.

The high frequency transformer 120 has a coupling rate of close to 100% due to configuring the primary coils 1 at both ends, similarly to in the high frequency transformers of the first exemplary embodiment and the second exemplary embodiment.

Due to employing the shell-type ferrite core 4 as the core, similarly to the high frequency transformer of the second exemplary embodiment, the ratio of the core with respect to the coils is increased, thereby strengthening the iron machine characteristics. The high frequency transformer 120 is accordingly suitably employed in applications with a small number of turns of the primary coils and the secondary coils, in particular in high frequency inverters (in the region of 50 kHz to 1 MHz).

Moreover, due to forming the primary coil assembly 1 from a single continuous flat wire wound at a specific interval, the effort of manufacturing the primary coil assembly 1 by connecting separately formed primary coils 1A is not required, such that the primary coil assembly 1 is easily manufactured. Moreover, since the secondary coils 2A of the secondary coil assembly 2 are connected together in parallel, the high frequency transformer 120 is suitably employed in applications in which a large current is output.

EXPLANATION OF THE REFERENCE NUMERALS

1 primary coil assembly
1A primary coils
1B crossing wires
1C lead wires
1D crossing wire
1E crossing bars
2 secondary coil assembly
2A secondary coils
2B crossing wires
2C lead wires
2D crossing wire
2E crossing bars
3 core-type ferrite core
3A core
4 shell-type ferrite core
4A central core
5 three-legged ferrite core
5A columnar cores
5B top plate
5C bottom plate
7 insulating member
7A insulation tabs
7B insulation tab retaining members
10 high-frequency transformer
11 primary coil assembly
12 primary coil assembly
13 primary coil assembly
20 high frequency transformer
21 secondary coil assembly
22 secondary coil assembly
23 secondary coil assembly
30 three phase high frequency transformer
40 high frequency transformer
50 high frequency transformer
60 three phase high frequency transformer
70 high frequency transformer
80 high frequency transformer
90 high frequency transformer
100 high frequency transformer
110 high frequency transformer
120 high frequency transformer

The invention claimed is:

1. A high frequency transformer comprising:

a primary coil assembly formed from a single flat wire, with a plurality of primary coils that are respectively configured by winding the flat wire edgewise a plurality of times and are formed at specific intervals such that a winding end portion of one of adjacent primary coils opposes a winding start portion of the other of the adjacent primary coils, the plurality of primary coils being connected and disposed in series;

a secondary coil assembly formed from a single flat wire, with a plurality of secondary coils that are respectively configured by winding the flat wire edgewise a plurality of times and are formed at specific intervals such that a winding end portion of one of adjacent secondary coils opposes a winding start portion of the other of the adjacent secondary coils, the plurality of secondary coils being connected and disposed in series; and a shell-type core;

with the primary coil assembly and the secondary coil assembly disposed such that the primary coils of the primary coil assembly and the secondary coils of the secondary coil assembly are disposed alternately to each other on a common coil axis, and the secondary coils are inserted between adjacent primary coils such that a winding start portion of each of the secondary coils in the secondary coil assembly opposes a winding end portion of one of adjacent primary coils in the primary coil assembly, and a winding end portion of each of the secondary coils opposes a winding start portion of the other of the adjacent primary coils, the primary coils positioned at ends of the primary coil assembly are disposed further outside along the common coil axis than secondary coils positioned at ends of the secondary coil assembly, wherein the primary coil assembly and the secondary assembly are configured such that high frequency current flows therein and so as to boost or reduce an electric voltage of a high frequency current input to the primary coil assembly and output the high frequency current with the boosted or reduced electric voltage from the secondary coil assembly, wherein the shell-type core comprises:

a central core that is formed of ferrite and around which the primary coils and the secondary coils are wound; and an outside core that is formed of ferrite and configured so as to enclose the central core from the outside, wherein the outside core includes:

a lower portion core located at one end of the central core; an upper portion core located at the other end of the central core;

a first side core extending from one end of the lower portion core to one end of the upper portion core so as to be parallel to the central core; and a second side core extending from the other end of the lower core to the other end of the upper portion core so as to be parallel to the central core.

2. The high frequency transformer of claim 1, wherein:

the primary coils are secondary coils and the secondary coils are primary coils, and the primary coil assembly is a secondary coil assembly and the secondary coil assembly is a primary coil assembly.

3. The high frequency transformer of claim 1, wherein the number of the primary coils is four or more, and the number of the secondary coils is three or more.

4. The high frequency transformer of claim 2, wherein the number of the secondary coils is four or more, and the number of the primary coils is three or more.

5. The high frequency transformer of claim 1 wherein the flat wire configuring the primary coil assembly and the flat wire configuring the secondary coil assembly differ from each other in width, in thickness, or in both width and thickness.

6. The high frequency transformer of claim 1, wherein in the flat wire configuring the primary coil assembly, sections between the adjacent primary coils function as crossing wires formed by being pulled out to the outside of the primary coils, and wherein sections between the adjacent secondary coils function as crossing wires formed by being pulled out to the outside of the secondary coils, the crossing wires in the primary coil assembly being formed so as to straddle the outside of the secondary coils located between the adjacent primary coils, and the crossing wires in the secondary coil assembly being formed so as to straddle outside of the primary coils located between the adjacent secondary coils; and wherein the faces of the crossing wires in the primary coil assembly and the faces of the crossing wires in the secondary coil assembly are a face along the coil axis of the primary and secondary coil assemblies.

7. The high frequency transformer of claim 1, comprising three each of the primary coil assemblies and the secondary coil assemblies, the secondary coils in the secondary coil assemblies having an inner diameter that is the same as the inner diameter of the primary coils of the primary coil assemblies, the primary coil assemblies and the secondary coil assemblies intervening with each other in a manner such that the inner peripheries of the primary coils and the inner peripheries of the secondary coils coincide, respective columnar cores being inserted in respective inner portions of the primary coil assemblies and the secondary coil assemblies intervening with each other, and the primary coil assemblies being Δ-connected or Y-connected and the secondary coil assemblies being Δ-connected or Y-connected.

8. The high frequency transformer of claim 7, wherein the three primary coil assemblies are Y-connected by connecting one end of each of the primary coil assemblies by a connecting ring, the three secondary coil assemblies are Δ-connected by connecting one end of one secondary coil assembly to the other end of another secondary coil assembly, the connecting ring being an annular plate-like conductor that is disposed in parallel to a top plate of a core, and one end of one secondary coil assembly and the other end of another secondary coil assembly are taken outside the secondary coil assemblies to configure lead wires, and one of the lead wires extends along the coil axes of the primary coil assemblies and the secondary coil assemblies.

9. The high frequency transformer of claim 1, wherein the shell-type core is configured so as to be able to be split into a first E-shaped core and a second E-shaped core, the first E-shaped core being integrally formed of a portion of the central core, the lower portion core of the outside core, and a portion of the first and second side cores of the outside core, and the second E-shaped core being integrally formed of the rest of the central core, the upper portion core of the outside core, and the rest of the first and second side cores of the outside core.

10. The high frequency transformer of claim 1, wherein the shell-type core is configured so as to be able to be split into:

an E-shaped core being integrally formed of the central core, the lower portion core of the outside core, and the first and second side cores of the outside core; and an I-shaped core corresponding to the upper portion core of the outside core.

11. The high frequency transformer of claim 1, further comprising insulating members including:

insulating tabs that are inserted between the primary coils and the secondary coils; and an insulating tab retaining member retaining the insulating tabs at specific intervals.

* * * * *